US006881046B2

(12) United States Patent
Shibamoto et al.

(10) Patent No.: US 6,881,046 B2
(45) Date of Patent: Apr. 19, 2005

(54) SCROLL TYPE FLUID MACHINE

(75) Inventors: Yoshitaka Shibamoto, Sakai (JP); Katsumi Kato, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 34 days.

(21) Appl. No.: 10/469,401

(22) PCT Filed: Mar. 6, 2003

(86) PCT No.: PCT/JP03/02679

§ 371 (c)(1),
(2), (4) Date: Aug. 28, 2003

(87) PCT Pub. No.: WO03/076808

PCT Pub. Date: Sep. 18, 2003

(65) Prior Publication Data

US 2004/0101428 A1 May 27, 2004

(30) Foreign Application Priority Data

Mar. 13, 2002 (JP) ..... 2002-68613

(51) Int. Cl.[7] ..... F04C 18/00
(52) U.S. Cl. ..... 418/55.2; 418/55.1; 418/55.4
(58) Field of Search ..... 418/55.1, 55.2, 418/55.4, 55.5, 57

(56) References Cited

U.S. PATENT DOCUMENTS 3,994,635 A * 11/1976 McCullough ..... 418/55.4
5,000,669 A * 3/1991 Shimizu et al. ..... 418/1
5,466,134 A 11/1995 Shaffer et al.
5,551,846 A * 9/1996 Taylor et al. ..... 418/55.1
5,632,612 A 5/1997 Shaffer
6,264,444 B1 * 7/2001 Nakane et al. ..... 418/55.1
6,638,040 B1 * 10/2003 Wang et al. ..... 418/55.1

FOREIGN PATENT DOCUMENTS

| | | | |
|---|---|---|---|
| JP | 02-227581 | 9/1990 | |
| JP | 03-031502 | 2/1991 | |
| JP | 05-296168 | 11/1993 | |
| JP | 06-330864 | 11/1994 | |
| JP | 06330864 A * | 11/1994 | ..... F04C/18/02 |
| JP | 07-019187 | 1/1995 | |
| JP | 07-269472 | 10/1995 | |
| JP | 10-082384 | 3/1998 | |
| JP | 2000-027768 | 1/2000 | |

* cited by examiner

*Primary Examiner*—Thomas Denion
*Assistant Examiner*—Theresa Trieu
(74) *Attorney, Agent, or Firm*—Shinjyu Global IP Counselors, LLP

(57) ABSTRACT

A stationary scroll is provided with a stationary side wrap and an outer peripheral portion. The stationary side wrap is formed into a spiral wall shape. The outer peripheral portion is formed into a ring-like shape enclosing the periphery of the stationary side wrap. A movable scroll is provided with a first flat plate, a movable side wrap, and a second flat plate. The movable side wrap is formed into a spiral wall shape. Additionally, the movable side wrap is caught between the first flat plate and the second flat plate, with the movable side wrap in mating engagement with the stationary side wrap. In the movable side wrap, the first flat plate is formed integrally with the movable side wrap. Additionally, the second flat plate is formed as a separate body from the first flat plate and the movable side wrap and is coupled to the first flat plate with a bolt.

23 Claims, 25 Drawing Sheets

(CONVENTIONAL SCROLL COMPRESSOR)

(SCROLL COMPRESSOR OF PRESENT INVENTION)

(ENTIRE STATIONARY SCROLL )

(LONGITUDINAL SECTION OF STATIONARY SCROLL )

(CONVENTIONAL SCROLL COMPRESSOR )

(SCROLL COMPRESSOR OF PRESENT INVENTION)

SCROLL TYPE FLUID MACHINE

TECHNICAL FIELD

The present invention relates to fluid machines of the scroll type.

BACKGROUND ART

Scroll type fluid machines have been well known in the prior art. For example, Japanese Patent Kokai number (1994)330864 discloses a compressor composed of a scroll type fluid machine.

An arrangement of a typical scroll type fluid machine will be described below. This type of fluid machine includes a stationary scroll and a movable scroll. The stationary and movable scrolls include respective tabular flat plate portions and spiral wraps. In both the scrolls, the wraps are vertically arranged on front surface sides of the flat plate portions. Additionally, in both the scrolls the wraps are formed integrally with the flat plate portions, respectively. The stationary and movable scrolls are disposed in such an orientation that they face each other, and their respective wraps are matingly engaged with each other. The wraps, which are being engaged with each other, are sandwiched between the flat plate portions. In this state, a fluid chamber is comparted by the wraps and the flat plate portions.

The stationary scroll is secured firmly to a housing of the fluid machine. On the other hand, the movable scroll is placed in the housing through an Oldham ring. This Oldham ring constitutes a rotation preventing mechanism for preventing rotation of the movable scroll. Additionally, in the movable scroll a bearing is formed on a back surface side of the flat plate portion, and an eccentric portion of a rotary shaft engages with the bearing. The movable scroll orbits but does not rotate.

When such a scroll type fluid machine is used as a refrigerant compressor, a gas refrigerant is drawn to areas near the outer peripheral side ends of the wraps. The gas refrigerant is trapped in the inside of the fluid chamber. When the movable scroll is driven through the rotary shaft, the volume of the fluid chamber gradually decreases, and the gas refrigerant in the inside of the fluid chamber is compressed. When the fluid chamber reaches near the inner peripheral side ends of the wraps, the compressed gas refrigerant is discharged through discharge ports opening to the flat plate portions.

Problems that Invention Intends to Solve

In a scroll type fluid machine a movable scroll executes an orbital motion with its wrap in mating engagement with a stationary scroll wrap. During that period, wrap side surfaces of both the scrolls come into sliding contact with each other and, furthermore, wrap tips and flat plate portions of both the scrolls come into sliding contact with each other. If there is created an excessive gap between the wraps which are sliding against each other or between the wrap tip and the flat plate portion which are sliding against each other, this will cause leakage of fluid from the fluid chamber. As a result, the efficiency of the fluid machine will drop. Consequently, in order to avoid the drop in fluid machine efficiency, it is required that surfaces which are brought into sliding contact with each other (i.e., sliding surfaces) be finished with a high degree of accuracy.

However, the problem with conventional scroll type fluid machines is that it is difficult to provide highly accurately machined sliding surfaces to the wrap tip and the flat plate portion. This problem will be described below.

For example, the movable side wrap tip of the movable scroll slides against the stationary side flat plate portion of the stationary scroll. On the other hand, as has been described above, in each scroll the wrap is formed integrally with the flat plate portion. Consequently, the sliding surface of the stationary side flat plate portion with respect to the movable side wrap tip lies at the bottom of the stationary side wrap.

Accordingly, high accuracy machining of the sliding surface of the flat plate portion with respect to the wrap tip is difficult to carry out. In other words, it is difficult to reduce the surface roughness of the sliding surface and it is also difficult to improve the flatness of the sliding surface. Consequently, in conventional scroll type fluid machines it is impossible to effectively control leakage of fluid through a gap between the wrap tip and the flat plate portion. Due to this, it is difficult to achieve improvements in efficiency.

Bearing in mind the above-described problems, the present invention was made. Accordingly, an object of the present invention is to make it possible to machine wrap tip and flat plate portion sliding surfaces with ease and with high accuracy, for improving the efficiency of fluid machinery.

DISCLOSURE OF INVENTION

The present invention provides a first problem solving means which is directed to a scroll type fluid machine comprising a stationary scroll (40), a movable scroll (50) which executes an orbital motion, a rotation preventing mechanism for preventing rotation of the movable scroll (50), and a rotary shaft (20). The movable scroll (50) includes a first flat plate portion (51) which engages with an eccentric portion (21) of the rotary shaft (20), and a movable side wrap (53) which is formed integrally with the first flat plate portion (51). The stationary scroll (40) includes a stationary side wrap (41) which matingly engages with the movable side wrap (53), and a second flat plate portion (52) which is formed as a separate body from the stationary side wrap (41) and which faces the first flat plate portion (51) across the stationary side wrap (41). The stationary side wrap (41), the movable side wrap (53), the first flat plate portion (51), and the second flat plate portion (52) together define a fluid chamber (60).

The present invention provides a second problem solving means which is directed to a scroll type fluid machine comprising a stationary scroll (40), a movable scroll (50), a rotation preventing mechanism for preventing rotation of the movable scroll (50), and a rotary shaft (20). The stationary scroll (40) includes a stationary side wrap (41). The movable scroll (50), including a first flat plate portion (51) which engages with an eccentric portion (21) of the rotary shaft (20), a movable side wrap (53) which is formed integrally with the first flat plate portion (51) and which matingly engages with the stationary side wrap (41), and a second flat plate portion (52) which is formed as a separate body from the first flat plate portion (51) and the movable side wrap (53) and which faces the first flat plate portion (51) across the movable side wrap (53), is so constructed as to execute an orbital motion with the second flat plate portion (52) coupled to the first flat plate portion (51) or to the movable side wrap (53). The stationary side wrap (41), the movable side wrap (53), the first flat plate portion (51), and the second flat plate portion (52) together define a fluid chamber (60).

The present invention provides a third problem solving means which is directed to a scroll type fluid machine comprising a stationary scroll (40), a movable scroll (50), a rotation preventing mechanism for preventing rotation of the movable scroll (50), and a rotary shaft (20). The stationary scroll (40) includes a stationary side wrap (41). The movable scroll (50), including a first flat plate portion (51) which engages with an eccentric portion (21) of the rotary shaft (20), a movable side wrap (53) which is formed as a separate body from the first flat plate portion (51) and which matingly engages with the stationary side wrap (41), and a second flat plate portion (52) which is formed integrally with the movable side wrap (53) and which faces the first flat plate portion (51) across the movable side wrap (53), is so constructed as to execute an orbital motion with the first flat plate portion (51) coupled to the second flat plate portion (52) or to the movable side wrap (53). The stationary side wrap (41), the movable side wrap (53), the first flat plate portion (51), and the second flat plate portion (52) together define a fluid chamber (60).

The present invention provides a fourth problem solving means which is directed to a scroll type fluid machine comprising a stationary scroll (40), a movable scroll (50), a rotation preventing mechanism for preventing rotation of the movable scroll (50), and a rotary shaft (20). The stationary scroll (40) includes a stationary side wrap (41). The movable scroll (50), including a first flat plate portion (51) which engages with an eccentric portion (21) of the rotary shaft (20), a movable side wrap (53) which is formed as a separate body from the first flat plate portion (51) and which matingly engages with the stationary side wrap (41), and a second flat plate portion (52) which is formed as a separate body from the first flat plate portion (51) and the movable side wrap (53) and which faces the first flat plate portion (51) across the movable side wrap (53), is so constructed as to execute an orbital motion with the first flat plate portion (51), the movable side wrap (53), and the second flat plate portion (52) coupled to one another. The stationary side wrap (41), the movable side wrap (53), the first flat plate portion (51), and the second flat plate portion (52) together define a fluid chamber (60).

The present invention provides a fifth problem solving means according to the first problem solving means in which the stationary scroll (40) includes an outer peripheral portion (42) which is formed integrally with the stationary side wrap (41) and which encloses the periphery of the stationary side wrap (41), and the outer peripheral portion (42) is greater in height than the stationary side wrap (41) so that there is created a gap between a tip of the stationary side wrap (41) and the first flat plate portion (51).

The present invention provides a sixth problem solving means according to any one of the second to fourth problem solving means in which the stationary scroll (40) includes an outer peripheral portion (42) which is formed integrally with the stationary side wrap (41) and which encloses the periphery of the stationary side wrap (41), and the outer peripheral portion (42) is greater in height than the stationary side wrap (41) so that there is created a gap between a tip of the stationary side wrap (41) and either the first flat plate portion (51) or the second flat plate portion (52).

The present invention provides a seventh problem solving means according to any one of the second to fourth problem solving means in which the movable side wrap (53) is greater in height than the stationary side wrap (41).

The present invention provides an eighth problem solving means according to any one of the second to fourth problem solving means in which the stationary side wrap (41) is such formed that a central portion of the stationary side wrap (41) is less in height than an outer peripheral portion of the stationary side wrap (41).

The present invention provides a ninth problem solving means according to the fifth problem solving means in which the tip of the stationary side wrap (41) is provided with a tip seal (72) against which the first flat plate portion (51) slides.

The present invention provides a tenth problem solving means according to the sixth problem solving means in which the tip of the stationary side wrap (41) is provided with a tip seal (72) against which either the first flat plate portion (51) or the second flat plate portion (52) slides.

The present invention provides an eleventh problem solving means according to the seventh problem solving means in which the tip of the stationary side wrap (41) is provided with a tip seal (72) against which either the first flat plate portion (51) or the second flat plate portion (52) slides.

The present invention provides a twelfth problem solving means according to the eighth problem solving means in which the tip of the stationary side wrap (41) is provided with a tip seal (72) against which either the first flat plate portion (51) or the second flat plate portion (52) slides.

The present invention provides a thirteenth problem solving means according to any one of the second to fourth problem solving means in which a plurality of support post portions (61) for maintaining spacing between the first flat plate portion (51) and the second flat plate portion (52) are mounted outside the movable side wrap (53) in the movable scroll (50).

The present invention provides a fourteenth problem solving means according to the thirteenth problem solving means in which the plurality of support post portions (61) are so formed as to be greater in height than the movable side wrap (53).

The present invention provides a fifteenth problem solving means according to the thirteenth problem solving means in which the stationary scroll (40) includes an outer peripheral portion (42) which is formed integrally with the stationary side wrap (41) and which encloses the periphery of the stationary side wrap (41), and a plurality of guide apertures (47) into which are inserted the plurality of support post portions (61) are formed in the outer peripheral portion (42), and the plurality of guide apertures (47) of the outer peripheral portion (42) and the plurality of support post portions (61) which are inserted into the plurality of guide apertures (47) to slide against side walls thereof together constitute the rotation preventing mechanism for preventing rotation of the movable scroll (50).

The present invention provides a sixteenth problem solving means according to the first problem solving means in which the stationary side wrap (41) is such formed that the thickness of a part of the stationary side wrap (41) or the overall thickness of the stationary side wrap (41) is greater than the thickness of the movable side wrap (53).

The present invention provides a seventeenth problem solving means according to any one of the second to fourth problem solving means in which the stationary side wrap (41) is such formed that the thickness of a part of the stationary side wrap (41) or the overall thickness of the stationary side wrap (41) is greater than the thickness of the movable side wrap (53).

The present invention provides an eighteenth problem solving means according to the first problem solving means in which the Young's modulus of a material used to form the stationary side wrap (41) is higher than the Young's modulus of a material used to form the movable side wrap (53).

The present invention provides a nineteenth problem solving means according to any one of the second to fourth problem solving means in which the Young's modulus of a material used to form the stationary side wrap (41) is higher than the Young's modulus of a material used to form the movable side wrap (53).

The present invention provides a twentieth problem solving means according to the first problem solving means in which the stationary scroll (40) includes an outer peripheral portion (42) which is formed integrally with the stationary side wrap (41) and which encloses the periphery of the stationary side wrap (41), and an inner side surface of the outer peripheral portion (42) is formed continuously with an inner side surface of the stationary side wrap (41) so that the outer peripheral portion's (42) inner side surface comes into sliding contact with an outer side surface of the movable side wrap (53).

The present invention provides a twenty-first problem solving means according to the second to fourth problem solving means in which the stationary scroll (40) includes an outer peripheral portion (42) which is formed integrally with the stationary side wrap (41) and which encloses the periphery of the stationary side wrap (41), and an inner side surface of the outer peripheral portion (42) is formed continuously with an inner side surface of the stationary side wrap (41) so that the outer peripheral portion's (42) inner side surface comes into sliding contact with an outer side surface of the movable side wrap (53).

The present invention provides a twenty-second problem solving means according to the twentieth problem solving means in which the outer peripheral portion's (42) inner side surface is so formed as to become slidably contactable with the whole of an outer peripheralmost portion of the movable side wrap (53).

The present invention provides a twenty-third problem solving means according to the twenty-first problem solving means in which the outer peripheral portion's (42) inner side surface is so formed as to become slidably contactable with the whole of an outer peripheralmost portion of the movable side wrap (53).

The present invention provides a twenty-fourth problem solving means according to any one of the second to fourth problem solving means in which the first flat plate portion (51) and the second flat plate portion (52) are such shaped that the location of the center of gravity of the movable scroll (50) lies on the central line of the eccentric portion (21).

The present invention provides a twenty-fifth problem solving means according to any one of the second to fourth problem solving means in which the scroll type fluid machine further comprises a casing (11) which is shaped like a hermetically sealed container for housing the stationary scroll (40), the movable scroll (50), the rotation preventing mechanism, and the rotary shaft (20) and the scroll type fluid machine is constructed such that the whole interior portion of the casing (11) is placed in a low pressure state.

The present invention provides a twenty-sixth problem solving means according to any one of the second to fourth problem solving means in which the scroll type fluid machine further comprises a casing (11) which is shaped like a hermetically sealed container for housing the stationary scroll (40), the movable scroll (50), the rotation preventing mechanism, and the rotary shaft (20) and a low pressure chamber (12) which is placed in a low pressure state and in which at least the stationary scroll (40) and the movable scroll (50) are disposed is defined in the interior portion of the casing (11).

The present invention provides a twenty-seventh problem solving means according to the first problem solving means in which the stationary scroll (40) further includes a thin plate member (71) which is sandwiched between the stationary side wrap (41) and the second flat plate portion (52) and which slides against a tip of the movable side wrap (53).

The present invention provides a twenty-eighth problem solving means according to either the second problem solving means or the fourth problem solving means in which the movable scroll (50) further includes a thin plate member (71) which is sandwiched between the movable side wrap (53) and the second flat plate portion (52) and which slides against a tip of the stationary side wrap (41).

The present invention provides a twenty-ninth problem solving means according to either the third problem solving means or the fourth problem solving means in which the movable scroll (50) further includes a thin plate member (71) which is sandwiched between the movable side wrap (53) and the first flat plate portion (51) and which slides against a tip of the stationary side wrap (41).

The present invention provides a thirtieth problem solving means according to the first problem solving means in which the scroll type fluid machine is such constructed that a force for pressing the first flat plate portion (51) against the stationary side wrap (41) acts on the movable scroll (50).

The present invention provides a thirty-first problem solving means according to any one of the second to fourth problem solving means in which the scroll type fluid machine is such constructed that a force for pressing either the first flat plate portion (51) or the second flat plate portion (52) against the stationary side wrap (41) acts on the movable scroll (50).

The present invention provides a thirty-second problem solving means according to the first problem solving means in which a portion of the movable side wrap (53) extending from a central side end thereof for a given distance constitutes a low wall portion (57) which is less in height than an outer peripheral side end of the movable side wrap (53) and the stationary side wrap (41) of the stationary scroll (40) is provided with a planar surface forming portion (49) which is brought into sliding contact with a tip of the low wall portion (57) to define the fluid chamber (60).

The present invention provides a thirty-third problem solving means according to any one of the second to fourth problem solving means in which a portion of the movable side wrap (53) extending from a central side end thereof for a given distance constitutes a low wall portion (57) which is less in height than an outer peripheral side end of the movable side wrap (53) and the stationary side wrap (41) of the stationary scroll (40) is provided with a planar surface forming portion (49) which is brought into sliding contact with a tip of the low wall portion (57) to define the fluid chamber (60).

Working

In the first problem solving means, the movable scroll (50) is provided with the first flat plate portion (51) and the movable side wrap (53). On the other hand, the stationary scroll (40) is provided with the second flat plate portion (52) and the stationary side wrap (41). The movable side wrap (53) of the movable scroll (50) is brought into mating engagement with the stationary side wrap (41) of the stationary scroll (40). In such a state, if the movable scroll (50) executes an orbital motion, the volume of the fluid chamber (60) will vary with the orbiting movement of the movable scroll (50). During that period, the inner side surface of the stationary side wrap (41) and the outer side surface of the movable side wrap (53) come into sliding contact with each other, while the outer side surface of the stationary side wrap

(41) and the inner side surface of the movable side wrap (53) come into sliding contact with each other. Additionally, the tip of the stationary side wrap (41) and the first flat plate portion (51) come into sliding contact with each other, while the tip of the movable side wrap (53) and the second flat plate portion (52) come into sliding contact with each other. The second flat plate portion (52) which comes into sliding contact with the movable side wrap (53) is formed as a separate body from the stationary side wrap (41).

In the first problem solving means, the side surface of the stationary side wrap (41) and the side surface of the movable side wrap (53) do not have to come into direct contact with each other. In other words, strictly speaking, even when there is a micro-gap between the stationary side wrap (41) and the movable side wrap (53), it will suffice if the stationary side wrap (41) and the movable side wrap (53) seemingly appear to come into frictional contact with each other. The same applies to the state between the tip of the stationary side wrap (41) and the first flat plate portion (51) as well as to the state between the tip of the movable side wrap (53) and the second flat plate portion (52).

In the second to fourth problem solving means, the movable scroll (50) is provided with the first flat plate portion (51), the movable side wrap (53), and the second flat plate portion (52). On the other hand, the stationary scroll (40) is provided with the stationary side wrap (41). The movable side wrap (53) of the movable scroll (50) is brought into mating engagement with the stationary side wrap (41) of the stationary scroll (40). In such a state, if the movable scroll (50) executes an orbital motion, the volume of the fluid chamber (60) varies with the orbiting movement of the movable scroll (50). During that period, the inner side surface of the stationary side wrap (41) and the outer side surface of the movable side wrap (53) come into sliding contact with each other, while the outer side surface of the stationary side wrap (41) and the inner side surface of the movable side wrap (53) come into sliding contact with each other. Additionally, one tip of the stationary side wrap (41) comes into sliding contact with the first flat plate portion (51), while the other tip of the stationary side wrap (41) comes into sliding contact with the second flat plate portion (52).

In addition, in these second to fourth problem solving means the side surface of the stationary side wrap (41) and the side surface of the movable side wrap (53) do not have to come into direct contact with each other. In other words, strictly speaking, even when there is a micro-gap between the stationary side wrap (41) and the movable side wrap (53), it will suffice if the stationary side wrap (41) and the movable side wrap (53) seemingly appear to come into frictional contact with each other. The same applies to the state between the one tip of the stationary side wrap (41) and the first flat plate portion (51) as well as to the state between the other tip of the stationary side wrap (41) and the second flat plate portion (52).

In the second problem solving means, the movable side wrap (53) is formed integrally with the first flat plate portion (51). On the other hand, the second flat plate portion (52) is formed as a separate body from each of the movable side wrap (53) and the first flat plate portion (51). In other words, the second flat plate portion (52) which comes into sliding contact with the stationary side wrap (41) is formed as a separate body from the movable side wrap (53). In the movable scroll (50), the second flat plate portion (52) is connected to either one of the movable side wrap (53) and the first flat plate portion (51) each of which is formed as a separate body from the second flat plate portion (52).

In the third problem solving means, the movable side wrap (53) is formed integrally with the second flat plate portion (52). On the other hand, the first flat plate portion (51) is formed as a separate body from each of the movable side wrap (53) and the second flat plate portion (52). In other words, the first flat plate portion (51) which comes into sliding contact with the stationary side wrap (41) is formed as a separate body from the movable side wrap (53). In the movable scroll (50), the first flat plate portion (51) is connected to either one of the movable side wrap (53) and the second flat plate portion (52) each of which is formed as a separate body from the first flat plate portion (51).

In the fourth problem solving means, the first flat plate portion (51), the movable side wrap (53), and the second flat plate portion (52) are each formed as a separate body from the other. In other words, the first flat plate portion (51) and the second flat plate portion (52) which come into sliding contact with the stationary side wrap (41) are each formed as a separate body from the movable side wrap (53). In the movable scroll (50), the first flat plate portion (51), the movable side wrap (53), and the second flat plate portion (52) each of which is formed as a separate body from the other are connected together.

In the fifth problem solving means, in the stationary scroll (40) the outer peripheral portion (42) is formed integrally with the stationary side wrap (41). This outer peripheral portion (42) is greater in height than the stationary side wrap (41). This secures a clearance between the tip of the stationary side wrap (41) and the first flat plate portion (51), when the stationary side wrap (41) and the movable side wrap (53) are in mating engagement with each other.

In the sixth problem solving means, in the stationary scroll (40) the outer peripheral portion (42) is formed integrally with the stationary side wrap (41). This outer peripheral portion (42) is greater in height than the stationary side wrap (41). This secures a clearance between the tip of the stationary side wrap (41), and either the first flat plate portion (51) or the second flat plate portion (52), when the stationary side wrap (41) and the movable side wrap (53) are in mating engagement with each other.

In the seventh problem solving means, the movable side wrap (53) is greater in height than the stationary side wrap (41). In the movable scroll (50) of the present problem solving means, the distance between the first flat plate portion (51) and the second flat plate portion (52) is equal to the height of the movable side wrap (53). Stated another way, the distance between the first flat plate portion (51) and the second flat plate portion (52) is greater than the height of the stationary side wrap (41), whereby a clearance between the first flat plate portion (51) and the tip of the stationary side wrap (41) and a clearance between the second flat plate portion (52) and the tip of the stationary side wrap (41) are secured.

In the eighth problem solving means, the central portion of the stationary side wrap (41) is greater in height than the outer peripheral portion thereof. Consequently, the size of a clearance between the tip of the stationary side wrap (41) and the first flat plate portion (51) and the size of a clearance between the tip of the stationary side wrap (41) and the second flat plate portion (52) are grater on the central side of the stationary side wrap (41) than on the outer peripheral side thereof. In addition, the height of the stationary side wrap (41) may become continuously or gradually shorter from the outer peripheral side end toward the central side end.

In the ninth problem solving means, the tip seal (72) is mounted on the tip of the stationary side wrap (41). That is to say, in the present problem solving means there is created a gap between the stationary side wrap (41) and the first flat plate portion (51), and this gap is sealed off by the tip seal (72).

In the tenth to twelfth problem solving means, the tip seal (72) is mounted on the tip of the stationary side wrap (41). That is to say, in these problem solving means there is created a gap between the stationary side wrap (41), and either the first flat plate portion (51) or the second flat plate portion (52), and this gap is sealed off by the tip seal (72).

In the thirteenth problem solving means, interposed between the first flat plate portion (51) and the second flat plate portion (52) are the movable side wrap (53) and the plural support post portions (61). Each support post (61) is sandwiched between the first flat plate portion (51) and the second flat plate portion (52), thereby maintaining spacing therebetween. Each support post portion (61) may be a separate body from each of the first flat plate portion (51) and the second flat plate portion (52). On the other hand, each support post portion (61) may be formed integrally with either the first flat plate portion (51) or the second flat plate portion (52). Further, the plural support post portions (61) are disposed more outside than the movable side wrap (53).

In the fourteenth problem solving means, the height of the support post portions (61) exceeds the height of the movable side wrap (53). Accordingly, even when the first flat plate portion (51) and the second flat plate portion (52) are connected together for example by a bolt, most of the clamping pressure by the bolt acts on the support post portions (61), and the clamping pressure does not act such severely on the movable side wrap (53).

In the fifteenth problem solving means, the stationary scroll (40) is provided with the outer peripheral portion (42). Formed in the outer peripheral portion (42) are the plural guide apertures (47) associated with the respective support post portions (61). Each support post portion (61) of the movable scroll (50) is inserted into a corresponding guide aperture (47) of the outer peripheral portion (42) and its outer peripheral surface slides against the inner side surface of the guide aperture (47). The support post portion (61) slides against the outer peripheral portion (42), whereby the movable scroll (50) is guided, and the rotational movement of the movable scroll (50) is regulated.

In the sixteenth and the seventeenth problem solving means, the thickness of the stationary side wrap (41) is greater partially or wholly than the thickness of the movable side wrap (53).

In the eighteenth and nineteenth problem solving means, the stationary side wrap (41) and the movable side wrap (53) are formed of different materials. More specifically, the stationary side wrap (41) is formed of a material whose Young's modulus is higher than the material of the movable side wrap (53).

In the twentieth and twenty-first problem solving means, the stationary scroll (40) is provided with the outer peripheral portion (42). The inner side surface of the outer peripheral portion (42) is formed continuously with the inner side surface of the stationary side wrap (41) and comes into sliding contact with the outer side surface of the movable side wrap (53). In other words, the fluid chamber (60) is formed not only between the stationary side wrap (41) and the movable side wrap (53) but also between the outer peripheral portion (42) and the movable side wrap (53). That is to say, part of the stationary side wrap surface which comes into sliding contact with the movable side wrap (53) to compart the fluid chamber (60) is formed by the inner side surface of the outer peripheral portion (42).

In the twenty-second and twenty-third problem solving means, the whole outer side surface of the outer peripheralmost portion of the movable side wrap (53) and the inner side surface of the outer peripheral portion (42) slidingly contact each other. In other words, the stationary side wrap surface which comes into sliding contact with the movable side wrap (53) to compart the fluid chamber (60) is extended to near the outer peripheral side end of the movable side wrap (53). Also in the outer peripheralmost portion of the movable side wrap (53) the fluid chamber (60) is defined between the whole of the outer peripheralmost portion and the outer peripheral portion (42).

In the twenty-second and twenty-third problem solving means, the inner side surface of the outer peripheral portion (42) and the outer side surface of the movable side wrap (53) do not have to come into direct contact with each other. In other words, strictly speaking, even when there is a micro-gap between the outer peripheral portion (42) and the movable side wrap (53), it will suffice if the outer peripheral portion (42) and the movable side wrap (53) seemingly appear to come into frictional contact with each other.

In the twenty-fourth problem solving means, in order to set the location of the center of gravity of the movable scroll (50) on the central line of the eccentric portion (21) both the shape of the first flat plate portion (51) and the shape of the second flat plate portion (52) are adjusted. If the location of the center of gravity of the movable scroll (50) lies on the central line of the eccentric portion (21), this considerably reduce the drop in the rotational moment of the movable scroll (50) generated during revolutions of the movable scroll (50).

In the twenty-fifth problem solving means, the interior of the casing (11) is placed in a low pressure state. For example, when using the scroll type fluid machine (10) as a compressor, the inner pressure of the casing (11) becomes equal to the pressure of a fluid drawn into the fluid chamber (60). On the other hand, when using the scroll type fluid machine (10) as an expander, the inner pressure of the casing (11) becomes equal to the pressure of a fluid flown out of the fluid chamber (60). In the interior of the casing (i), the area around the stationary scroll (40) and the area around the movable scroll (50) enter a low pressure state.

In the twenty-sixth problem solving means, the low pressure chamber (12) is comparted in the interior of the casing (11). The interior of the low pressure chamber (12) is placed in a low pressure state. For example, when using the scroll type fluid machine (10) as a compressor, the inner pressure of the low pressure chamber (12) becomes equal to the pressure of a fluid drawn into the fluid chamber (60). On the other hand, when using the scroll type fluid machine (10) as an expander, the inner pressure of the low pressure chamber (12) becomes equal to the pressure of a fluid flown out of the fluid chamber (60). At least the stationary scroll (40) and the movable scroll (50) are disposed in the inside of the low pressure chamber (12). The area around the stationary scroll (40) and the area around the movable scroll (50) enter a low pressure state. In addition, spaces other than the low pressure chamber (12) in the inside of the casing (11) may be, for example in a high pressure state.

In the twenty-seventh problem solving means, in the stationary scroll (40) the thin plate member (71) is sandwiched between the stationary side wrap (41) and the second flat plate portion (52). The tip of the movable side wrap (53) slides against this thin plate member (71).

In the twenty-eighth problem solving means, in the movable scroll (50) the thin plate member (71) is sandwiched between the movable side wrap (53) and the second flat plate portion (52). This thin plate member (71) slides against the tip of the stationary side wrap (41).

In the twenty-ninth problem solving means, in the movable scroll (50) the thin plate member (71) is sandwiched between the movable side wrap (53) and the first flat plate portion (51). The thin plate member (71) slides against the tip of the stationary side wrap (41).

In the thirtieth problem solving means, a pressing force that presses the first flat plate portion (51) in the direction of the stationary side wrap (41) acts on the movable scroll (50). During revolutions of the movable scroll (50), moments trying to incline the movable scroll (50) with respect to the stationary scroll (40) and the rotary shaft (20) are generated. By contrast to this, a pressing force applied to the movable scroll (50) in the present problem solving means works so as to negate moments trying to incline the movable scroll (50).

In the thirty-first problem solving means, a pressing force that presses the first flat plate portion (51) or the second flat plate portion (52) in the direction of the stationary side wrap (41) acts on the movable scroll (50). During revolutions of the movable scroll (50), moments trying to incline the movable scroll (50) toward the stationary scroll (40) and the rotary shaft (20) are generated. By contrast to this, in the present problem solving means a pressing force applied to the movable scroll (50) works so as to negate the moments trying to incline the movable scroll (50).

In the thirty-second and thirty-third problem solving means, a central end side portion of the movable side wrap (53) constitutes the low wall portion (57). In addition, the stationary side wrap (41) includes, at a central end side portion thereof, the planar surface forming portion (49). This planar surface forming portion (49) is such formed that it crosses the stationary side wrap (41) and comes into sliding contact with the tip of the low wall portion (57) to define the fluid chamber (60).

In the thirty-second and thirty-third problem solving means, the tip of the low wall portion (57) and the planar surface forming portion (49) do not have to come into direct contact with each other. In other words, strictly speaking, even when there is a micro-gap between the low wall portion (57) and the planar surface forming portion (49), it will suffice if the low wall portion (57) and the planar surface forming portion (49) seemingly appear to come into frictional contact with each other.

Effects

In the first problem solving means, the second flat plate portion (52) which comes into sliding contact with the movable side wrap (53) is formed as a separate body from the stationary side wrap (41). In the second flat plate portion (52) which is formed as a separate body from the stationary side wrap (41), its sliding surface with respect to the movable side wrap (53) is a mere planar surface. Consequently, in comparison with a conventional one in which the second flat plate portion (52) is formed integrally with the stationary side wrap (41) it becomes extremely easier to machine the sliding surface of the second flat plate portion (52) with respect to the movable side wrap (53) with a high degree of accuracy.

Accordingly, in accordance with the present problem solving means it becomes possible to finish the sliding surface of the second flat plate portion (52) to a low surface roughness without expending much time on the machining thereof, and the sliding surface of the second flat plate portion (52) is finished to a planar surface without fail. As a result, the amount of fluid leaking through a gap between the second flat plate (52) and the movable side wrap (53) is reduced considerably without reducing the production efficiency of the scroll type fluid machine (10), thereby improving the efficiency of the scroll type fluid machine (10).

Further, in the first problem solving means the second flat plate portion (52) is formed as a separate body from the stationary side wrap (41) in the stationary scroll (40). This makes it possible to check a positional relationship between the stationary side wrap (41) and the movable side wrap (53) for example by visual check or by the use of a clearance gauge or the like in a state prior to the assembling of the second flat plate portion (52), at the time of the assembling of the scroll type fluid machine (10). It is possible to check a gap between the stationary side wrap (41) and the movable side wrap (53) while turning the movable side wrap (53), and the stationary side wrap (41) is secured firmly at an optimum position. Accordingly, in accordance with the present problem solving means the amount of fluid leaking from the fluid chamber (60) is reduced also by optimizing the alignment of the stationary side wrap (41) and the movable side wrap (53), thereby making it possible to improve the efficiency of the scroll type fluid machine (10).

In accordance with the second problem solving means, the second flat plate portion (52) which comes into sliding contact with the stationary side wrap (41) is formed as a separate body from the movable side wrap (53). In the second flat plate portion (52) which is formed as a separate body from the movable side wrap (53), its sliding surface with respect to the stationary side wrap (41) is a mere planar surface. Consequently, in comparison with a conventional one in which the second flat plate portion (52) is formed integrally with the stationary side wrap (41) to constitute the stationary scroll (40) it becomes extremely easier to machine the sliding surface of the second flat plate portion (52) with respect to the stationary side wrap (41) with a high degree of accuracy.

Accordingly, the present problem solving means makes it possible to finish the sliding surface of the second flat plate portion (52) to a low surface roughness without expending much time on the machining thereof and further ensures that the sliding surface of the second flat plate portion (52) is finished to a planar surface. As a result, the amount of fluid leaking through a gap between the second flat plate portion (52) and the stationary side wrap (41) is reduced considerably without reducing the production efficiency of the scroll type fluid machine (10), thereby improving the efficiency of the scroll type fluid machine (10).

In accordance with the third problem solving means, the first flat plate portion (51) which comes into sliding contact with the stationary side wrap (41) is formed as a separate body from the movable side wrap (53). In the first flat plate portion (51) which is formed as a separate body from the movable side wrap (53), its sliding surface with respect to the stationary side wrap (41) is a mere planar surface. Consequently, in comparison with a conventional one in which the first flat plate portion (51) is formed integrally with the movable side wrap (53) to constitute the movable scroll (50) it becomes extremely easier to machine the sliding surface of the first flat plate portion (51) with respect to the stationary side wrap (41) with a high degree of accuracy.

Accordingly, the present problem solving means makes it possible to finish the sliding surface of the first flat plate portion (51) to a low surface roughness without expending much time on the machining thereof and further ensures that the sliding surface of the first flat plate portion (51) is finished to a planar surface. As a result, the amount of fluid leaking through a gap between the first flat plate portion (51) and the stationary side wrap (41) is reduced considerably without reducing the production efficiency of the scroll type fluid machine (10), thereby improving the efficiency of the scroll type fluid machine (10).

In the fourth problem solving means, both the first flat plate portion (51) and the second flat plate portion (52) which come into sliding contact with the stationary side wrap (41) are each formed as a separate body from the movable side wrap (53). In the first flat plate portion (51) and the second flat plate portion (52) each of which is formed as a separate body from the movable side wrap (53), their sliding surfaces with respect to the stationary side wrap (41) are mere planar surfaces. Consequently, in comparison with a conventional one in which the first flat plate portion (51) is formed integrally with the movable side wrap (53) to constitute the movable scroll (50) while the second flat plate portion (52) is formed integrally with the stationary side wrap (41) to constitute the stationary scroll (40), it becomes extremely easier to machine the sliding surfaces of the first and second flat plate portions (51) and (52) with respect to the stationary side wrap (41) with a high degree of accuracy.

Accordingly, the present problem solving means makes it possible to finish the sliding surfaces of the first and second flat plate portions (51) and (52) to a low surface roughness without expending much time on the machining thereof and further ensures that the sliding surfaces of the first and second flat plate portions (51) and (52) are each finished to a planar surface. As a result, the amount of fluid leaking through a gap between the first flat plate portion (51) and the stationary side wrap (41) and the amount of fluid leaking through a gap between the second flat plate portion (52) and the stationary side wrap (41) are reduced considerably without reducing the production efficiency of the scroll type fluid machine (10), thereby improving the efficiency of the scroll type fluid machine (10).

In the second and fourth problem solving means, in the movable scroll (50) the second flat plate portion (52) is formed as a separate body from the movable side wrap (53). This makes it possible to check a positional relationship between the stationary side wrap (41) and the movable side wrap (53) for example by visual check or by the use of a clearance gauge or the like in a state prior to the assembling of the second flat plate portion (52), at the time of the assembling of the scroll type fluid machine (10). It is possible to check a gap between the stationary side wrap (41) and the movable side wrap (53) while turning the movable side wrap (53), and the stationary side wrap (41) is secured firmly at an optimum position. Accordingly, in accordance with these problem solving means the amount of fluid leaking from the fluid chamber (60) is reduced also by optimizing the alignment of the stationary side wrap (41) and the movable side wrap (53), thereby making it possible to improve the efficiency of the scroll type fluid machine (10).

Further, in the second to fourth problem solving means the first flat plate portion (51), the movable side wrap (53), and the second flat plate portion (52) together constitute the movable scroll (50). Consequently, the inner pressure of the fluid chamber (60) acts on the first and second flat plate portions (51) and (52); however, a force acting on the first flat plate portion (51) and a force acting on the second flat plate portion (52) are cancelled each other.

Stated another way, in a commonly used scroll type fluid machine the inner pressure of a fluid chamber acts on a flat plate portion of a stationary scroll and on a flat plate portion of a movable scroll. Accordingly, the force acts on the movable scroll in such a direction as to draw it away from the stationary scroll.

By contrast to the above, in accordance with the second to fourth problem solving means the movable scroll (50) is provided with both the first flat plate portion (51) and the second flat plate portion (52), whereby a force acting on the first flat plate portion (51) and a force acting on the second flat plate portion (52) are cancelled each other. Consequently, it is possible to considerably reduce axial load (i.e., thrust load) acting on the movable scroll (50), thereby considerably reducing frictional loss generated during revolutions of the movable scroll (50).

In accordance with the fifth problem solving means, it is possible to secure a clearance between the tip of the stationary side wrap (41) and the first flat plate portion (51) by performing dimensional control of the height of the outer peripheral portion (42) and the height of the stationary side wrap (41). Consequently, the stationary side wrap (41) is prevented from suffering damage from forceful frictional contact with the first flat plate portion (51), even when the stationary side wrap (41) undergoes some deformation by the inner pressure of the fluid chamber and heat. In addition, it is possible to avoid the increase in frictional resistance caused by contact of the stationary side wrap (41) with the first flat plate portion (51). Accordingly, with the present problem solving means it becomes possible to improve the reliability of the scroll type fluid machine (10).

In accordance with the sixth problem solving means, it is possible to secure a clearance between the tip of the stationary side wrap (41), and the first flat plate portion (51) or the second flat plate portion (52) by performing dimensional control of the height of the outer peripheral portion (42) and the height of the stationary side wrap (41). Consequently, the stationary side wrap (41) is prevented from suffering damage from forceful frictional contact with the first flat plate (51) or the second flat plate portion (52), even when the stationary side wrap (41) undergoes some deformation by the inner pressure of the fluid chamber and heat. In addition, it is possible to avoid the increase in frictional resistance caused by contact of the stationary side wrap (41) with the first flat plate portion (51) or the second flat plate portion (52). Accordingly, with the present problem solving means it becomes possible to improve the reliability of the scroll type fluid machine (10).

In the seventh problem solving means, it is arranged such that the movable side wrap (53) sandwiched between the first flat plate portion (51) and the second flat plate portion (52) is greater in height than the stationary side wrap (41) which matingly engages with the movable side wrap (53). This prevents, without fail, the movable scroll (50) from being placed in a lock state with respect to the stationary scroll (40), when connecting the first flat plate portion (51) and the second flat plate portion (52) together. In other words, it is ensured that such a situation that the movable scroll (50) becomes unable to execute an orbital motion because the stationary side wrap (41) is caught between the first flat plate portion (51) and the second flat plate portion (52) is avoided. Accordingly, with the present problem solving means it is ensured that the scroll type fluid machine (10) is assembled without paying special attention, and the production process thereof is simplified.

Additionally, in accordance with the present problem solving means it is possible to secure a clearance between the tip of the stationary side wrap (41), and the first flat plate portion (51) or the second flat plate portion (52). Consequently, the stationary side wrap (41) is prevented from suffering damage from forceful frictional contact with the first flat plate (51) or the second flat plate portion (52), even when the stationary side wrap (41) undergoes some deformation by the inner pressure of the fluid chamber and heat. In addition, it is possible to avoid the increase in frictional resistance caused by contact of the stationary side wrap (41) with the first flat plate portion (51) or the second flat plate portion (52). Accordingly, with the present problem solving means it becomes possible to improve the reliability of the scroll type fluid machine (10).

In the eighth problem solving means, it is arranged such that the stationary side wrap (41) becomes shorter in height from the outer peripheral side toward the central side. In comparison with the outer peripheral side portion of the stationary side wrap (41), the central side portion thereof is likely to undergo a greater amount of deformation because the central side portion receives the inner pressure of the fluid chamber which is a high pressure while at the same time being exposed to high temperature. By contrast to this, in accordance with the present problem solving means it is arranged such that the clearance between the tip of the stationary side wrap (41) and the first flat plate portion (51) and the clearance between the tip of the stationary side wrap (41) and the second flat plate portion (52) increase as closer to the central side of the stationary side wrap (41) prone to undergoing great deformation.

Consequently, in accordance with the present problem solving means it is possible to prevent the stationary side wrap (41) from suffering damage from forceful frictional contact with the first flat plate portions (51) and the second flat plate portion (52). In addition, it is possible to avoid the increase in frictional resistance caused by contact of the stationary side wrap (41) with the first flat plate portion (51) and the second flat plate portion (52). Accordingly, with the present problem solving means it becomes possible to improve the reliability of the scroll type fluid machine (10).

In the ninth problem solving means, after securing a clearance between the stationary side wrap (41) and the first flat plate portion (51) a gap between the stationary side wrap (41) and the first flat plate portion (51) is sealed off by the tip seal (72). Accordingly, in accordance with the present problem solving means leakage of fluid through the gap between the stationary side wrap (41) and the first flat plate portion (51) is suppressed, in addition to effects obtained by securing the clearance. Therefore, it becomes possible to avoid the drop in the efficiency of the scroll type fluid machine (10).

In the tenth to twelfth problem solving means, after securing a clearance between the stationary side wrap (41), and the first flat plate portion (51) or the second flat plate portion (52) a gap between the stationary side wrap (41) and the first flat plate portion (51) or a gap between the stationary side wrap (41) and the second flat plate portion (52) is sealed off by the tip seal (72). Accordingly, in accordance with the these problem solving means leakage of fluid through the gap between the stationary side wrap (41), and either the first flat plate portion (51) or the second flat plate portion (52) is suppressed, in addition to effects obtained by securing the clearance. Therefore, it becomes possible to avoid the drop in the efficiency of the scroll type fluid machine (10).

In accordance with the thirteenth problem solving means, the movable scroll (50) is provided with the plural support post portions (61), which ensures that the first flat plate portion (51) and the second flat plate portion (52) are connected together while maintaining spacing therebetween. In addition, in the present problem solving means the support post portions (61) are disposed more outside than the movable side wrap (53), thereby keeping the movable side wrap (53) small in size. Accordingly, the present problem solving means ensures that the first flat plate portion (51) and the second flat plate portion (52) are connected together while preventing the movable scroll (50) from becoming large in size.

In accordance with the fourteenth problem solving means, since the height of the support post portions (61) exceeds the height of the movable side wrap (53), this makes it possible for the support post portions (61) to support most of the force for connecting together the first flat plate portion (51) and the second flat plate portion (52). Consequently, even when the force of connecting together the first flat plate portion (51) and the second flat plate portion (52) becomes excessive, it is possible to prevent the movable side wrap (53) from undergoing a great deformation due to such connecting force, whereby the drop in the efficiency of the scroll type fluid machine (10) can be avoided by preventing leakage of fluid from the fluid chamber (60).

In accordance with the fifteenth problem solving means, the rotation preventing mechanism for preventing rotation of the movable scroll (50) is configured by making utilization of the support post portions (61) of the movable scroll (50) and the guide apertures (47) of the outer peripheral portion (42). Accordingly, the present problem solving means eliminates the need for separately providing, for example as a rotation preventing mechanism, an Oldham mechanism or the like, thereby simplifying the construction of the scroll type fluid machine (10).

In the sixteenth and seventeenth problem solving means, it is possible to secure the rigidity of the stationary side wrap (41) by setting the thickness of the stationary side wrap (41) to an adequate value. In addition, it is possible to secure the rigidity of the stationary side wrap (41) by forming the stationary side wrap (41) of the eighteenth problem solving means and the stationary side wrap (41) of the nineteenth problem solving means by the use of a material having a high Young's modulus.

Each of these problem solving means employs an arrangement in which the stationary side wrap (41) is formed as a separate body from each of the first flat plate portion (51) and the second flat plate portion (52), and the stationary side wrap (41) is shaped like a cantilevered beam extending from the outer peripheral side toward the central side. Consequently, in comparison with the movable side wrap (53) which is sandwiched between the first flat plate portion (51) and the second flat plate portion (52) the stationary side wrap (41) is more susceptible to deformation. By contrast to this, in accordance with the sixteenth to nineteenth problem solving means it is possible to sufficiently secure the rigidity of the stationary side wrap (41) and to prevent the stationary side wrap (41) from undergoing excessive deformation.

In the twentieth and twenty-first problem solving means, a part of the stationary side wrap surface which comes into sliding contact with the movable side wrap (53) is constituted by the inner side surface of the outer peripheral portion (42). Consequently, even when employing a construction in which the length of a stationary side wrap is equal to the length of a movable side wrap (a so-called symmetrical scroll construction), it is possible to make the length of the stationary side wrap (41) seemingly shorter than the length of the movable side wrap (53).

These problem solving means employ such a construction that the stationary side wrap (41) is formed as a separate body from each of the first flat plate portion (51) and the second flat plate portion (52) and the stationary side wrap (41) projects, in the form of a cantilevered beam, from the outer peripheral side toward the central side. Accordingly, in such a construction the stationary side wrap (41) might undergo a greater amount of deformation in comparison with the movable side wrap (53) which is sandwiched between the first flat plate portion (51) and the second flat plate portion (52).

By contrast to the above, with these problem solving means it is possible to make the length of the stationary side wrap (41) which is more susceptible to deformation in compassion with the movable side wrap (53) shorter than that of the movable side wrap (53). As a result, it is possible to enhance the rigidity of the stationary side wrap (41) by reducing the length of the stationary side wrap (41), thereby preventing the stationary side wrap (41) from undergoing an excessive deformation.

The twenty-second and twenty-third problem solving means employ a construction (a so-called asymmetric scroll construction) in which the length of a stationary side wrap is longer than the length of a movable side wrap by about half a peripheral length. Accordingly, in comparison with a case employing a so-called symmetric scroll construction it is possible to further expand the maximum volume of the fluid chamber (60) comparted by the stationary side inner wrap surface and the movable side outer wrap surface. Consequently, the stationary side wrap length and the movable side wrap length can be shortened without reducing the rate of flow of a fluid passing through the scroll type fluid machine (10). As a result, the rigidity of the stationary side wrap (41) is further enhanced by reducing the length of the stationary side wrap (41) to a further extent, thereby ensuring that the stationary side wrap (41) is prevented from undergoing an excessive deformation.

In the twenty-fourth problem solving means, the first flat plate portion (51) and the second flat plate portion (52) are modified in shape in order to adjust the location of the center of gravity of the movable scroll (50). Consequently, it becomes possible to adjust the location of the center of gravity of the movable scroll (50) while preventing the movable scroll (50) from becoming large in size.

In a commonly used scroll type fluid machine, its movable scroll is provided with only an equivalent to the first flat plate portion (51). Accordingly, adjustment of the location of the center of gravity of the movable scroll must be carried out by changing only the shape of such an equivalent to the first flat plate portion (51). Therefore, the movable scroll might become large in size.

By contrast to the above, in the present problem solving means the movable scroll (50) is provided with both the first flat plate portion (51) and the second flat plate portion (52). Consequently, it becomes possible to adjust the location of the center of gravity of the movable scroll (50) by changing both the shape of the first flat plate portion (51) and the shape of the second flat plate portion (52). Accordingly, in accordance with the present problem solving means it is possible to further downsize the first and second flat plate portions (51) and (52) in comparison with scroll type fluid machinery having a conventional construction.

In the twenty-fifth and twenty-sixth problem solving means, in the inside of the casing (11) the area around the stationary scroll (40) and the area around the movable scroll (50) are placed in a low pressure state. Accordingly, in view of the fluid chamber (60) which is defined on the outer peripheralmost side of the movable side wrap (53) and whose volume has increased to a maximum, there is hardly any pressure difference between the inner pressure of the fluid chamber (60) and the pressure of the areas around the stationary and movable scrolls (40) and (50).

These problem solving means employ a construction in which the second flat plate portion (52) is provided in the movable scroll (50) and slides against the stationary scroll (40). Consequently, if the areas around the stationary and movable scrolls (40) and (50) are brought into a high pressure state, this causes the possibility that the drop in efficiency occurs because fluid leaks into the fluid chamber (60) through a gap between the second flat plate portion (52) and the stationary scroll (40).

By contrast to the above, in accordance with the twenty-fifth and twenty-sixth problem solving means, it is possible to extremely diminish the difference in pressure between the fluid chamber (60) whose volume has increased to a maximum and the areas around the stationary and movable scrolls (40) and (50). Accordingly, in accordance with these problem solving means it is possible to considerably reduce the amount of fluid flowing into the fluid chamber (60) through a gap between the second flat plate portion (52) and the stationary scroll (40), thereby preventing the scroll type fluid machine (10) from undergoing a drop in efficiency.

In the twenty-seventh problem solving means, the stationary scroll (40) is provided with the thin plate member (71) and the movable side wrap (53) slides against the thin plate member (71). Accordingly, if the thin plate member (71) is formed of a material superior in resistance to abrasion, this ensures that trouble such as abrasion, seizing, and the like is avoided also in the tip of the movable side wrap (53) prone to deficiency in the amount of lubricant at startup or the like.

In the twenty-eighth and twenty-ninth problem solving means, the movable scroll (50) is provided with the thin plate member (71) and the thin plate member (71) slides against the stationary side wrap (41). Accordingly, if the thin plate member (71) is formed of a material superior in resistance to abrasion, this ensures that trouble such as abrasion, seizing, and the like is avoided also in the tip of the stationary side wrap (41) prone to deficiency in the amount of lubricant at startup or the like.

In accordance with the thirtieth and thirty-first problem solving means, moments trying to incline the movable scroll (50) which is orbiting are reduced by application of a pressing force to the movable scroll (50). Consequently, it becomes possible to prevent the movable scroll (50) from inclining and coming into contact with the stationary scroll (40) and the eccentric portion (21) of the rotary shaft (20), thereby avoiding damage. Therefore, the reliability of the scroll type fluid machine (10) is improved.

In a commonly used scroll type fluid machine, an equivalent to the first flat plate portion (51) is provided in a movable scroll and an equivalent to the second flat plate portion (52) is provided in a stationary scroll. Consequently, the inner pressure of a fluid chamber causes a separating force trying to draw the movable scroll away from the stationary scroll to act on the movable scroll. Therefore, inclination of the movable scroll cannot be prevented unless a pressing force in excess of the separating force acts on the movable scroll.

On the contrary, when the movable scroll (50) executes an orbital motion the inner pressure of the fluid chamber (60) varies with the orbiting movement of the movable scroll (50). Consequently, if a pressing force just to prevent inclination of the movable scroll (50) is applied thereto, the pressing force becomes too much when the inner pressure of the fluid chamber (60) is at a low level, even in such a state that the inner pressure of the fluid chamber (60) is at a maximum level. This causes the problem that frictional resistance during revolutions of the movable scroll (50) becomes excessive.

By contrast to the above, in the thirty-first problem solving means both the first flat plate portion (51) and the second flat plate portion (52) are provided in the movable scroll (50), and the inner pressure of the fluid chamber (60) acting on the first flat plate portion (51) and the inner pressure of the fluid chamber (60) acting on the second flat plate portion (52) are cancelled each other. Consequently, even when the inner pressure of the fluid chamber (60) varies, apparently only a pressing force of the present problem solving means acts on the movable scroll (50). Accordingly, in accordance with the present problem solving means inclination of the movable scroll (50) is prevented, just by application of a minimum required pressing force, and it is possible to improve the reliability of the scroll type fluid machine (10) without any increase in frictional resistance during revolutions of the movable scroll (50).

In the thirty-second and thirty-third problem solving means, the fluid chamber (60) is defined also by the low wall portion (57) of the movable side wrap (53) and the planar surface forming portion (49) formed in the stationary side wrap (41). Consequently, in accordance with these problem solving means, the minimum volume of the fluid chamber (60) whose volume varies with the revolution of the movable scroll (50) is made smaller in comparison with a case in which the height of the movable side wrap (53) is held constant. Accordingly, in accordance with these problem solving means it is possible to reduce the number of turns of the stationary side wrap (41) and the number of turns of the movable side wrap (53) while keeping the ratio of the maximum volume and the minimum volume of the fluid chamber (60) constant, and the stationary scroll (40) and the movable scroll (50) are downsized.

In the stationary scroll (40) of each of these problem solving means, the stationary side wrap (41) is shaped like a cantilevered beam extending from the outer peripheral side end toward the central side end and the amount of deformation of its central side portion is likely to become great. By contrast to this, in these problem solving means the planar surface forming portion (49) is formed so as to cross the central side portion of the stationary side wrap (41) the amount of deformation of which is great. Consequently, the rigidity of the central side portion of the stationary side wrap (41) is enhanced by the provision of the planar surface forming portion (49) and its deformation amount is made smaller. This prevents the stationary side wrap (41) from coming into frictional contact with the movable side wrap (53) or the like when deformed. Therefore, the stationary side wrap (41) is prevented from suffering damage. The reliability of the scroll type fluid machine (10) is improved.

BEST MODE FOR CARRYING OUT INVENTION

Hereinafter, embodiments of the present invention will be described in detail with reference to the drawings.

Embodiment 1 of Invention

A first embodiment of the present invention is a scroll compressor (10) composed of a scroll type fluid machine according to the present invention. This scroll compressor (10) is provided in a refrigerant circuit of a refrigerating apparatus.

Figure 1:
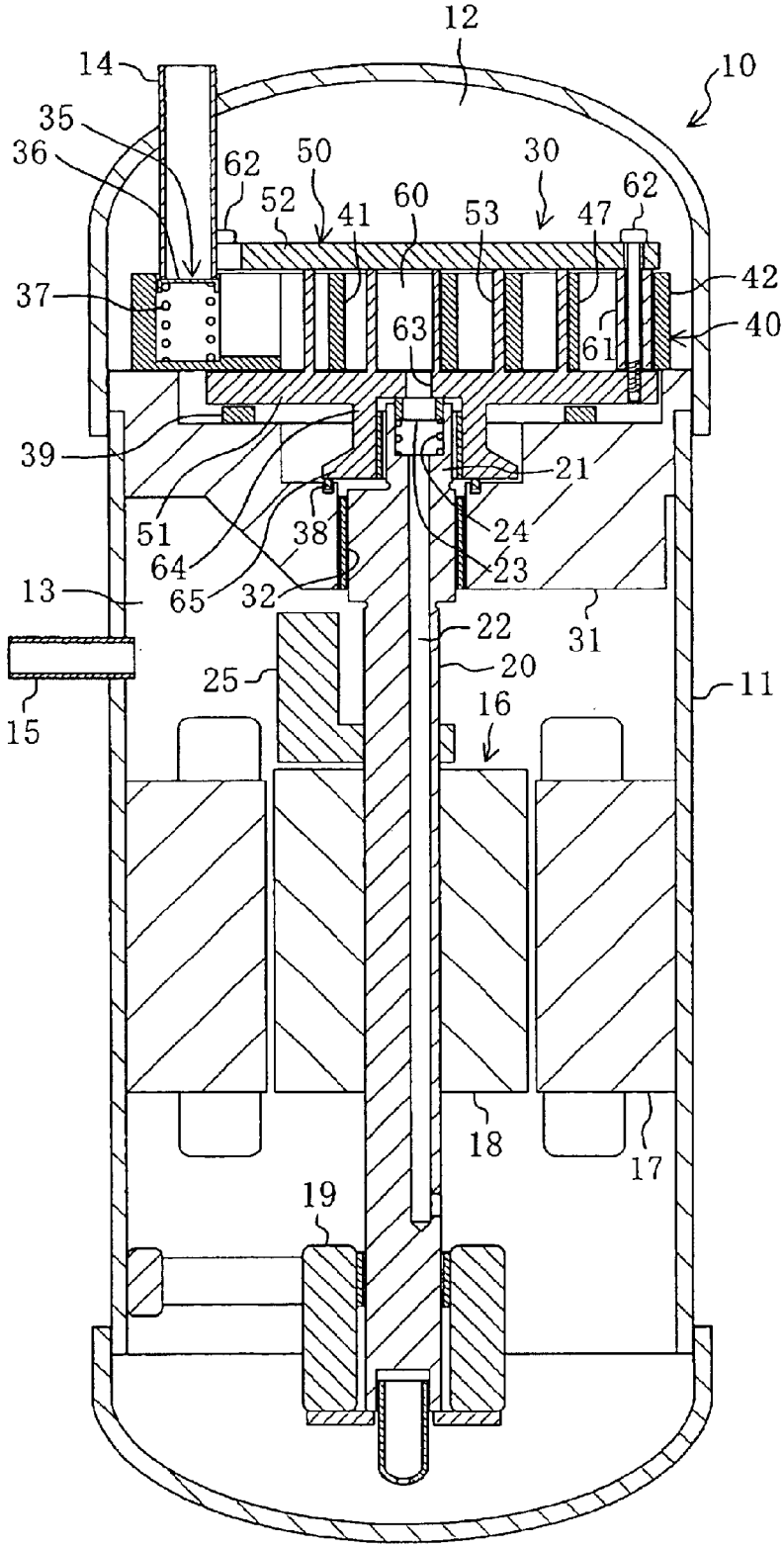
FIG. 1 is a schematic cross-sectional view showing a general arrangement of a scroll compressor in a first embodiment of the present invention.

As shown in FIG. 1, the scroll compressor (10) has a so-called hermetically sealed construction. This scroll type compressor has a casing (11) which is shaped like a longitudinal, cylindrical, hermetically sealed container. A compression mechanism (30), an electric motor (16), and a lower bearing (19) are disposed in that order (from top down) in the inside of the casing (11). Additionally, a vertically-extending driving shaft (20) serving as a rotary shaft is disposed in the inside of the casing (11).

The interior of the casing (11) is divided vertically by a housing (31) of the compression mechanism (30). In the inside of the casing (11), a space above the housing (31) becomes a low pressure chamber (12) and a space below the housing (31) becomes a high pressure chamber (13). During operation of the scroll compressor (10), the inner pressure of the low pressure chamber (12) becomes equal to the pressure (suction pressure) of a refrigerant drawn into the scroll compressor (10). On the other hand, the inner pressure of the high pressure chamber (13) becomes equal to the pressure (discharge pressure) of a refrigerant discharged out of the compression mechanism (30).

Housed in the high pressure chamber (13) are the electric motor (16) and the lower bearing (19). The electric motor (16) includes a stator (17) and a rotor (18). The stator (17) is secured firmly to a trunk portion of the casing (11). On the other hand, the rotor (18) is secured firmly to a longitudinal central portion of the driving shaft (20). The lower bearing (19) is secured firmly to a trunk portion of the casing (11). The lower bearing (19) rotatably supports a lower end of the driving shaft (20).

The casing (11) is provided with a tubular discharge port (15). One end of the discharge port (15) opens to a space above the electric motor (16) in the high pressure chamber (13).

A main bearing (32) is formed in the housing (31) of the compression mechanism (30) in such a way that it vertically passes through the housing (31). The driving shaft (20) is inserted into the main bearing (32) and is supported rotatably by the main bearing (32). In the driving shaft (20), an upper end portion projecting to an upper portion of the housing (31) constitutes an eccentric portion (21). The eccentric portion (21) is formed eccentrically in the direction of the central axis of the driving shaft (20).

In the driving shaft (20), a balance weight (25) is attached between the housing (31) and the stator (17). Additionally, a lubrication passageway (not shown) is formed in the driving shaft (20). Refrigerating machine oil accumulated at the bottom of the housing (31) is drawn up from the lower end of the driving shaft (20) by centrifugal pumping action and is delivered to each section through the lubrication passageway. Further, a discharge passageway (22) is formed in the driving shaft (20). The discharge passageway (22) will be described later.

Figure 2:
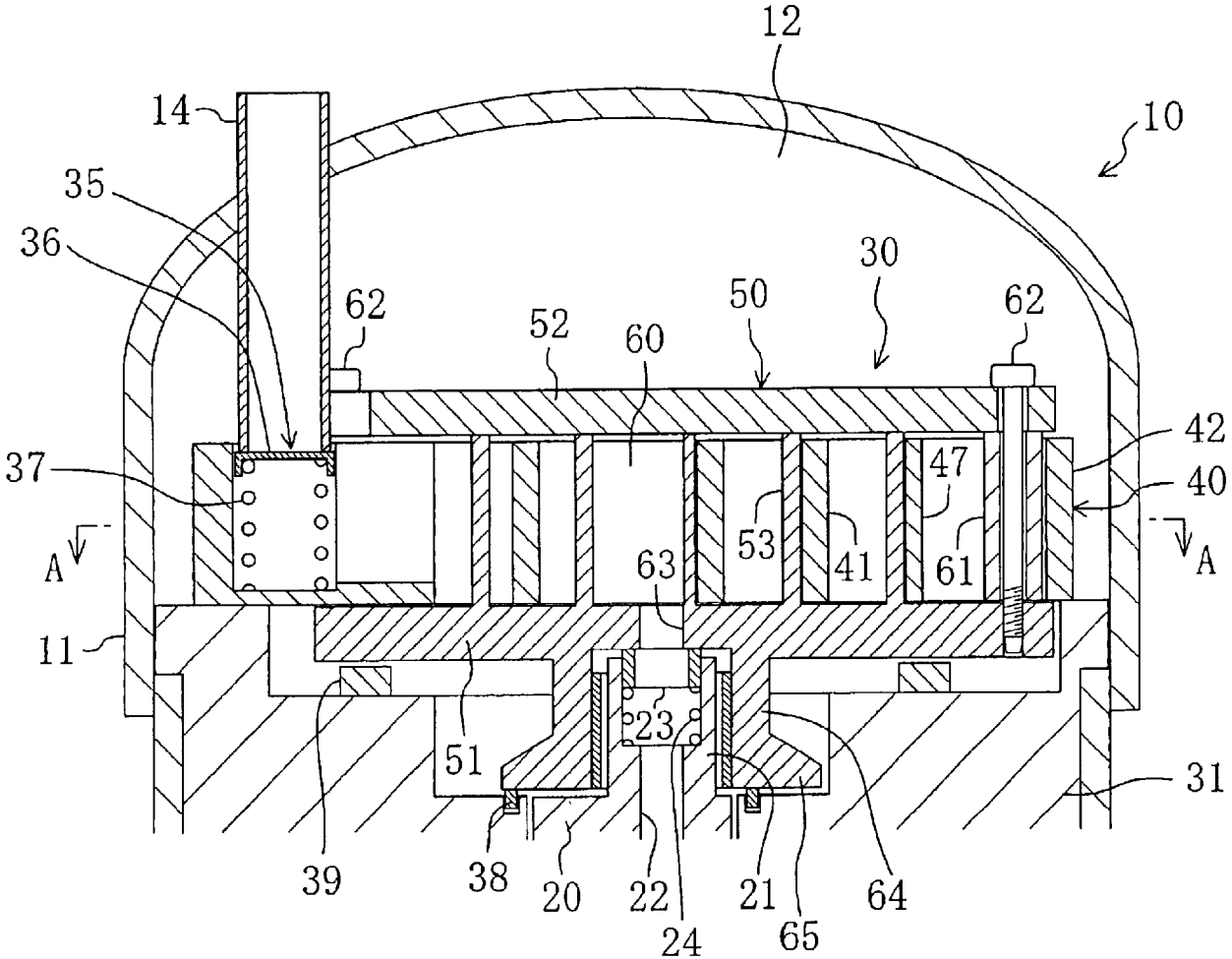
FIG. 2 is an enlarged cross-sectional view showing major parts of the scroll compressor in the first embodiment.

As shown also in FIG. 2, housed in the low pressure chamber (12) are a stationary scroll (40), a movable scroll (50), and an Oldham ring (39).

Figure 3:
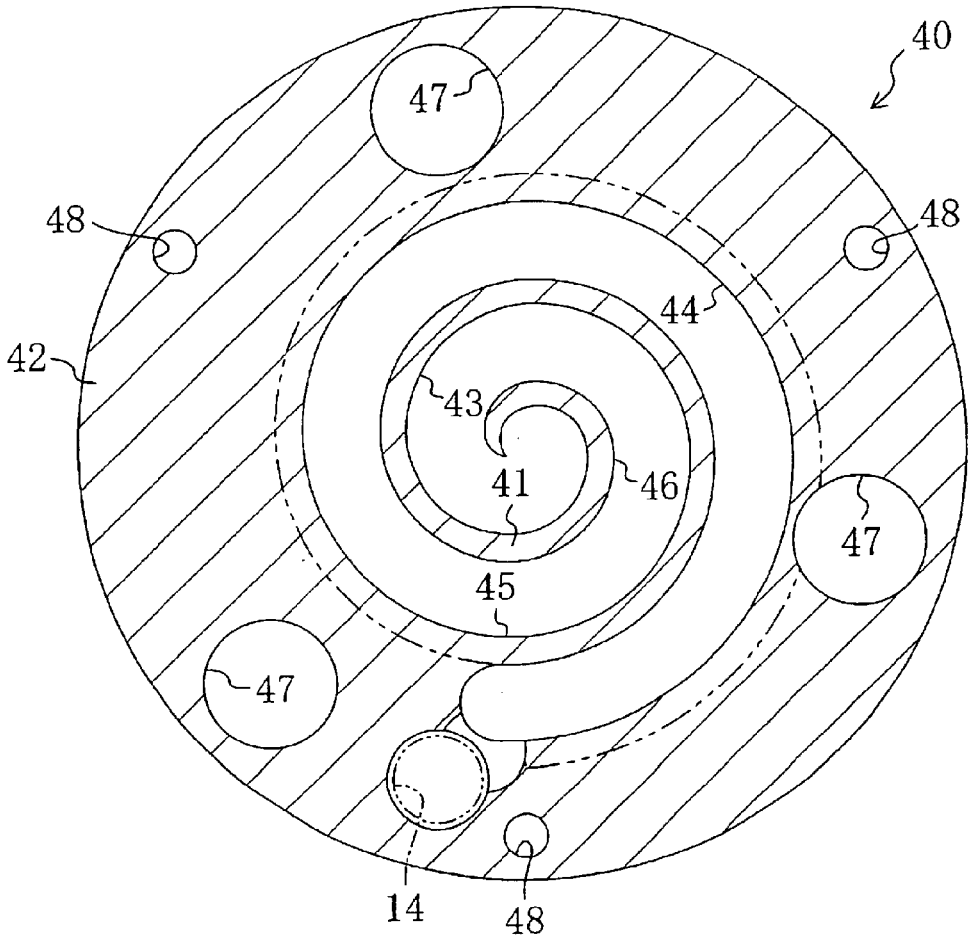
FIG. 3 is a cross-sectional view showing a stationary scroll in the first embodiment.

As shown also in FIG. 3, the stationary scroll (40) has a stationary side wrap (41) and an outer peripheral portion (42). FIG. 3 diagrams only the stationary scroll (40) and shows a cross-sectional view taken along the line A—A of FIG. 2.

The stationary side wrap (41) is shaped like a spiral wall of constant height. On the other hand, the outer peripheral portion (42) is shaped like a thick ring enclosing the periphery of the stationary side wrap (41) and is formed integrally with the stationary side wrap (41). In other words, on the inside of the outer peripheral portion (42), the stationary side wrap (41) projects in the form of a cantilevered beam. Further, formed in the outer peripheral portion (42) are three insertion apertures (47) and three bolt apertures (48). Both the insertion apertures (47) and the bolt apertures (48) pass through the outer peripheral portion (42) in the thickness direction thereof.

In the stationary scroll (40), an inner side surface (44) of the outer peripheral portion (42) is formed continuously with an inner side surface (43) of the stationary side wrap (41). Together with the inner side surface (43) of the stationary side wrap (41), the inner side surface (44) of the outer peripheral portion (42) constitutes a stationary side inner wrap surface (45). On the other hand, an outer side surface of the stationary side wrap (41) constitutes a stationary side outer wrap surface (46). In the stationary scroll (40), apparently the stationary side wrap (41) has a length of 1¾turns. However, since the inner side surface (44) of the outer peripheral portion (42) also constitutes the stationary side inner wrap surface (45), the inner wrap surface (45) has a length of 2¾ turns.

The stationary scroll (40) is placed on the housing (31) (see FIG. 2). The stationary scroll (40) is fastened firmly to the housing (31) by bolts slid through three bolt apertures (48), which is not shown in the Figure. One end of a tubular suction port (14) is inserted into the stationary scroll (40). The suction port (14) is so formed as to pass through an upper end of the casing (11).

Provided at a lower portion of the suction port (14) in the stationary scroll (40) is a suction check valve (35). The suction check valve (35) is made up of a valve element (36) and a coil spring (37). The valve element (36), shaped like a cap, is so mounted as to block up a lower end of the suction port (14). Additionally, the valve element (36) is pressed against the lower end of the suction port (14) by the coil spring (37).

Figure 4:
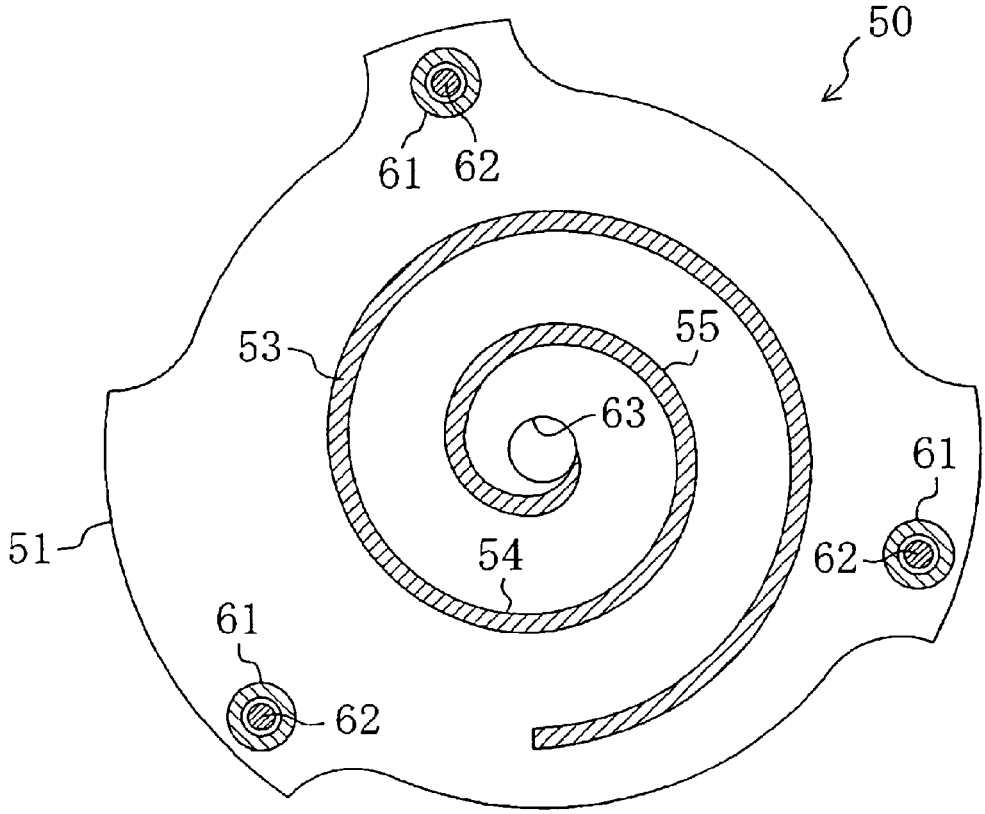
FIG. 4 is a cross-sectional view showing a movable scroll in the first embodiment.
Figure 5:
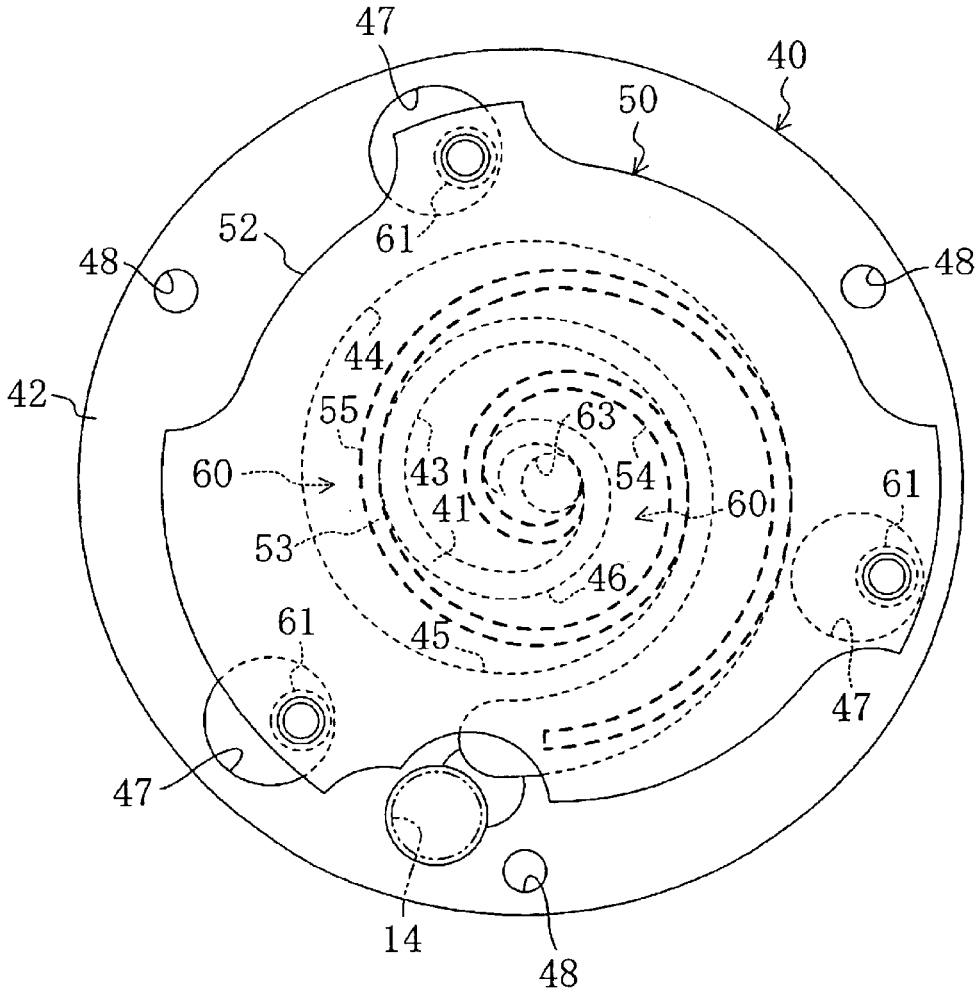
FIG. 5 is a top plan view showing the stationary scroll and the movable scroll in the first embodiment.

Referring to FIGS. 2, 4 and 5, the movable scroll (50) will be described. FIG. 4 shows only the movable scroll (50) and shows a cross-sectional view taken along the line A—A of FIG. 2. On the other hand, FIG. 5 diagrams both the stationary scroll (40) and the movable scroll (50) and shows a top plan view illustrating the stationary scroll (40) and the movable scroll (50) which are in engagement with each other.

The movable scroll (50) includes a first flat plate (51) constituting a first plate portion, a movable side wrap (53), a second flat plate (52) constituting a second flat plate portion, and support post members (61) each constituting a support post portion. The first flat plate (51) and the second flat plate (52) are such disposed that they face each other across the movable side wrap (53). The first flat plate (51) is formed integrally with the movable side wrap (53). On the other hand, the second flat plate (52) is formed as a separate body from each of the first flat plate (51) and the movable side wrap (53) and is coupled to the first flat plate (51). This will be described later.

As shown in FIG. 4, the first flat plate (51) is shaped like a substantially circular flat plate. The first flat plate (51) has three portions protruding in the radial direction. The support post members (61) are vertically formed in these protrusion portions, respectively. In other words, the movable scroll (50) is provided with the three support post members (61). Each support post member (61) is a thickish, tubular member and is formed as a separate body from the first flat plate (51).

The movable side wrap (53) is shaped like a spiral wall of constant height and is vertically formed on the side of a front surface (an upper surface in FIG. 2) of the first flat plate (51). An inner side surface of the movable side wrap (53) constitutes a movable side inner wrap surface (54). On the other hand, an outer side surface of the movable side wrap (53) constitutes a movable side outer wrap surface (55). The movable side wrap (53) is so formed that the movable side inner wrap surface (54) and the movable side outer wrap surface (55) draw an involute curve. Additionally, the movable side inner wrap surface (54) and the movable side outer wrap surface (55) each have a length of 2¼ turns.

As shown in FIG. 5, the second flat plate (52) is so formed as to have substantially the same shape as the first flat plate (51). However, the second flat plate (52) is provided with a notch for avoiding interference with the suction port (14). The second flat plate (52) is fastened to the first flat plate (51) by three bolts (62) with the support post members (61) and the movable scroll (50) sandwiched between the second flat plate (52) and the first flat plate (51). Diagramatic representation of the bolts (62) is omitted in FIG. 5. The bolts (62), inserted into the support post members (61), connect together the first flat plate (51) and the second flat plate (52) (see FIG. 2).

The first flat plate (51) and the second flat plate (52) are spaced apart from each other by the support post members (61) sandwiched between the first flat plate (51) and the second flat plate (52). The support post members (61) are slid into insertion apertures (47) formed in an outer peripheral portion (42) of the stationary scroll (40). The diameter of the insertion apertures (47) is set to such a value that the support post members (61) do not make contact with the outer peripheral portion (42) during revolutions of the movable scroll (50).

The movable side wrap (53) of the movable scroll (50) and the stationary side wrap (41) of the stationary scroll (40) matingly engage with each other (see FIG. 5). The stationary side inner wrap surface (45) and the stationary side outer wrap surface (46) come into sliding contact with the movable side outer wrap surface (55) and with the movable side inner wrap surface (54), respectively, with the movable side wrap (53) in mating engagement with the stationary side wrap (41). In other words, the stationary side inner and outer wrap surfaces (45) and (46) have a shape drawing an envelope curve of the movable side wrap (53) which executes an orbital motion.

Additionally, in the second flat plate (52) of the movable scroll (50) its front surface (the lower one in FIG. 2) constitutes a sliding surface which slides against an upper tip of the stationary side wrap (41). In other words, the sliding surface of the second flat plate (52) with respect to the stationary side wrap (41) is a mere planar surface. Further, the front surface of the first flat plate (51) (the upper one in FIG. 2) constitutes a sliding surface which slides against a lower tip of the stationary side wrap (41). A compression chamber (60) which is a fluid chamber is comparted by the stationary side wrap (41) and the movable side wrap (53) which come into sliding contact with each other, and the first flat plate (51) and the second flat plate (52) which are disposed face to face with each other across the stationary side wrap (41) and the movable side wrap (53).

In the movable scroll (50), the height of the supporting pillar members (61) is slightly greater than the height of the movable side wrap (53). Accordingly, most of the clamping pressure by the bolts (62) is supported by the support post members (61), and the movable side wrap (53) will not undergo deformation by the clamping pressure.

In addition, the height of the movable side wrap (53) (the vertical length in FIG. 2) is somewhat higher than the height of the stationary side wrap (41) (the vertical length in FIG. 2). This secures a clearance between each of the first and second flat plates (51) and (52) facing each other across the movable side wrap (53), and the stationary side wrap (41). Further, the thickness of the stationary side wrap (41) is greater than the thickness of the movable side wrap (53).

The compression mechanism (30) of the present embodiment employs a so-called asymmetric scroll construction (see FIG. 5). More specifically, in the compression mechanism (30) the stationary side inner wrap surface (45) formed by the outer peripheral portion (42) of the stationary scroll (40) is allowed to come into sliding contact with the whole of the movable side outer wrap surface (55) formed in an outer peripheralmost area of the movable side wrap (53). In other words, the stationary side inner wrap surface (45) extends to near an outer peripheral side end of the movable side wrap (53).

The first flat plate (51) of the movable scroll (50) is provided, at a central part thereof, with a discharge opening (63) (see FIGS. 2 and 4). The discharge opening (63) penetrates through the first flat plate (51). Formed in the first flat plate (51) is a bearing portion (64). The bearing portion (64) is formed into a substantially cylindrical shape and is projected on the side of the back surface of the first flat plate (51) (on the side of the lower surface in FIG. 2). Further, a collar portion (65), shaped like a collar, is formed at a lower end portion of the bearing portion (64).

A seal ring (38) is disposed between the lower surface of the collar portion (65) of the bearing portion (64) and the housing (31). High-pressure refrigerating machine oil is supplied to the inside of the seal ring (38) through the lubrication passageway of the driving shaft (20). When high-pressure refrigerating machine oil is delivered to the inside of the seal ring (38), a hydraulic pressure acts on the bottom surface of the collar portion (65). As a result, the movable scroll (50) is pushed upward. In other words, in the present embodiment a force for pressing the first flat plate (51) against the stationary scroll (40) is applied to the movable scroll (50).

The eccentric portion (21) of the driving shaft (20) is inserted into the bearing portion (64) of the first flat plate (51). An entrance end of the discharge passageway (22) opens at an upper end surface of the eccentric portion (21). The discharge passageway (22) is formed such that its diameter is made somewhat greater in the vicinity of its entrance end. Disposed in the inside of the discharge passageway (22) are a tubular seal (23) and a coil spring (24). The tubular seal (23) is shaped like a tube whose inside diameter is slightly greater than the diameter of the discharge opening (63) and is pressed against the back surface of the first flat plate (51) by the coil spring (24). Additionally, an exit end of the discharge passageway (22) opens between the stator (17) and the lower bearing (19) in the side surface of the driving shaft (20) (see FIG. 1).

Interposed between the first flat plate (51) and the housing (31) is an Oldham ring (39). The Oldham ring (39) has a pair of key portions which engage with the first flat plate (51) and another pair of key portions which engage with the housing (31), which is not shown. The Oldham ring (39) constitutes a rotation preventing mechanism for preventing rotation of the movable scroll (50).

In the present embodiment, the location of the center of gravity of the movable scroll (50) is so set as to lie substantially on the central line of the eccentric portion (21). The location of the center of gravity of the movable scroll

(50) is set by adjustment of both the shape of the first flat plate (51) and the shape of the second flat plate (52). In other words, deviation of the location of the center of gravity of the movable scroll (50) due to the arrangement that the movable side wrap (53) is formed into a spiral shape is cancelled by adjustment of both the shape of the first flat plate (51) and the shape of the second flat plate (52).

Working Operation

As has been described above, the scroll compressor (10) of the present invention is installed in a refrigerant circuit of a refrigerating machine. In the refrigerant circuit, a refrigerant circulates to perform a vapor compression refrigerating cycle. During such a cycle, the scroll compressor (10) draws in a low-pressure refrigerant vaporized in the evaporator and compresses it. Thereafter, the scroll compressor (10) delivers the compressed, high-pressure refrigerant to a condenser. The operation of refrigerant compression by the scroll compressor (10) will be described below.

Rotational power generated in the electric motor (16) is transferred to the movable scroll (50) by the driving shaft (20). The movable scroll (50) which engages with the eccentric portion (21) of the driving shaft (20) is guided by the Oldham ring (39) and executes only an orbital motion but does not rotate on its axis. When the movable scroll (50) is executing an orbital motion, the stationary side inner wrap surface (45) and the movable side outer wrap surface (55) come into sliding contact with each other while the stationary side outer wrap surface (46) and the movable side inner wrap surface (54) come into sliding contact with each other. Additionally, the upper tip of the stationary side wrap (41) is brought into sliding contact with the front surface of the second flat plate (52) while the lower tip of the stationary side wrap (41) is brought into sliding contact with the front surface of the first flat plate (51).

Low-pressure refrigerant is drawn into the suction port (14). The low-pressure refrigerant presses down the valve element (36) of the suction check valve (35) and flows into the compression chamber (60). As the movable scroll (50) moves, the volume of the compression chamber (60) decreases, and the refrigerant in the compression chamber (60) is compressed. The compressed refrigerant passes through the discharge opening (63) and flows into the discharge passageway (22) from the compression chamber (60). Thereafter, the high-pressure refrigerant flows into the high pressure chamber (13) through the discharge passageway (22), passes through the discharge port (15), and is delivered out of the casing (11).

Here, as the volume of the compression chamber (60) gradually decreases, the inner pressure of the compression chamber (60) increases. When the inner pressure of the compression chamber (60) rises, an axial load depressing the first flat plate (51) acts on the first flat plate (51) while an axial load pushing up the second flat plate (52) acts on the second flat plate (52). On the other hand, in the movable scroll (50) of the present embodiment the first flat plate (51) and the second flat plate (52) are connected together by the bolts (62). Consequently, an axial load acting on the first flat plate (51) and an axial load acting on the second flat plate (52) are cancelled each other. Accordingly, even when the inner pressure of the compression chamber (60) rises, apparently the axial load acting on the movable scroll (50) does not vary at all.

Effects of First Embodiment

In accordance with the present embodiment, the second flat plate (52) which comes into sliding contact with the stationary side wrap (41) is formed as a separate body from the movable side wrap (53). In the second flat plate (52) which is formed as a separate body from the movable side wrap (53), its sliding surface with respect to the stationary side wrap (41) is a mere planar surface. This makes it much easier to machine the sliding surface of the second flat plate (52) with respect to the stationary side wrap (41) with a high degree of accuracy in comparison with conventional scroll compressors in which an equivalent to the second flat plate (52) is formed integrally with a stationary side wrap to constitute a stationary scroll.

The present embodiment, therefore, makes it possible to finish the sliding surface of the second flat plate (52) to a low surface roughness without expending much time on the machining thereof and further ensures that the sliding surface of the second flat plate (52) is finished to a planar surface. As a result, the amount of fluid leaking through a gap between the second flat plate (52) and the stationary side wrap (41) is reduced considerably without reducing the production efficiency of the scroll compressor (10), and the efficiency of the scroll compressor (10) is improved.

Further, in the scroll compressor (10) of the present embodiment the second flat plate (52) is formed as a separate body from the movable side wrap (53) in the movable scroll (50). This makes it possible to check a positional relationship between the stationary side wrap (41) and the movable side wrap (53) for example by visual check or by the use of a clearance gauge or the like in a state prior to the assembling of the second flat plate portion (52), at the time of the assembling of the scroll compressor (10). It is possible to check a gap between the stationary side wrap (41) and the movable side wrap (53) while turning the movable side wrap (53), and the stationary scroll (40) is secured firmly to the housing (31) at an optimum position. Accordingly, in accordance with the present embodiment the amount of fluid leaking from the compression chamber (60) is reduced by optimizing the positional relationship between the stationary side wrap (41) and the movable side wrap (53), thereby making it possible to improve the efficiency of the scroll compressor (10).

Additionally, in the movable scroll (50) of the present embodiment the first flat plate (51) and the second flat plate (52) are disposed so that the movable scroll (50) is sandwiched therebetween and the first flat plate (51) and the second flat plate (52) are connected together by the bolts (62). Because of this, even when the inner pressure of the compressor chamber (60) acts on the first and second flat plates (51) and (52), a force acting on the first flat plate (51) and a force acting on the second flat plate (52) are cancelled each other.

Figure 6A:
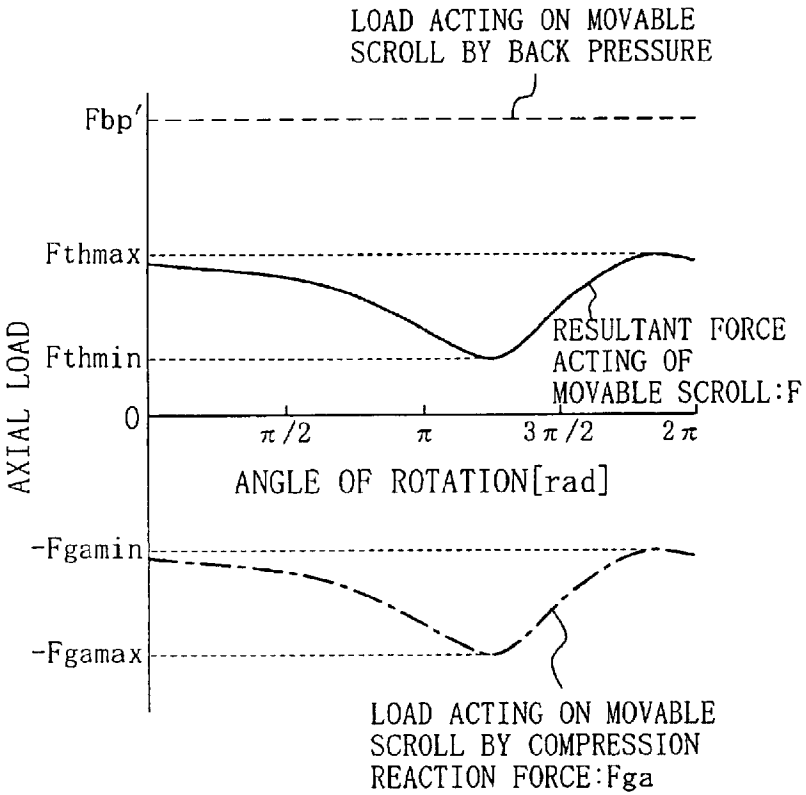
FIG. 6A is a diagram representing a relationship between the axial load and the angle of rotation of a movable scroll in a commonly used scroll compressor.
Figure 6B:
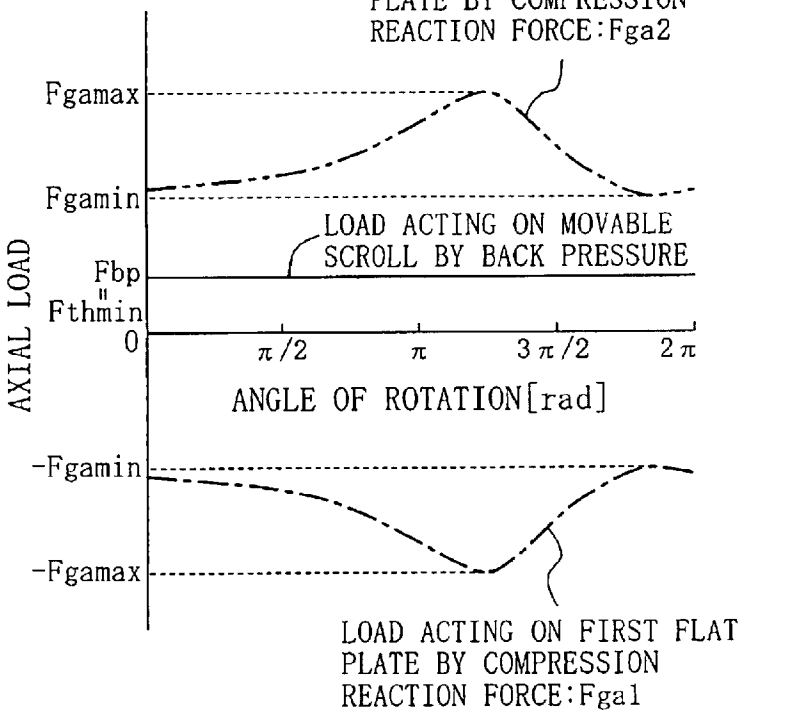
FIG. 6B is a diagram representing a relationship between the axial load and the angle of rotation of the movable scroll in the scroll compressor of the first embodiment.

Referring to FIGS. 6A and 6B, the above will be described. In FIGS. 6A and 6B, the upward load is positive (+) whereas the downward load is negative (−). In a general scroll type fluid machine, one of a pair of flat plates between which are sandwiched a stationary side wrap and a movable side wrap is provided in a stationary scroll and the other flat plate is provided in a movable scroll. Consequently, as shown in FIG. 6A, when the inner pressure of the compressor chamber rises by the orbital motion of the movable scroll, a load working in the direction in which the movable scroll is pulled away from the stationary scroll, i.e., a downward axial load Fga, acts on the movable scroll.

By contrast to the above, in the present embodiment the movable scroll (50) is provided with both the first flat plate (51) and the second flat plate (52). As shown in FIG. 6B, a downward axial load Fga1 acts on the first flat plate (51) and an upward axial load Fga2 acts on the second flat plate (52). These two loads always become equal in magnitude and a resultant force of the load Fga1 acting on the first flat plate

(51) and the load Fga2 acting on the second flat plate (52) becomes zero. Consequently, with the present embodiment, it is possible to achieve a considerable reduction in axial load (i.e., thrust load) acting on the movable scroll (50) as well as in frictional loss resulting from supporting an axial load acting on the movable scroll (50).

In the way described above, in accordance with the present embodiment it is possible to achieve a considerable reduction in frictional loss by reducing the axial load of the movable scroll (50). Accordingly, the scroll compressor (10) of the present embodiment is suitable for so-called variable speed type compressors. In other words, when the scroll compressor (10) is made variable in speed by the use of an inverter, there is the possibility that an alternating electrical current of a higher frequency than the commercial power source is supplied to the electric motor (16), thereby causing the movable scroll (50) to rotate at a high speed. By contrast to this, in the scroll compressor (10) according to the present embodiment it is possible to achieve a considering reduction in frictional loss during revolutions of the movable scroll (50). Accordingly, the scroll compressor (10) is extremely suitable for the high speed operation of the movable scroll (50).

Additionally, in the present embodiment the hydraulic pressure of refrigerating machine oil acts on the lower surface of the collar portion (65) in the movable scroll (50) so that the first flat plate (51) of the movable scroll (50) is pressed against the stationary scroll (40). Moments trying to incline the movable scroll (50) during revolutions thereof are reduced by application of such a pressing force.

In other words, in the movable scroll (50) its gravity center location lies away from the location of the bearing portion (64), so that a moment trying to incline the movable scroll (50) in the direction of the eccentric portion (21), is produced in the movable scroll (50) during revolutions thereof. On the other hand, when the aforementioned pressing force acts on the movable scroll (50), an opposite moment to the moment trying to incline the movable scroll (50) is produced, and these two moments are cancelled each other. Accordingly, in accordance with the present embodiment it is possible to prevent the movable scroll (50) from inclining and coming into contact with the stationary scroll (40) and the eccentric portion (21) of the rotary shaft. Therefore, it is possible to improve the reliability of the scroll compressor (10) because possible damage by contact is avoided.

Additionally, in accordance with the present embodiment it is possible to considerably reduce pressing force which is applied for controlling the inclination of the movable scroll (50) in comparison with commonly used scroll compressors. This will be described by making reference again to FIGS. 6A and 6B.

As has been described above, in a scroll compressor having a conventional configuration the inner pressure of a compression chamber causes a downward axial load to act on a movable scroll. When the movable scroll executes an orbital motion, the inner pressure of the compression chamber varies. Accordingly, the axial load Fga which acts on the movable scroll will vary according to the angle of rotation of the movable scroll. More specifically, the axial load Fga varies in the range of $-Fgamax \leqq Fga \leqq -Fgamin$, as shown by dashed line in FIG. 6A.

Here, suppose an upward pressing force Fthmin with respect to the movable scroll (50) is required at minimum for preventing the movable scroll (50) from inclining. In such an assumption, even if $Fga=-Fgamax$, it is necessary to make a resultant force F that acts on the movable scroll greater than Fthmin. Accordingly, in this case a minimum pressing force Fbp' to be acted on the movable scroll is $Fbp'=Fthmin+Fgamax$.

However, the pressing force Fbp' to be acted on the movable scroll is applied by making utilization of the hydraulic pressure of refrigerating machine oil or the like and is substantially constant, regardless of the angle of rotation of the movable scroll. Accordingly, the resultant force F that acts on the movable scroll will have varied in the range of $Fibmin \leqq F \leqq Fthmax$. In other words, a greater force than the required minimum pressing force Fthmin almost constantly acts on the movable scroll. As a result of this, the upward pressing force that acts on the movable scroll becomes excessive in a commonly used scroll compressor, thereby producing the problem that the frictional loss during revolutions of the movable scroll (50) becomes excessive.

By contrast to the above, in accordance with the present embodiment the axial load that acts on the movable scroll (50) is cut to zero by the inner pressure of the compression chamber (60), which will be described. When the inner pressure of the compression chamber (60) varies during revolutions of the movable scroll (50), the downward axial load Fga1 which acts on the first flat plate (51) varies in the range of $-Fgamax \leqq Fga1 \leqq -Fgamin$, as shown by dashed line in FIG. 6B. Further, the upward axial load Fga2 that acts on the second flat plate (52) varies in the range of $Fgamin \leqq Fga2 \leqq Fgamax$, as shown by chain double-dashed line in FIG. 6B. These two loads Fga1 and Fga2, which have the same magnitude and orient in opposite direction in every angle of rotation, are cancelled each other.

In the way as described above, in the scroll compressor (10) of the present embodiment, apparently only an upward pressing force Fbp that is applied by making use of a high-pressure refrigerating machine oil acts on the movable scroll (50). If the pressing force Fbp is Fbp=Fthmin, this makes it possible to prevent inclination of the movable scroll (50). Accordingly, the present embodiment makes it possible to suppress frictional loss produced by the pressing force Fbp acting on the movable scroll (50) to the minimum while improving the reliability of the scroll compressor (10) by preventing inclination of the movable scroll (50).

Additionally, in the present embodiment the height of the movable side wrap (53) sandwiched between the first flat plate (51) and the second flat plate (52) is made greater than the height of the stationary side wrap (41) which engages with the movable side wrap (53). This ensures that the movable scroll (50) is prevented from being placed in the lock state with respect to the stationary scroll (40) when connecting the first flat plate (51) and the second flat plate (52) together with the bolts (62). In other words, such a situation that the stationary side wrap (41) is caught between the first flat plate (51) and the second flat plate (52) and the movable scroll (50) becomes unable to execute an orbital motion, is avoided without fail. Accordingly, the present embodiment ensures that a scroll compressor is assembled without paying special attention, and the production process thereof can be simplified.

Further, in accordance with the present embodiment the movable scroll (50) is provided with the plural support post members (61), which ensures that the first flat plate (51) and the second flat plate (52) are connected together while holding a space therebetween. Furthermore, in the movable scroll (50) of the present embodiment the support post members (61) are disposed more outside than the movable side wrap (53), thereby making it possible to keep the movable side wrap (53) small in size. Accordingly, in accordance with the present embodiment it is possible to connect together the first flat plate (51) and the second flat plate (52) without fail while preventing the movable scroll (50) from increasing in size.

Additionally, in accordance with the present embodiment the height of the support post members (61) is greater than the height of the movable side wrap (53), thereby making it possible for the support post members (61) to support most of the clamping force by the bolts (62). Because of this, even if the clamping force of the bolts (62) for connecting together the first flat plate (51) and the second flat plate (52) is excessive, the movable side wrap (53) is prevented from undergoing a great deformation due to the clamping force, and refrigerant leakage from the compression chamber (60) is prevented, and the drop in the efficiency of the scroll compressor (10) is avoided.

Further, in accordance with the present embodiment it is possible to considerably simplify the dimensional control of members required for preventing excessive inclination of the movable scroll (50). This will be described by making reference to FIG. 7.

As described above, in a commonly used scroll compressor a pair of flat plates between which a stationary side wrap and a movable side wrap are sandwiched, one of the flat plates is provided in a stationary scroll whereas the other flat plate is provided in a movable scroll. In such a scroll compressor, to which extent the movable scroll inclines is determined by a clearance δ between the back surface of the movable scroll and an Oldham ring.

On the other hand, if the inclination of the movable scroll increases, this causes an eccentric portion of a driving shaft to come into contact with a bearing portion of the movable scroll, thereby causing trouble such as abrasion and damage. As a result, the need for accurate control of the clearance δ between the movable scroll and the Oldham ring for suppressing the inclination of the movable scroll to below a certain level arises. However, various dimensions have an effect on the clearance δ. These many dimensions must be controlled in the range of a narrow tolerance, thereby producing the problem that the production efficiency of scroll compressor drops.

Figure 7:
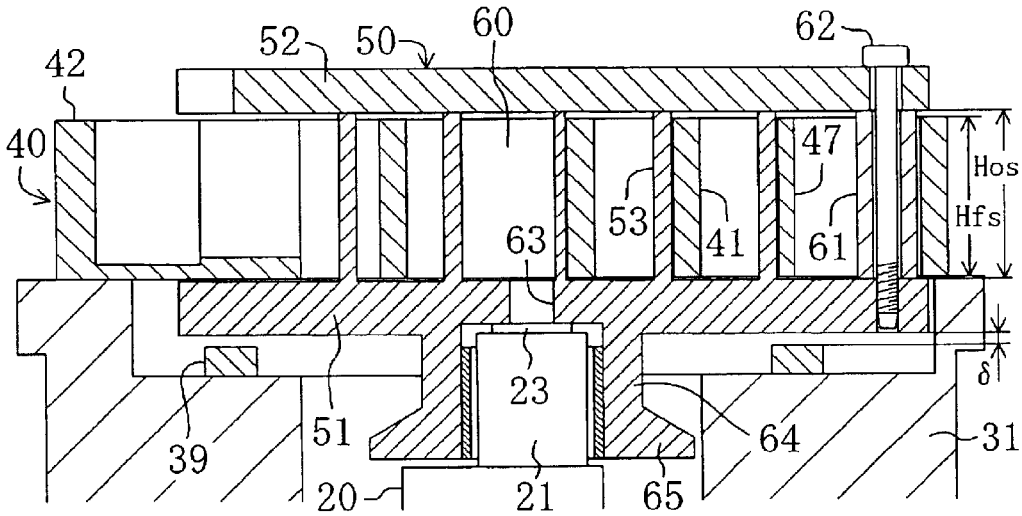
FIG. 7 is an enlarged cross-sectional view showing major parts of a compression mechanism in the first embodiment.
Figure 7:
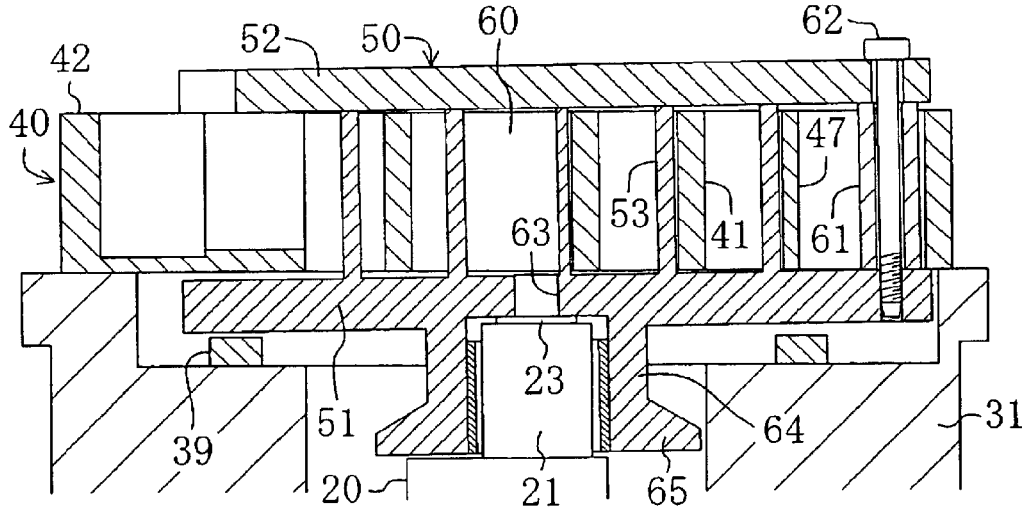

By contrast to the above, in the scroll compressor (10) of the present embodiment the movable scroll (50) is provided with both the first flat plate (51) and the second flat plate (52), and the stationary scroll (40) is sandwiched between the first flat plate (51) and the second flat plate (52). As shown in FIG. 7, to which extent the movable scroll (50) inclines in the scroll compressor (10) of the present invention is determined not by the clearance δ between the movable scroll (50) and the Oldham ring (39) but by a difference (Hos−Hfs) between Hos (the height of the movable side wrap (53)) and Hfs (the height of the stationary side wrap (41)).

Such arrangement ensures that excessive inclination of the movable scroll (50) is avoided by the controlling of only two dimensions, i.e., Hos (the height of the movable side wrap (53)) and Hfs (the height of the stationary side wrap (41)). Accordingly, the present embodiment makes it possible to maintain the reliability of the scroll compressor (10) at high level and to improve the production efficiency of the scroll compressor (10).

Here, in the scroll compressor (10) of the present embodiment it is arranged such that the stationary side wrap (41) is formed as a separate body from each of the first flat plate (51) and the second flat plate (52), and the stationary side wrap (41) projects in the form of a cantilevered beam toward the inside of the outer peripheral portion (42). Accordingly, in comparison with the movable side wrap (53) which is formed integrally with the first flat plate (51), the stationary side wrap (41) might undergo a greater deformation.

By contrast to the above, in the present embodiment the thickness of the stationary side wrap (41) is made greater than the thickness of the movable side wrap (53). Accordingly, in accordance with the present embodiment it is possible to enhance the rigidity of the stationary side wrap (41) which is more susceptible to deformation in comparison with the movable side wrap (53), thereby preventing the stationary side wrap (41) from undergoing an excessive deformation.

Additionally, in the present embodiment the stationary side inner wrap surface (45) is made up of the inner side surface (43) of the stationary side wrap (41) and the inner side surface (44) of the outer peripheral portion (42) (see FIGS. 3 and 5). This arrangement makes it possible to make the stationary side wrap (41) more susceptible to deformation than the movable side wrap (53) shorter than the movable side wrap (53) by about half a turn. Accordingly, in the present embodiment it is possible to enhance the rigidity of the stationary side wrap (41) by reducing the length of the stationary side wrap (41) and excessive deformation of the stationary side wrap (41) can be controlled.

Further, the present embodiment employs a so-called asymmetric construction. In other words, the length of the stationary side inner wrap surface (45) is longer than the length of the movable side outer wrap surface (55) by about half a turn. Accordingly, in comparison with a symmetric scroll construction in which the wrap surfaces (45) and (55) have the same length, it is possible to increase the maximum volume of the compression chamber (60) comparted by the stationary side inner wrap surface (45) and the movable side outer wrap surface (55). In addition, the length of the stationary side wrap surfaces (45, 46) and the length of the movable side wrap surfaces (54, 55) can be reduced without reducing the amount of refrigerant that the scroll compressor (10) can draw in. As a result, the rigidity of the stationary side wrap (41) is further enhanced by reducing the length of the stationary side wrap (41) to a further extent, thereby ensuring that excessive deformation of the stationary side wrap (41) is controlled.

Furthermore, in the present embodiment the first flat plate (51) and the second flat plate (52) are modified in their shape in order to adjust the location of the center of gravity of the movable scroll (50). As a result, it becomes possible to adjust the location of the center of gravity of the movable scroll (50) while preventing the movable scroll (50) from becoming large in size.

The above will be described. In a commonly used scroll type fluid machine, only an equivalent to the first flat plate (51) is disposed in a movable scroll. Accordingly, adjustment of the location of the center of gravity of the movable scroll has to be carried out by changing only the shape of the equivalent to the first flat plate (51), which might cause the size thereof to increase.

By contrast to the above, in the present embodiment both the first flat plate (51) and the second flat plate (52) are disposed in the movable scroll (50). As a result of such arrangement, it becomes possible to perform adjustment of the location of the center of gravity of the movable scroll (50) by changing both the shape of the first flat plate (51) and the shape of the second flat plate (52). Accordingly, in accordance with the present embodiment the first flat plate (51) and the second flat plate (52) are downsized and, therefore, the movable scroll (50) is downsized, in comparison with commonly used scroll compressors.

In addition, in the present embodiment the stationary scroll (40) and movable scroll (50) of the compression mechanism (30) are installed in the low pressure chamber (12) in the inside of the casing (11). Stated another way, the areas around the stationary scroll and movable scrolls (40) and (50) are placed in the same pressure level as the suction pressure of the scroll compressor (10). Accordingly, in view of the compression chamber (60) whose volume has increased to a maximum formed on the outer peripheralmost side of the movable side wrap (53), there is little difference between the inner pressure of the compression chamber (60) and the inner pressure of the low pressure chamber (12).

Here, the present embodiment employs such an arrangement that the second flat plate (52) is so disposed in the movable scroll (50) as to slide against the stationary scroll (40). Consequently, if the areas around the stationary and movable scrolls (40) and (50) are placed in the same high pressure level as the discharge pressure, this might cause refrigerant to leak into the compression chamber (60) through a gap between the second flat plate (52) and the stationary scroll (40), thereby resulting in the drop in efficiency.

By contrast to the above, in accordance with the present embodiment it is possible to extremely reduce the difference in pressure between the maximum volume compression chamber (60) and the areas around the stationary and movable scrolls (40) and (50). Accordingly, in accordance with the present embodiment it is possible to considerably reduce the amount of refrigerant leaking into the compression chamber (60) through a gap between the second flat plate (52) and the stationary scroll (40), thereby preventing the scroll compressor (10) from dropping in efficiency.

Additionally, in the present embodiment the stationary side wrap (41) is formed as a separate body from the second flat plate (52). This makes it possible to reduce the size of gaps in the vicinity of the tips of the stationary side wrap (41) and the movable side wrap (53), thereby reducing the amount of refrigerant leaking through the gaps. This will be described by making reference to FIGS. 8A and 8B and to FIGS. 9A and 9B.

Figure 8A:
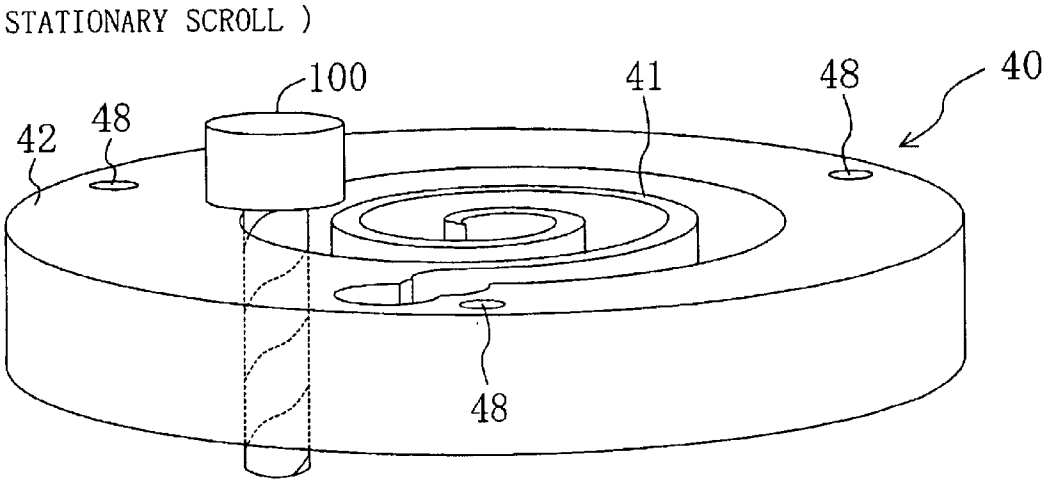
FIG. 8A is a schematic perspective view of the stationary scroll in the first embodiment.
Figure 8B:
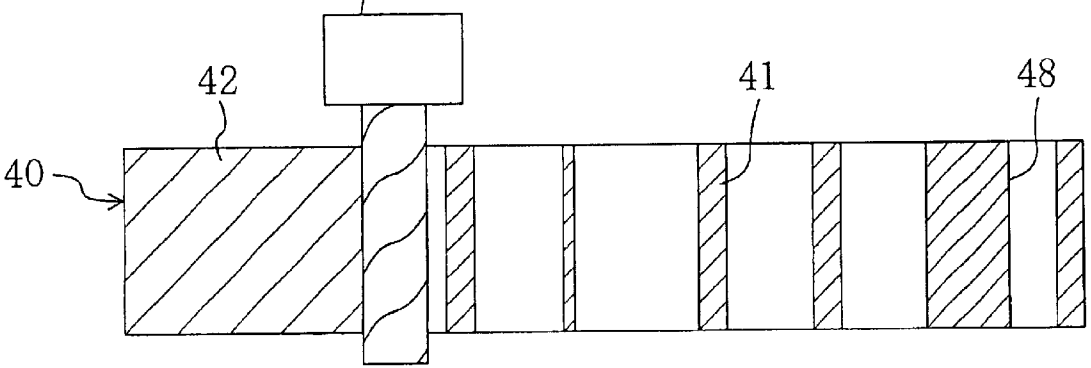
FIG. 8B is a schematic cross-sectional view of the stationary scroll in the first embodiment.

As has been described above, the stationary scroll (40) of the present embodiment has such a shape that the spiral stationary side wrap (41) projects in the form of a cantilevered beam toward the inside of the ring-like outer peripheral portion (42). Accordingly, machining of the stationary scroll (40) can be carried out by the use of an end mill (100) with a cutting edge formed only on its side surface, as shown in FIGS. 8A and 8B.

Figure 9A:
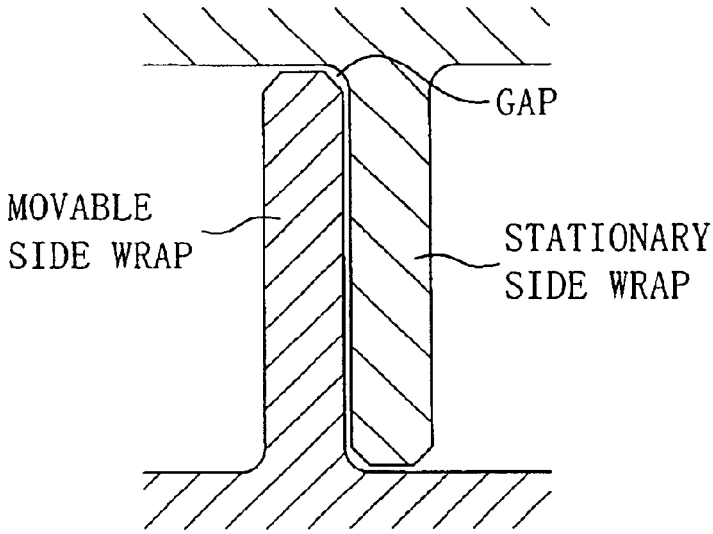
FIG. 9A is a schematic cross-sectional view showing a movable side wrap and a stationary side wrap in a commonly used scroll compressor.

On the other hand, in a stationary scroll of a commonly used scroll compressor an equivalent to the second flat plate is formed integrally with a stationary side wrap. Machining of such a stationary scroll requires an end mill having at its end surface a cutting edge. Such a type of end mill easily wears at corners of the cutting edge. Consequently, a curved surface-like radius is formed at the root of the stationary side wrap, as shown in FIG. 9A. In order to avoid interference with such a radius portion, the tip of the movable side wrap is chamfered. As a result, there is created a gap in the vicinity of the root of the stationary side wrap and in the vicinity of the tip of the movable side wrap, leakage of refrigerant through the gaps occurs.

Figure 9B:
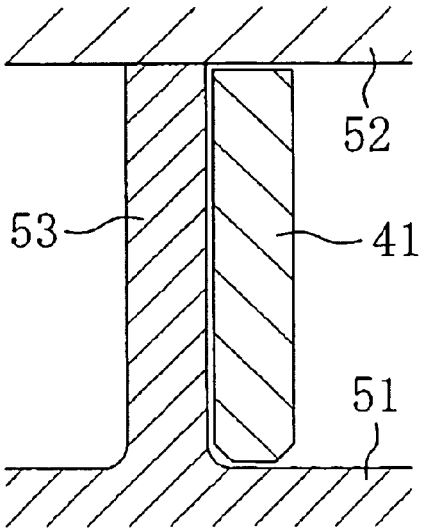
FIG. 9B is a schematic cross-sectional view showing a movable side wrap and a stationary side wrap in the scroll compressor of the first embodiment.

By contrast to the above, in the present embodiment the stationary scroll (40) is formed as a separate body from the second flat plate (52). Consequently, as shown in FIG. 9B, it is possible to finish the tips of the stationary and movable side wraps (41) and (53) at right angles, thereby preventing creation of gaps in the vicinity thereof. Accordingly, in accordance with the present embodiment the amount of refrigerant leaking through the gaps in the vicinity of the stationary and movable side wraps (41) and (53) is reduced, thereby improving the efficiency of the scroll compressor (10).

First Modification Example of First Embodiment

As described above, the scroll type fluid machine constituting the scroll compressor (10) of the present embodiment comprises the stationary scroll (40), the movable scroll (50) which executes an orbital motion, the rotation preventing mechanism for preventing rotation of the movable scroll (50), and the rotating shaft. The stationary scroll (40) includes the spiral stationary side wrap (41). On the other hand, the movable scroll (50) includes the first flat plate (51) which engages with the eccentric portion (21) of the rotating shaft, the movable side wrap (53) which comes into mating engagement with the stationary side wrap (41), and the second flat plate (52) which is disposed face to face with the first flat plate (51) across the movable side wrap (53). The stationary side wrap (41), the movable side wrap (53), the first flat plate (51), and the second flat plate (52) together constitute a compression chamber (60).

In the scroll compressor (10) of the present embodiment, the first flat plate (51) is formed integrally with the movable side wrap (53), while the second flat plate (52) is formed as a separate body from each of the first flat plate (51) and the movable side wrap (53). However, instead of such an arrangement the following arrangement may be employed.

Figure 10:
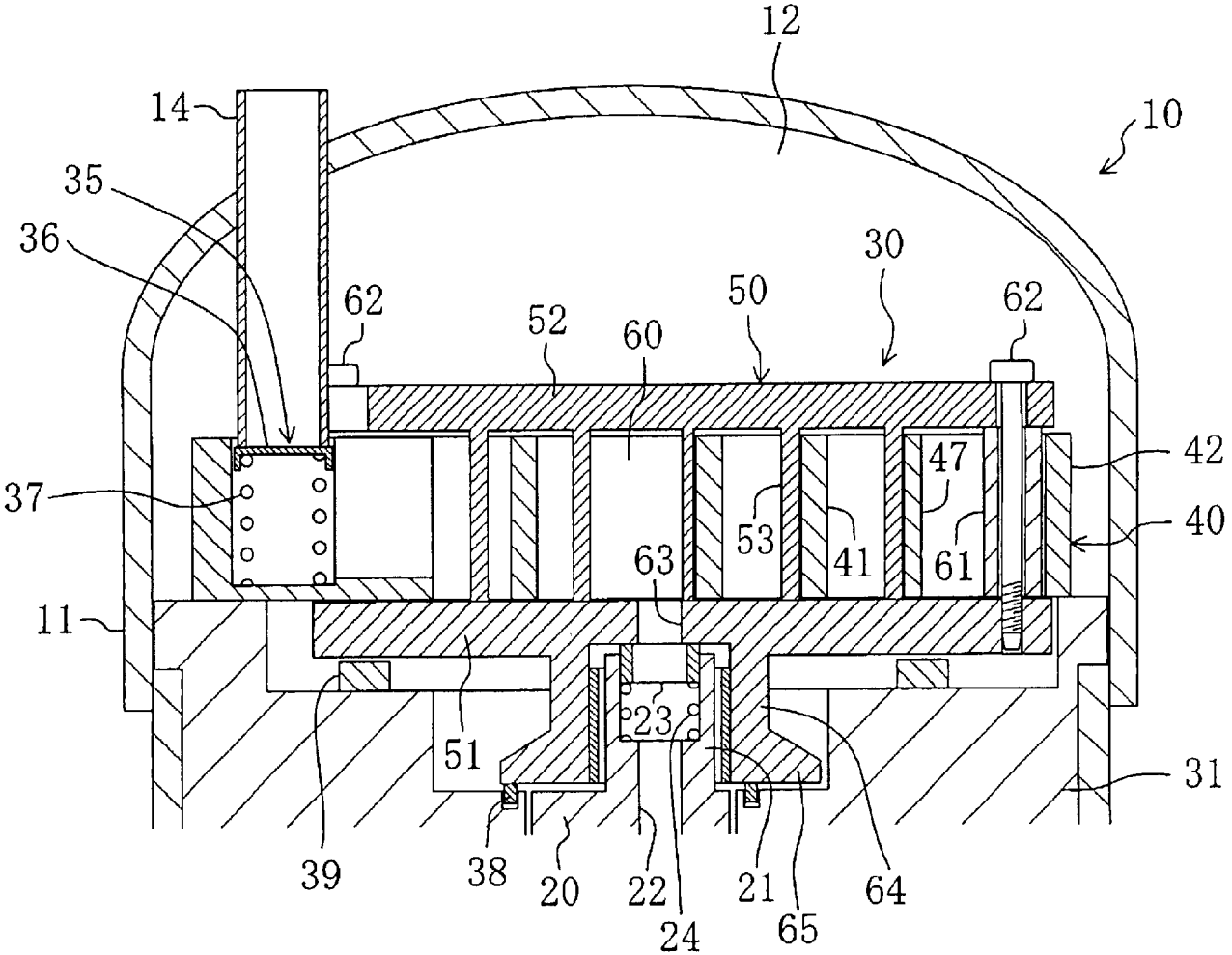
FIG. 10 is an enlarged cross-sectional view showing major parts of a scroll compressor of a first modification example of the first embodiment.

In the first place, it may be arranged such that the second flat plate (52) is formed integrally with the movable side wrap (53) while the first flat plate (51) is formed as a separate body from each of the second flat plate (52) and the movable side wrap (53), as shown in FIG. 10. In this arrangement, in the first flat plate (51) which is formed as a separate body from the movable side wrap (53), its sliding surface with respect to the stationary side wrap (41) is a mere planar surface. Consequently, in comparison with a commonly used scroll compressor in which an equivalent to the first flat plate (51) is formed integrally with a movable side wrap so as to constitute a movable scroll, it becomes extremely easier to machine the sliding surface of the first flat plate (51) with respect to the stationary side wrap (41) with a high degree of accuracy. Accordingly, in accordance with the present modification example it is possible to improve the efficiency of the scroll compressor (10) without reducing the production efficiency thereof as in the scroll compressor (10) of the foregoing embodiment.

Figure 11:
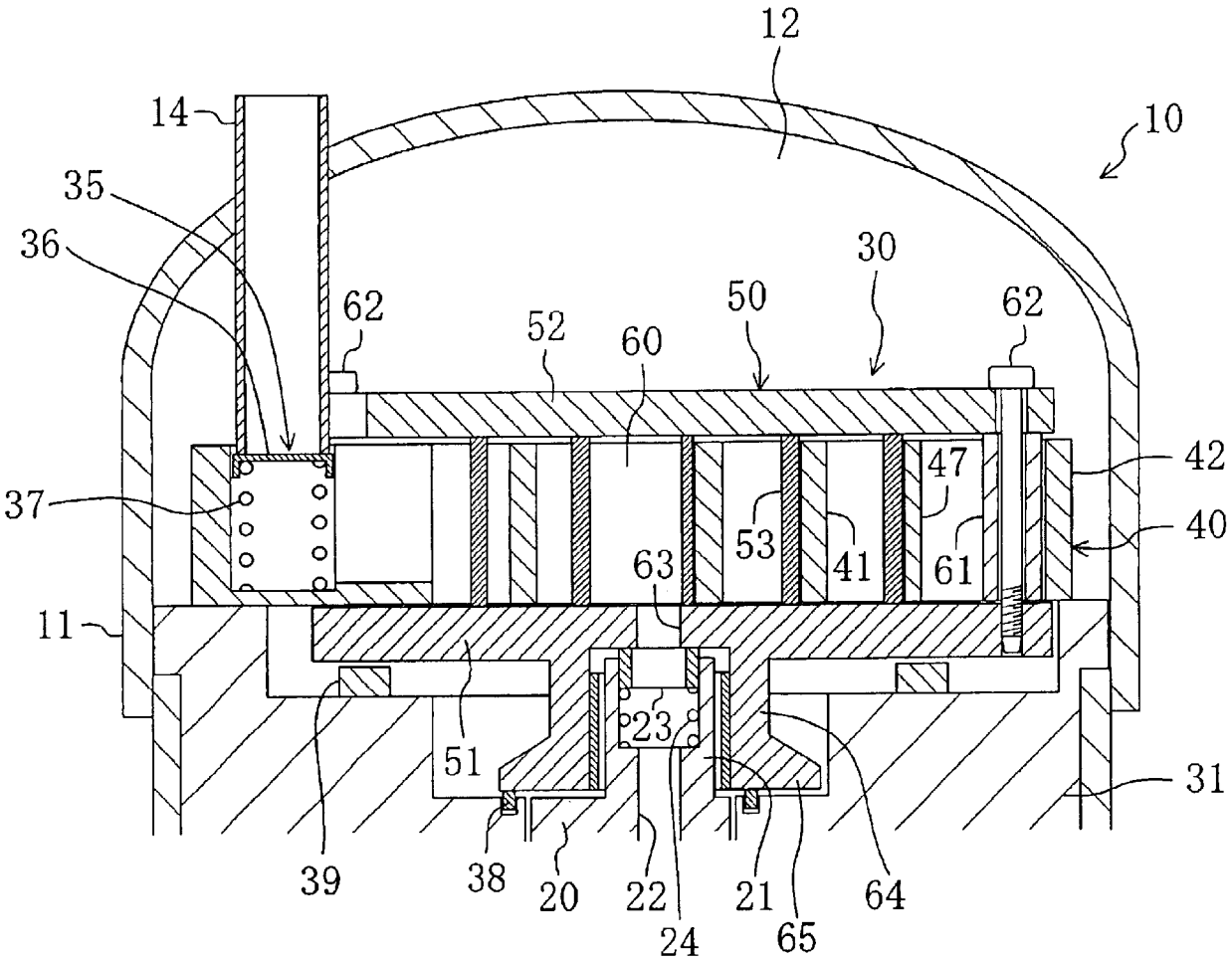
FIG. 11 is an enlarged cross-sectional view showing major parts of the scroll compressor of the first modification example of the first embodiment.

In the next place, as shown in FIG. 11, it may be arranged such that the first flat plate (51), the second flat plate (52), and the movable side wrap (53) are each formed as a separate body from the other. In such an arrangement, in the first and second flat plates (51) and (52) which are formed as a separate body from the movable side wrap (53) their sliding surfaces with respect to the stationary side wrap (41) are mere planar surfaces. Consequently, in comparison with a commonly used scroll compressor in which an equivalent to the first flat plate (51) is formed integrally with a movable side wrap so as to form a movable scroll while an equivalent to the second flat plate (52) is formed integrally with a stationary side wrap so as to form a stationary scroll, high-accuracy machining of the sliding surfaces of the first and second flat plates (51) and (52) with respect to the stationary side wrap (41) is facilitated considerably. Accordingly, in accordance with the present modification example it is possible to improve the efficiency of the scroll compressor (10) without reducing the production efficiency thereof, as in the scroll compressor (10) of the foregoing embodiment.

Further, where such an arrangement is employed it becomes possible to check a positional relationship between the stationary side wrap (41) and the movable side wrap (53) for example by visual check or by the use of a clearance gauge or the like in a state prior to the assembling of the second flat plate portion (52). Further, it is possible to check a gap between the stationary side wrap (41) and the movable side wrap (53) while the movable side wrap (53) is being turned, thereby making it possible for the stationary scroll (40) to be secured firmly to the housing (31) at an optimum position. Accordingly, in accordance with the present modification example the amount of fluid leakage from the compression chamber (60) is reduced also by optimizing the alignment of the stationary side wrap (41) and the movable side wrap (53), thereby making it possible to improve the efficiency of the scroll compressor (10).

Second Modification Example of First Embodiment

Figure 12:
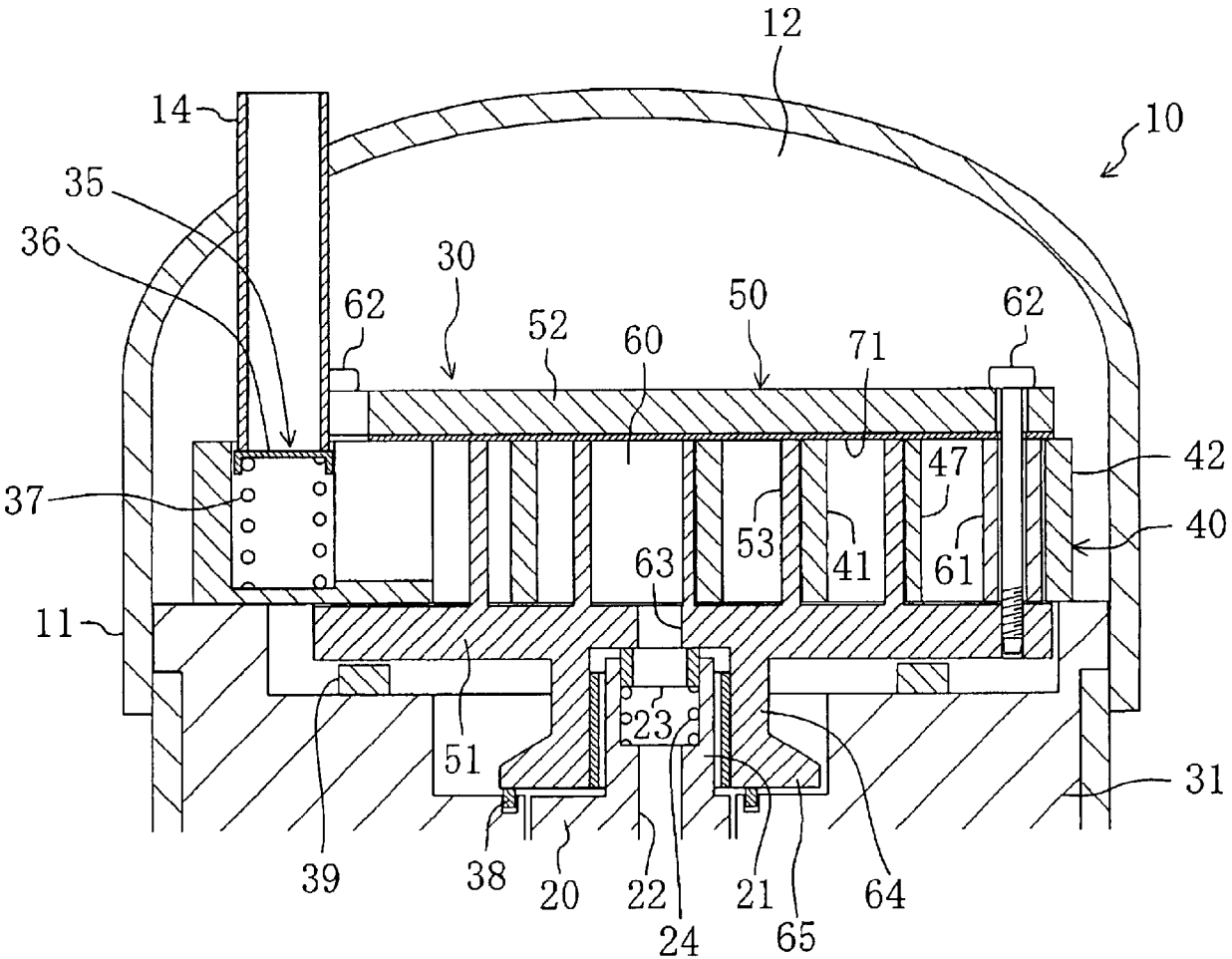
FIG. 12 is an enlarged cross-sectional view showing major parts of a scroll compressor of a second modification example of the first embodiment.

In the scroll compressor (10) of the foregoing embodiment, a sliding plate (71) may be sandwiched between the movable side wrap (53) and the second flat plate (52), as shown in FIG. 12. The sliding plate (71) is a thin plate made of a material superior in abrasion resistance such as spring steel and constitutes a thin plate member. In the scroll compressor (10) of the present modification example, the sliding plate (71) slides against the upper tip of the stationary side wrap (41). Since the sliding plate (71) exhibits excellent resistance to abrasion, this ensures that trouble, such as abrasion and seizing, is prevented even in the upper tip of the stationary side wrap (41) prone to deficiency in the amount of lubricant at startup or the like.

In addition, it is possible to apply the present modification example to the scroll compressor (10) of the first modification example. In other words, when employing such an arrangement that the second flat plate portion (52) is formed integrally with the movable side wrap (53) while the first flat plate (51) is formed as a separate body from each of the second flat plate (52) and the movable side wrap (53), the sliding plate (71) may be sandwiched between the movable side wrap (53) and the first flat plate (51). In this case, the lower tip of the fixed scroll (40) slides against the sliding plate (71). Additionally, when employing such an arrangement that the first flat plate (51), the second flat plate (52), and the movable side wrap (53) are each formed as a separate body from the other, the sliding plate (71) may be sandwiched between the movable side wrap (53) and the first flat plate (51) as well as between the movable side wrap (53) and the second flat plate (52). In such an arrangement, the sliding plate (71) slides against the upper and lower tips of the stationary scroll (40).

Third Modification Example of First Embodiment

The scroll compressor (10) of the foregoing embodiment is equipped with the Oldham ring (39) serving as a rotation preventing mechanism for preventing rotation of the movable scroll (50). However, instead of such an arrangement the following arrangement may be employed.

Figure 13:
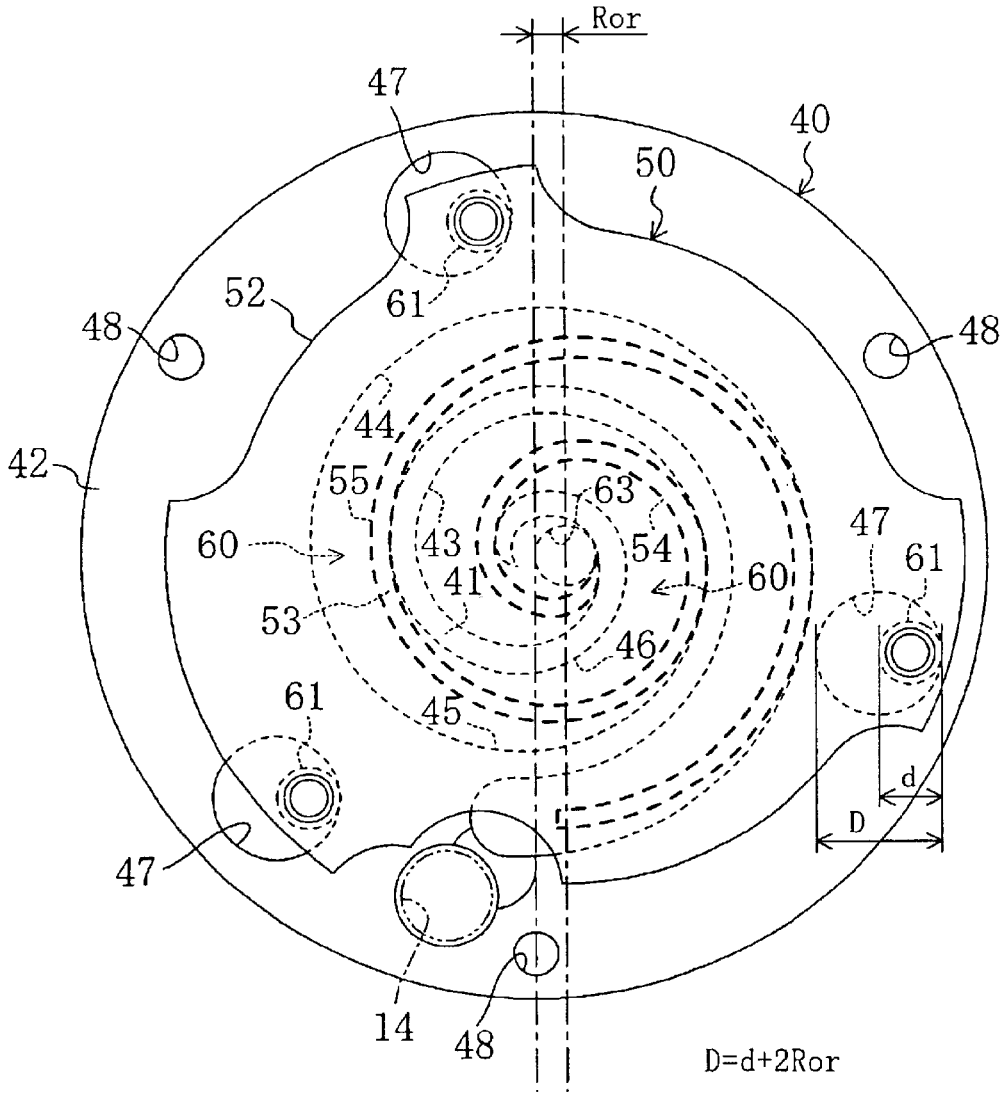
FIG. 13 is a top plan view showing a stationary scroll and a movable scroll in a third modification example of the first embodiment.

In other words, as shown in FIG. 13, an arrangement may be employed in which the insertion apertures (47) of the outer peripheral portion (42) and the support post members (61) inserted into the insertion apertures (47) together constitute a rotation preventing mechanism for preventing rotation of the movable scroll (50). In the instant modification example, each insertion aperture (47) is such formed that its diameter D is $D=d+2\cdot Ror$ where d indicates the diameter of the support post members (61) and Ror indicates the revolution radius of the movable scroll (50). Further, the insertion aperture (47), which is formed at a predetermined location so as to draw an envelop curve of the support post member (61) which revolves with the movable scroll (50), constitutes a guide aperture.

In the scroll compressor (10) of the present modification example, the side surface of each support post member (61) slides against the side wall of the insertion aperture (47). And, each support post member (61) and the outer peripheral portion (42) come into sliding contact with each other, thereby guiding the movable scroll (50), and the rotation of the movable scroll (50) is regulated. In this way, in the present modification example it is possible to constitute a rotation preventing mechanism for preventing rotation of the movable scroll (50) by making utilization of the support post members (61) of the movable scroll (50) and the insertion apertures (47) of the outer peripheral portion (42). Accordingly, the present modification example eliminates the need for the provision of the Oldham ring (39) as a rotation preventing mechanism, thereby making it possible to simplify the construction of the scroll compressor (10).

Fourth Modification Example of First Embodiment

In the scroll compressor (10) of the foregoing embodiment, in the stationary scroll (40) the height of the outer peripheral portion (42) is equal to that of the stationary side wrap (41). However, instead of employing such an arrangement the following arrangement may be used.

Figure 14:
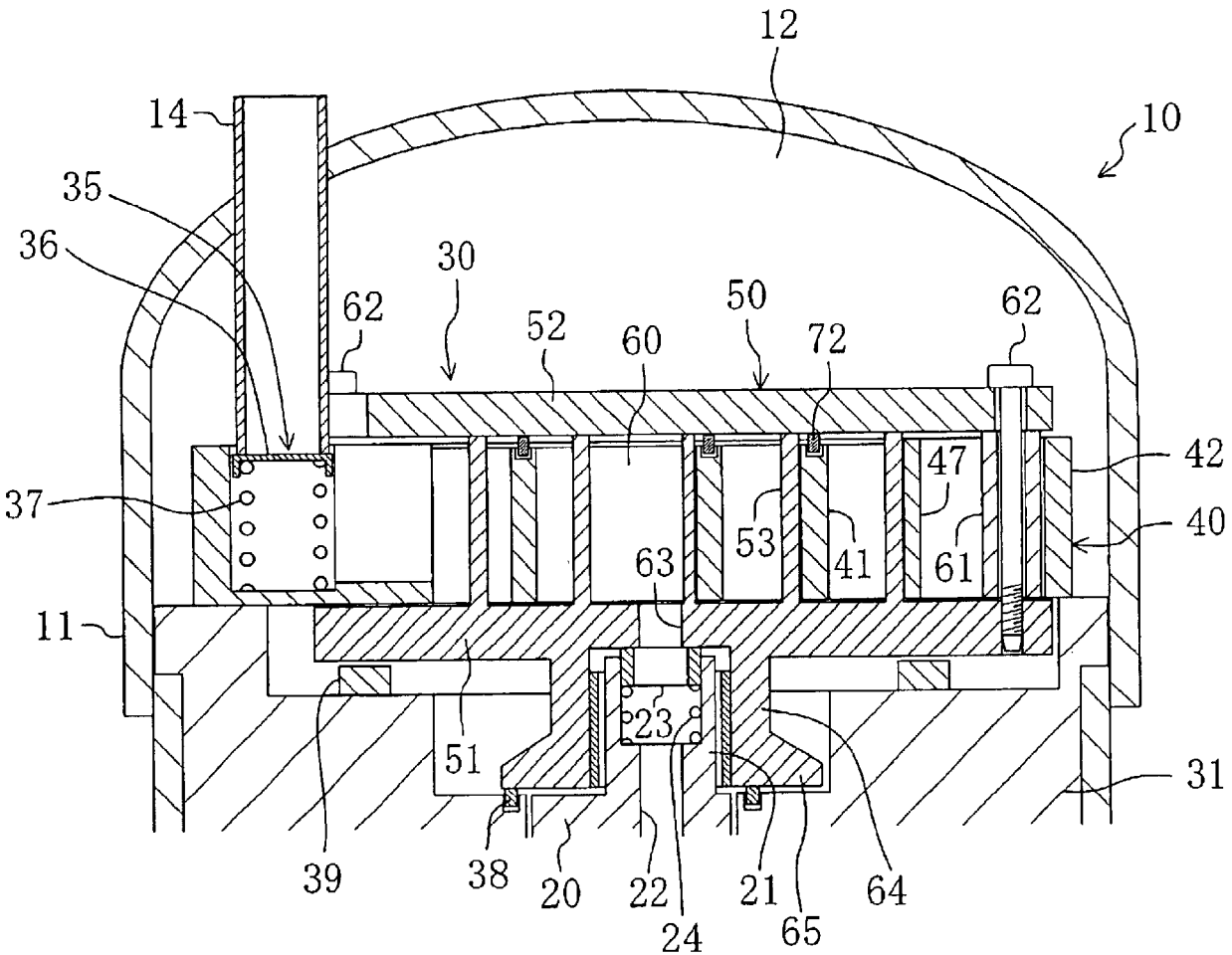
FIG. 14 is an enlarged cross-sectional view showing major parts of a scroll compressor in a fourth modification example of the first embodiment.

In other words, the height of the outer peripheral portion (42) may be made somewhat greater than the height of the stationary side wrap (41) (see FIG. 14). In the present modification example, the second flat plate (52) comes into sliding contact with the upper surface of the outer peripheral portion (42) even when the movable scroll (50) is positioned at the downmost position, thereby ensuring that a clearance is always secured between the upper tip of the stationary side wrap (41) and the second flat plate (52).

Consequently, the tip of the stationary side wrap (41) is prevented from suffering damage from forceful frictional contact with the second flat plate portion (52), even when the stationary side wrap (41) undergoes some deformation due to the inner pressure of the fluid chamber and heat. In addition, it is possible to avoid the increase in frictional resistance caused by contact of the stationary side wrap (41) with the second flat plate portion (52).

Furthermore, a tip seal (72) is mounted on the stationary side wrap (41) (see Figure 14). The tip seal (72) is provided at the upper tip of the stationary side wrap (41) and comes into sliding contact with the second flat plate (52). As described above, in the present modification example there is defined a gap between the tip of the stationary side wrap (41) and the second flat plate (52). This gap is sealed off by the tip seal (72).

Such provision of the tip seal (72) seals off, after securing a clearance between the stationary side wrap (41) and the second flat plate (52), a gap between the stationary side wrap (41) and the second flat plate (52). Accordingly, in accordance with the present modification example leakage of refrigerant through the gap between the stationary side wrap (41) and the second flat plate (52) is suppressed and the drop in the efficiency of the scroll compressor (10) is avoided, in addition to effects obtained by securing the clearance.

Fifth Modification Example of First Embodiment

In the scroll compressor (10) of the foregoing embodiment, the height of the stationary side wrap (41) is constant in the stationary scroll (40). However, instead of such an arrangement the following arrangement may be employed.

Figure 15:
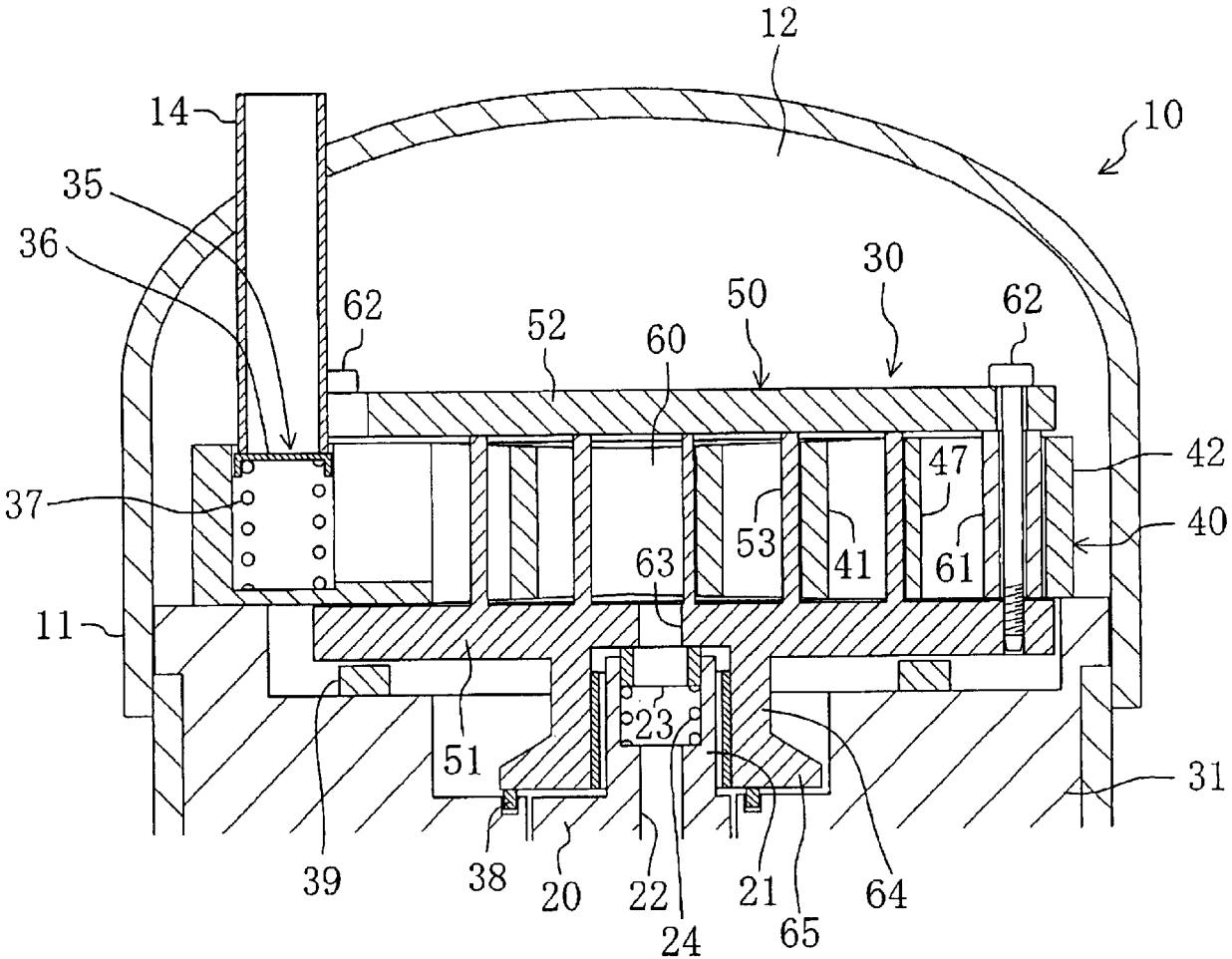
FIG. 15 is an enlarged cross-sectional view showing major parts of a scroll compressor in a fifth modification example of the first embodiment.

To sum up, as shown in FIG. 15, the height of the stationary side wrap (41) may become gradually smaller toward the center side from the outer peripheral side of the stationary side wrap (41). In the present modification example, the upper tip surface of the stationary side wrap

(41) is an inclined plane inclining downwardly toward the center side from the outer peripheral side of the stationary side wrap (41). On the other hand, the lower tip surface of the stationary side wrap (41) is an inclined plane inclining upwardly toward the center side from the outer peripheral side of the stationary side wrap (41). In addition, it may be arranged such that only the upper tip surface is inclined and the lower tip surface is made flat in stationary side wrap (41), or it may be arranged such that only the lower tip surface is inclined and the upper tip surface is made flat. Furthermore, even in the scroll compressor (10) of the present modification example the tip of the stationary side wrap (41) may be provided with a tip seal, as in the fourth modification example.

Here, the amount of deformation of the central side portion of the stationary side wrap (41) is likely to increase because the central side portion of the stationary side wrap (41) receives the inner pressure of the compression chamber (60) which is high and, at the same time, is exposed to a high temperature. By contrast to this, in accordance with the present modification example it is arranged such that the clearance between the tip of the stationary side wrap (41) and the first flat plate portion (51) and the clearance between the tip of the stationary side wrap (41) and the second flat plate portion (52) increase as closer to the central side of the stationary side wrap (41) prone to undergoing great deformation. Consequently, in accordance with the present modification example the stationary side wrap (41) will not become damaged from forceful frictional contact with the first flat plate (51) and the second flat plate (52). Further, the increase in frictional resistance by contact of the stationary side wrap (41) with the first flat plate (51) and the second flat plate (52) is avoidable.

Sixth Modification Example of First Embodiment

The scroll compressor (10) of the foregoing embodiment may employ the following arrangement. Differences between the foregoing embodiment and the present modification example will be clarified below.

Figure 16:
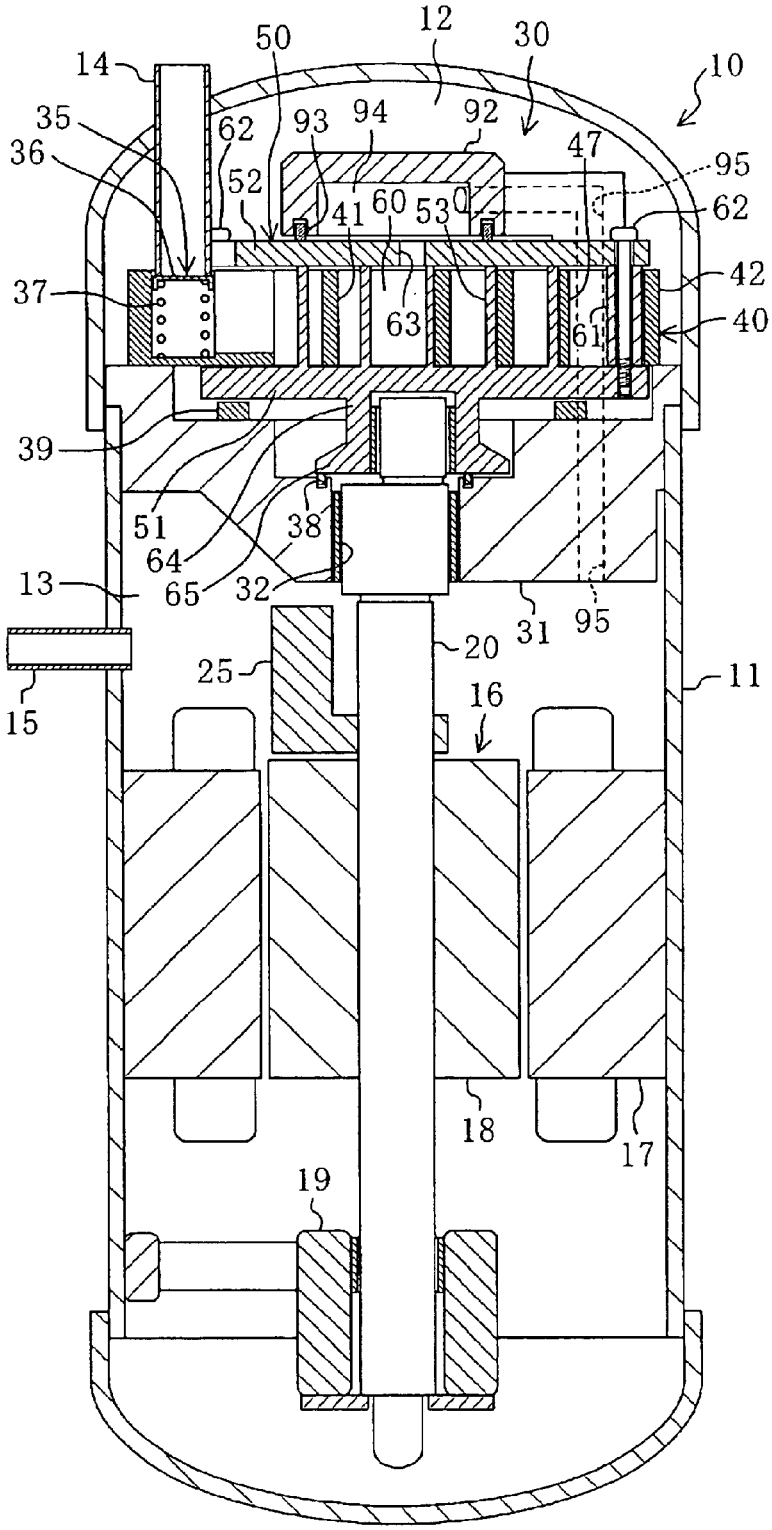
FIG. 16 is a schematic cross-sectional view showing a general arrangement of a scroll compressor in a sixth modification example of the first embodiment.

As shown in FIG. 16, in the movable scroll (50) of the present modification example the discharge opening (63) is formed in the second flat plate (52). Stated another way, the discharge opening (63) is formed not in the first flat plate (51) but in the second flat plate (52). The discharge opening (63) is formed centrally in the second flat plate (52) and passes therethrough.

In addition, the compression mechanism (30) of the present modification example is provided with a discharge passageway member (92) and a discharge passageway (95). In the scroll compressor (10) of the present modification example, the discharge passageway (22) is not formed in the driving shaft (20), and neither the tubular seal (23) nor the coil spring (24) is provided.

The discharge passageway member (92) is formed such that its dome-like portion covers the central portion of the second flat plate (52). The interior of the dome-like portion is a discharge pressure space (94). In addition, the discharge passageway member (92) is firmly secured, at a portion thereof extending laterally from the dome-like portion, to the housing (31), together with the stationary scroll (40). Provided between a lower end of the dome-like portion of the discharge passageway member (92) and the second flat plate (52) is a seal ring (93). The seal ring (93) slides against the second flat plate (52) of the movable scroll (50) and seals off a gap between the discharge passageway member (92) and the second flat plate (52).

The discharge passageway (95) is so formed as to extend from the discharge passageway member (92) to the housing (31) via the outer peripheral portion (42) of the stationary scroll (40). The discharge passageway (95) communicates, at its entrance end, with the discharge pressure space (94) and communicates, at its exist end, with the high pressure chamber (13) in the inside of the casing (11).

Refrigerant, which has been compressed in the compression mechanism (30), passes through the discharge opening (63) and flows into the discharge pressure space (94). The high-pressure refrigerant in the discharge pressure space (94) passes through the discharge passageway (95) and flows into the high pressure chamber (13). Thereafter, the high-pressure refrigerant in the high pressure chamber (13) passes through the discharge port (15) and is delivered to outside the casing (11).

Seventh Modification Example of First Embodiment

The scroll compressor (10) of the foregoing embodiment may employ the following arrangement. Differences between the foregoing embodiment and the present modification example will be clarified below.

Figure 17:
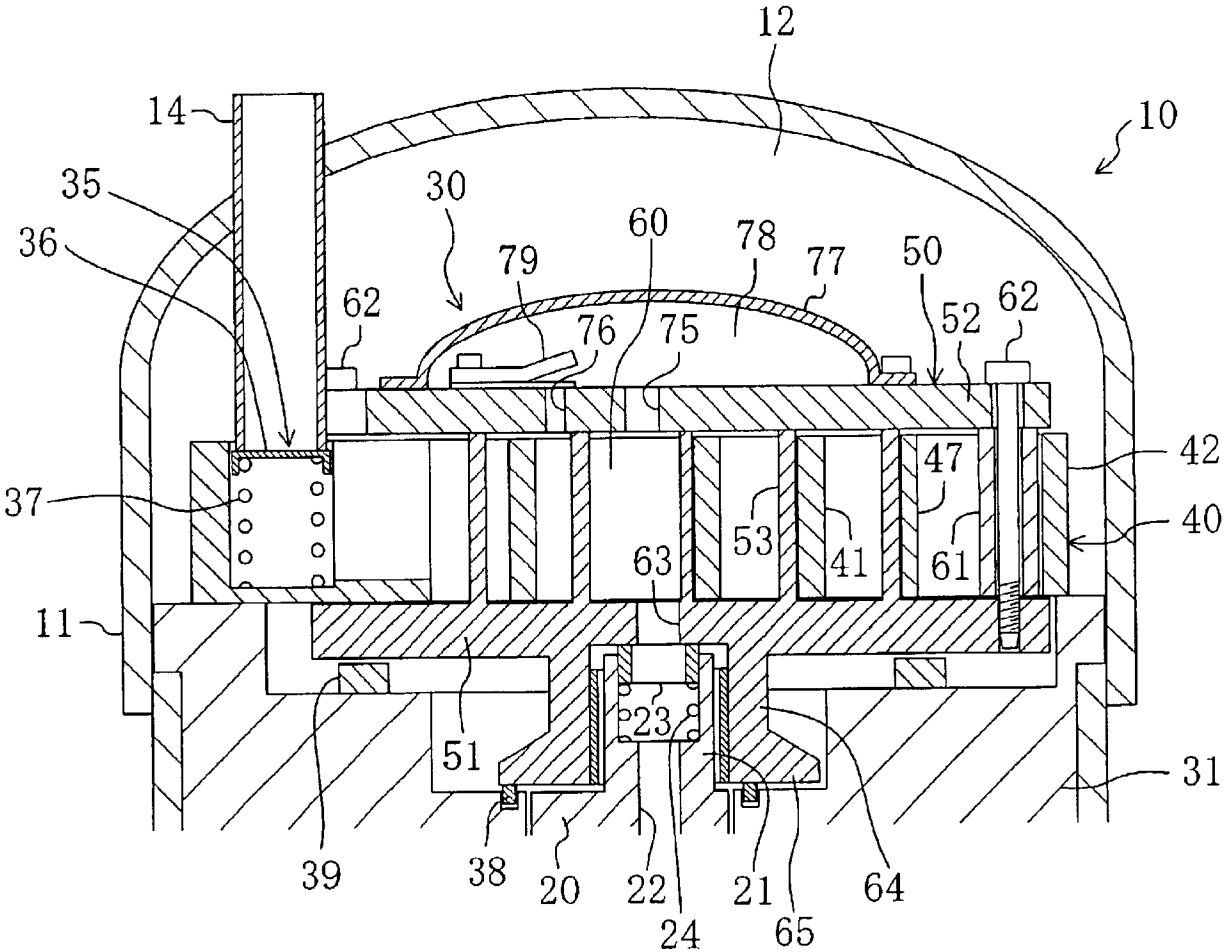
FIG. 17 is an enlarged cross-sectional view showing major parts of a scroll compressor in a seventh modification example of the first embodiment.

As shown in FIG. 17, in the movable scroll (50) of the present modification example the second flat plate (52) is provided with a communication aperture (75) and an intermediate discharge aperture (76). The communication aperture (75) is located face to face with the discharge opening (63) of the first flat plate (51) and passes through the second flat plate (52). The intermediate discharge aperture (76) is located nearer to the outer periphery of the second flat plate (52) than the communication aperture (75) and passes through the second flat plate (52).

Additionally, a dome-like cover member (77) is mounted on the back surface of the second flat plate (52) (the upper one in FIG. 17). The cover member (77) is attached in such a way that it covers the communication aperture (75) and intermediate discharge aperture (76) of the second flat plate (52). A discharge muffler space (78) is comparted by the cover member (77) and the second flat plate (52). The discharge muffler space (78) is made communicable with the compression chamber (60) through the communication aperture (75) and the intermediate discharge aperture (76).

Further, a relief valve (79) is mounted on the back surface of the second flat plate (52). The relief valve (79) is a so-called reed valve and is so disposed as to block off the intermediate discharge aperture (76). The relief valve (79) opens only when the inner pressure of the compression chamber (60) becomes higher than the inner pressure of the discharge muffler space (78), thereby causing the intermediate discharge aperture (76) to open.

In a commonly used scroll compressor, its compression ratio is constant and does not vary. On the other hand, where a refrigerating cycle is executed by circulation of a refrigerant in a refrigerant circuit, the ratio of high pressure and low pressure in the refrigerating cycle varies depending on the operating condition. Consequently, if the compression ratio of the scroll compressor exceeds the high pressure/low pressure ratio of the refrigerating cycle, this will cause the scroll compressor to compress the refrigerant to a more-than-necessary level.

By contrast to the above, in accordance with the present modification example, such an overpressure phenomenon is avoidable. In other words, in such a state that the compression ratio of the scroll compressor (10) is greater than the high pressure/low pressure ratio of the refrigerating cycle, the inner pressure of the compression chamber (60) will have reached the high pressure of the refrigerating cycle in the middle of a compression stroke. Consequently, the relief valve (79) is pushed and brought into the open state, and a part of the refrigerant in the inside of the compression chamber (60) passes through the intermediate discharge aperture (76) and flows into the discharge muffler space (78).

Only the remaining refrigerant is compressed in the compression chamber (60). Consequently, even in such a state that the compression chamber (60) is communicating with the discharge opening (63), the refrigerant pressure will not increase more than necessary. On the other hand, the refrigerant, which has flowed into the discharge muffler space (78) in the middle of the compression stroke, passes through the communication aperture (75) and merges into the refrigerant in the inside of the compression chamber (60), thereafter flowing into the discharge passageway (22) through the discharge opening (63). As just described, in the scroll compressor (10) of the present modification example its compression ratio is automatically controlled depending upon the operating condition of the refrigerating cycle.

Eighth Modification Example of First Embodiment

The scroll compressor (10) of the foregoing embodiment employs such an arrangement that the interior of the casing (11) is divided into the low pressure chamber (12) and the high pressure chamber (13). Instead of such an arrangement, the scroll compressor (10) may employ a construction (a low pressure dome construction) in which the whole interior of the casing (11) is placed in a low pressure (suction pressure) state. Differences between the foregoing embodiment and the present modification example will be clarified below.

Figure 18:
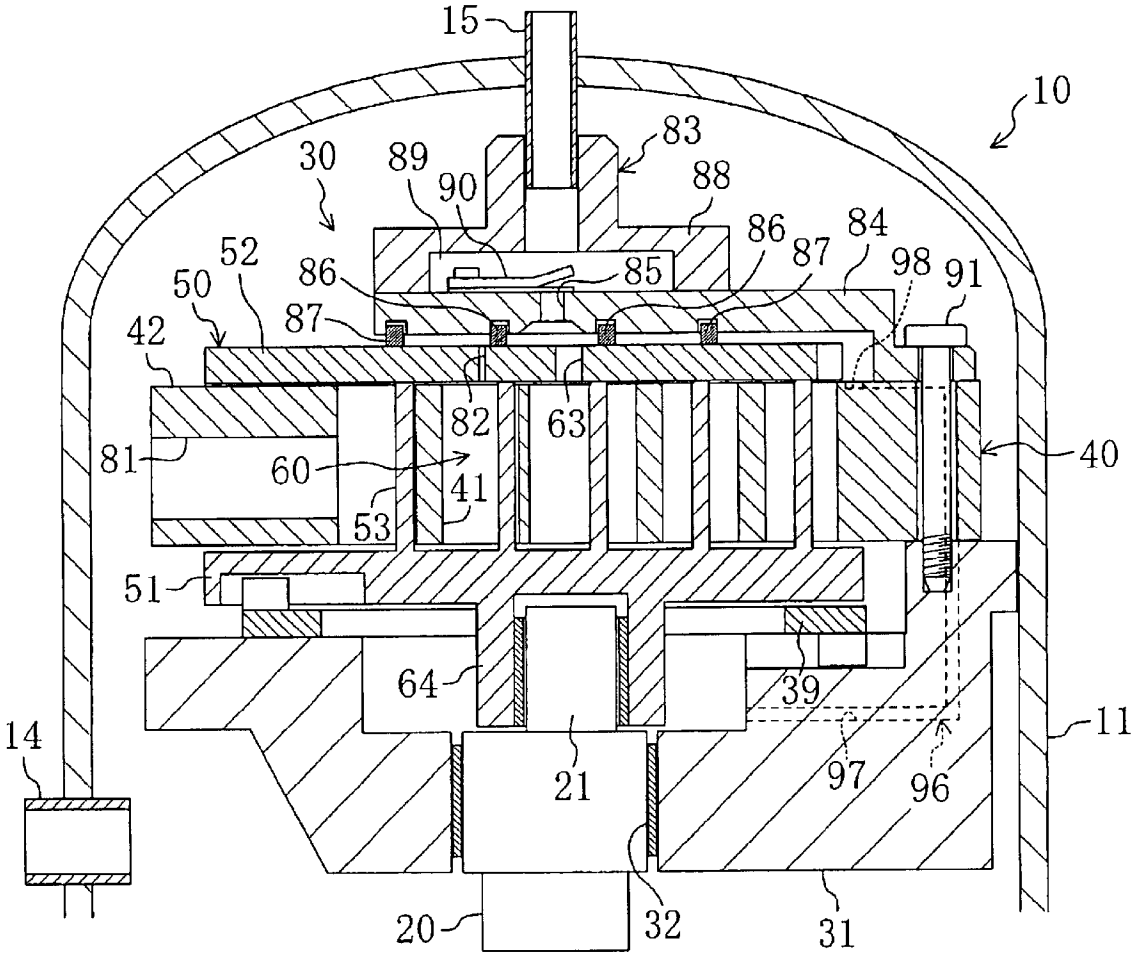
FIG. 18 is an enlarged cross-sectional view showing major parts of a scroll compressor in an eighth modification example of the first embodiment.

As shown in FIG. 18, in the scroll compressor (10) of the present modification example the suction port (14) is attached to a trunk portion of the casing (11). Additionally, the stationary scroll (40) is provided with a suction opening (81). The suction opening (81) is so formed as to pass through the outer peripheral portion (42) in the lateral direction, thereby bringing the internal space of the casing (11) and the compression chamber (60) into communication with each other. In addition, the bearing portion (64) of the present modification example is formed into a simple tubular shape and the collar portion (65) is omitted.

In the movable scroll (50) of the present modification example, the second flat plate (52) is provided with a discharge opening (63) and an intermediate pressure introduction aperture (82). In other words, the discharge opening (63) is formed not in the first flat plate (51) but in the second flat plate (52). The discharge opening (63) is formed centrally in the second flat plate (52) and passes through the second flat plate (52). The intermediate pressure introduction aperture (82) is located nearer to the outer periphery of the second flat plate (52) than the discharge opening (63) and passes through the second flat plate (52).

The compression mechanism (30) of the present modification example is provided with a lead-out member (83) for high pressure refrigerant. The lead-out member (83) is provided with a flat plate-like member (84) and a cap-like member (88).

The flat plate-like member (84) is shaped like a flat plate and is so disposed as to provide a covering over the second flat plate (52). The flat plate-like member (84) is secured firmly to the housing (31) by a bolt (91), together with the stationary scroll (40). In the flat plate-like member (84), a communication aperture (85) is provided above the discharge opening (63) of the second flat plate (52). The communication aperture (85) is so formed as to pass through the flat plate-like member (84).

Provided between the flat plate-like member (84) and the second flat plate (52) are an inner seal ring (86) and an outer seal ring (87). The inner and outer seal rings (86) and (87) are disposed concentrically on the communication aperture (85) and are in sliding contact with the second flat plate (52) of the movable scroll (50) in orbital motion. In addition, the inner seal ring (86) and the outer seal ring (87) are so formed as to have their respective diameters. Even when the movable scroll (50) executes an orbital motion, the discharge opening (63) of the second flat plate (52) communicates constantly with a space inside the inner seal ring (86) whereas the intermediate pressure introduction aperture (82) communicates constantly with a space defined between the inner seal ring (86) and the outer seal ring (87).

The cap-like member (88) is mounted on an upper surface of the flat plate-like member (84). In such a state, a discharge pressure space (89) is comparted between the cap-like member (88) and the flat plate-like member (84). The communication aperture (85) of the flat plate-like member (84) opens to the discharge pressure space (89). In addition, one end of the discharge port (15) formed into a tubular shape is inserted into an upper end of the cap-like member (88). The discharge port (15) is so formed as to pass through an upper end portion of the casing (11).

Housed in the discharge pressure space (89) is a discharge valve (90). The discharge valve (90) is a so-called reed valve and is attached firmly to the upper surface of the flat plate-like member (84). Additionally, the discharge valve (90) is so disposed as to block off the communication aperture (85).

Further, the compression mechanism (30) of the present modification example is provided with a lubrication passageway (96). The lubrication passageway (96) is made up of a tubular passageway (97) and a groove-like passageway (98). Refrigerating machine oil is supplied to between the lower surface of the second flat plate (52) and the upper surface of the outer peripheral portion (42) through the lubrication passageway (96).

More specifically, the tubular passageway (97) is so formed as to extend from the housing (31) to the outer peripheral portion (42) of the stationary scroll (40). In addition, one end of the tubular passageway (97) opens above the main bearing (32) of the housing (31) whereas the other end opens at the upper surface of the outer peripheral portion (42) of the stationary scroll (40). On the other hand, the groove-like passageway (98) is formed by digging down into the upper surface of the outer peripheral portion (42) of the stationary scroll (40). The groove-like passageway (98) extends from the upper end of the tubular passageway (97) toward the inside of the outer peripheral portion (42) and extends along the inner periphery of the outer peripheral portion (42) in the form of an arc.

The running operation of the scroll compressor (10) of the present modification example will be described. Refrigerant at low pressure, which has flowed into the inside of the casing (11) through the suction port (14), passes through the suction opening (81) and is drawn into the compression chamber (60). The compressed, high pressure refrigerant flows out of the compression chamber (60) through the discharge opening (63), presses open the discharge valve (90), and flows into the discharge pressure space (89) from the communication aperture (85). Thereafter, the high pressure refrigerant passes through the discharge port (15) and is discharged out of the casing (11).

In the scroll compressor (10), the pressure of the inside of the inner seal ring (86) in communication with the discharge opening (63) is at the same level as the discharge pressure. On the other hand, the inner pressure of a space defined between the inner seal ring (86) and the outer seal ring (87) in communication with the intermediate pressure introduction aperture (82) is at an intermediate pressure level higher than the suction pressure but lower than the high pressure.

Consequently, in comparison with a case in which only a single seal ring is provided, it is possible to reduce, to a further extent, the difference between the inner and outer pressures of each of the inner and outer seal rings (86) and (87), thereby ensuring that the occurrence of leakage of high pressure refrigerant is prevented.

Additionally, in the inside of each of the inner and outer seal rings (86) and (87) the back pressure of the second flat plate (52) is higher than the suction pressure. Consequently, a force depressing the movable scroll (50) acts on the movable scroll (50). In other words, the second flat plate (52) of the movable scroll (50) is pressed against the upper surface of the stationary scroll (40). Inclination of the movable scroll (50) during revolutions thereof is controlled by application of such a depressing force to the movable scroll (50). In addition, although the second flat plate (52) is pressed against the upper surface of the outer peripheral portion (42), sliding portions of the both are lubricated with refrigerating machine oil supplied through the lubrication passageway (96).

Figure 19:
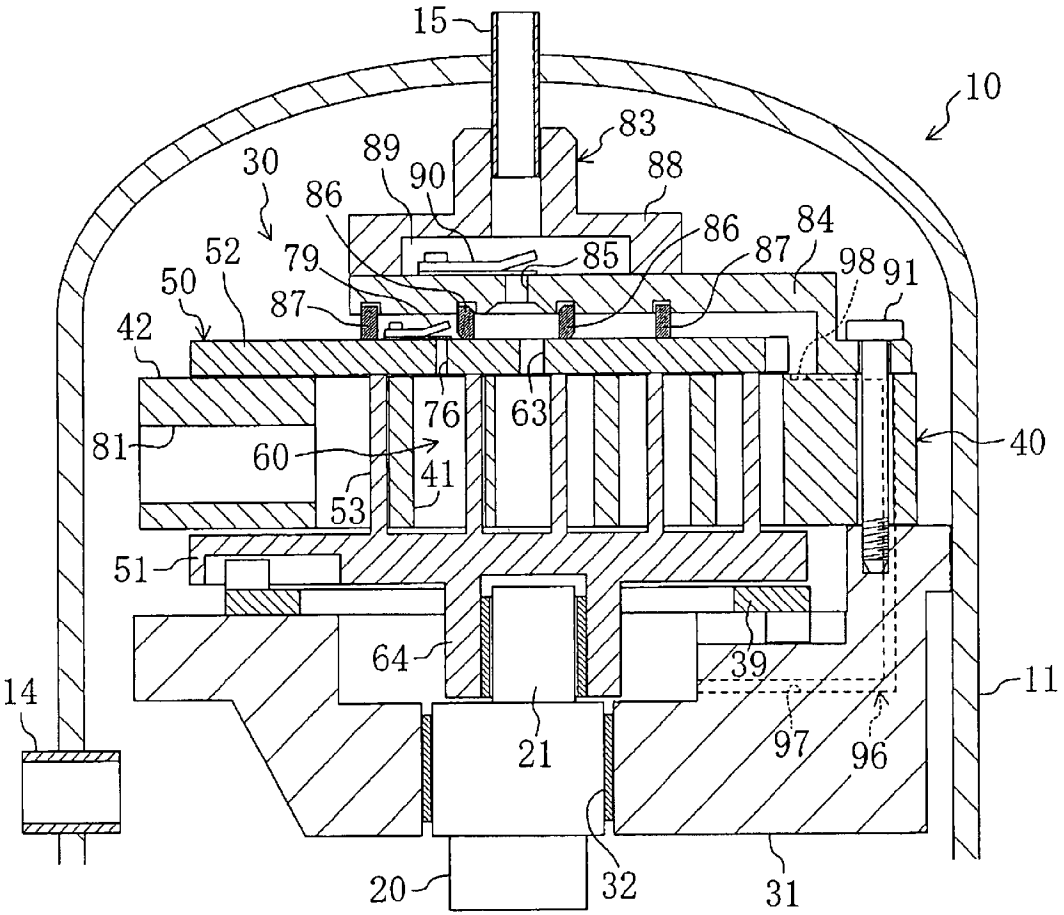
FIG. 19 is an enlarged cross-sectional view showing major parts of the scroll compressor in the eighth modification example of the first embodiment.

The scroll compressor (10) of the present modification example may employ the same arrangement as the seventh modification example capable of compression ratio control. When employing such an arrangement, the intermediate discharge aperture (76) of a largish diameter is formed in the second flat plate (52) at the same position as the intermediate pressure introduction aperture (82), as shown in FIG. 19. Furthermore, the relief valve (79) is mounted on the second flat plate (52) so that the intermediate discharge aperture (76) is blocked off. The construction of the relief valve (79) is the same as the one described in the seventh modification example. Further, the inner seal ring (86) is chamfered at two points. More specifically, in the inner seal ring (86) its upper inside corner and lower outside corner are chamfered.

In the scroll compressor (10) shown in FIG. 19, when the inner pressure of the compression chamber (60) reaches a refrigerating cycle high pressure in the middle of a compression stroke, the inner pressure of the compression chamber (60) presses open the relief valve (79). In this state, the refrigerant in the inside of the compression chamber (60), after passing through the intermediate discharge aperture (76), flows into a space between the inner seal ring (86) and the outer seal ring (87). When the pressure of the outside of the inner seal ring (86) becomes higher than the pressure of the inside of the inner seal ring (86), the inner seal ring (86) is lifted by a gas pressure acting on the lower end of the inner seal ring (86). And, refrigerant flows toward the inside from the outside of the inner seal ring (86). This refrigerant is delivered, together with refrigerant from the discharge opening (63), to the discharge port (15). On the other hand, when the pressure of the outside of the inner seal ring (86) is lower than the pressure of the inside of the inner seal ring (86), the inner seal ring (86) is pressed against the second flat plate (52) by a gas pressure acting on the upper end of the inner seal ring (86).

Ninth Modification Example of First Embodiment

The movable scroll (50) of the scroll compressor (10) in the foregoing embodiment is generally made of cast iron. In this case, it may be arranged such that the sliding surface (the lower one in FIG. 2) of the second flat plate (52) with respect to the stationary side wrap (41) undergoes treatment such as high-frequency induction hardening, nitriding, plating, and phosphate coating for enhancing resistance to seizing, resistance to abrasion et. cetera. There are cases where it is difficult to supply refrigerating machine oil for lubrication particularly to where the second flat plate (52) slides against the stationary side wrap (41). Accordingly, the sliding surface of the second flat plate (52) preferably undergoes such treatment.

Tenth Modification Example of First Embodiment

The movable scroll (50) of the scroll compressor (10) in the foregoing embodiment may be made of light alloy such as aluminum alloy et cetera.

That is to say, unlike a scroll compressor having a commonly used construction, the movable scroll (50) of the scroll compressor (10) of the foregoing embodiment is provided with both the first flat plate (51) and the second flat plate (52). Consequently, in comparison with commonly used scroll compressors the mass of the movable scroll (50) increases, thereby producing the possibility that the magnitude of load acting on the bearing portion (64) and the eccentric portion (21) of the driving shaft (20) increases.

By contrast to the above, if the movable scroll (50) is made of light alloy, this makes it possible to reduce the weight of the movable scroll (50) in comparison with a case where the movable scroll (50) is made of cast iron. Consequently, it is possible to suppress the increase in load that acts on the bearing portion (64) and on the eccentric portion (21) of the driving shaft (20) even when the movable scroll (50) is provided with both the first flat plate (51) and the second flat plate (52).

Additionally, it may be arranged such that the first flat plate (51) and the movable scroll (50) are made of cast iron while on the other hand only the second flat plate (52) is made of light alloy. In the movable scroll (50), the second flat plate (52) is disposed at a position vertically farthest from the bearing portion (64) (see FIG. 2). Consequently, moments which try to incline the movable scroll (50) is reduced considerably even when only the second flat plate (52) is made of light alloy for weight saving.

Eleventh Modification Example of First Embodiment

In the scroll compressor (10) of the foregoing embodiment, the support post member (61) which is formed as a separate body from the first flat plate (51) constitutes a support post part. Instead of such arrangement, the support post part may be formed integrally with the first flat plate (51). Additionally, in such a case an internal thread is formed in the support post port and the internal thread is brought into mating engagement with the bolt (62) so that the first flat plate (51) and the second flat plate (52) are connected together.

Twelfth Modification Example of First Embodiment

In the scroll compressor (10) of the foregoing embodiment, it may be arranged such that a sealant is sandwiched between the movable side wrap (53) and the second flat plate (52) in the movable scroll (50). As such a sealant, a rubber member or a gasket-like member may be used.

If the flatness of the tip surface of the movable side wrap (53) and the flatness of the lower surface of the second flat plate (52) are inadequate, this gives rise to the possibility that there is created a gap between the movable side wrap (53) and the second flat plate (52), even when the bolt (62) is tightened. By contrast to this, for the case of the present modification example in which a sealant is sandwiched between the movable side wrap (53) and the second flat plate (52), it is possible to seal off a gap created between the movable side wrap (53) and the second flat plate (52) without having to finish the tip surface of the movable side wrap (53) and the lower surface of the second flat plate (52) with a high degree of accuracy. Accordingly, in accordance with the present modification example leakage of refrigerant through a gap between the movable side wrap (53) and the second flat plate (52) is prevented without performing high accuracy machining on the movable side wrap (53) and the second flat plate (52).

Second Embodiment of Invention

A second embodiment of the present invention is an embodiment in which the stationary and movable scrolls (40) and (50) of the first embodiment are modified in construction. Differences between the scroll compressor (10) of the first embodiment and the scroll compressor (10) of the second embodiment will be clarified below.

Figure 20:
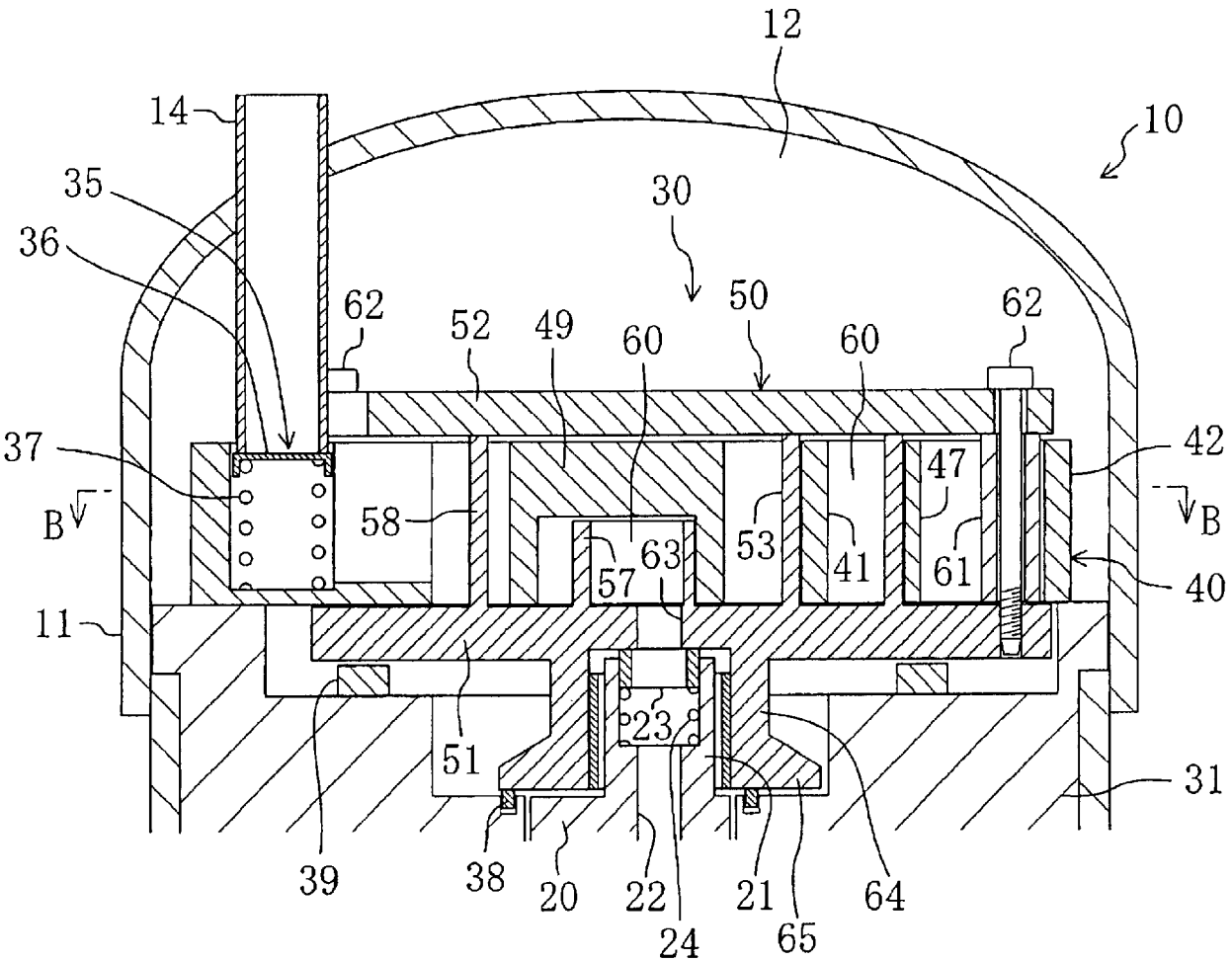
FIG. 20 is an enlarged cross-sectional view showing major parts of a scroll compressor in a second embodiment of the present invention.
Figure 21:
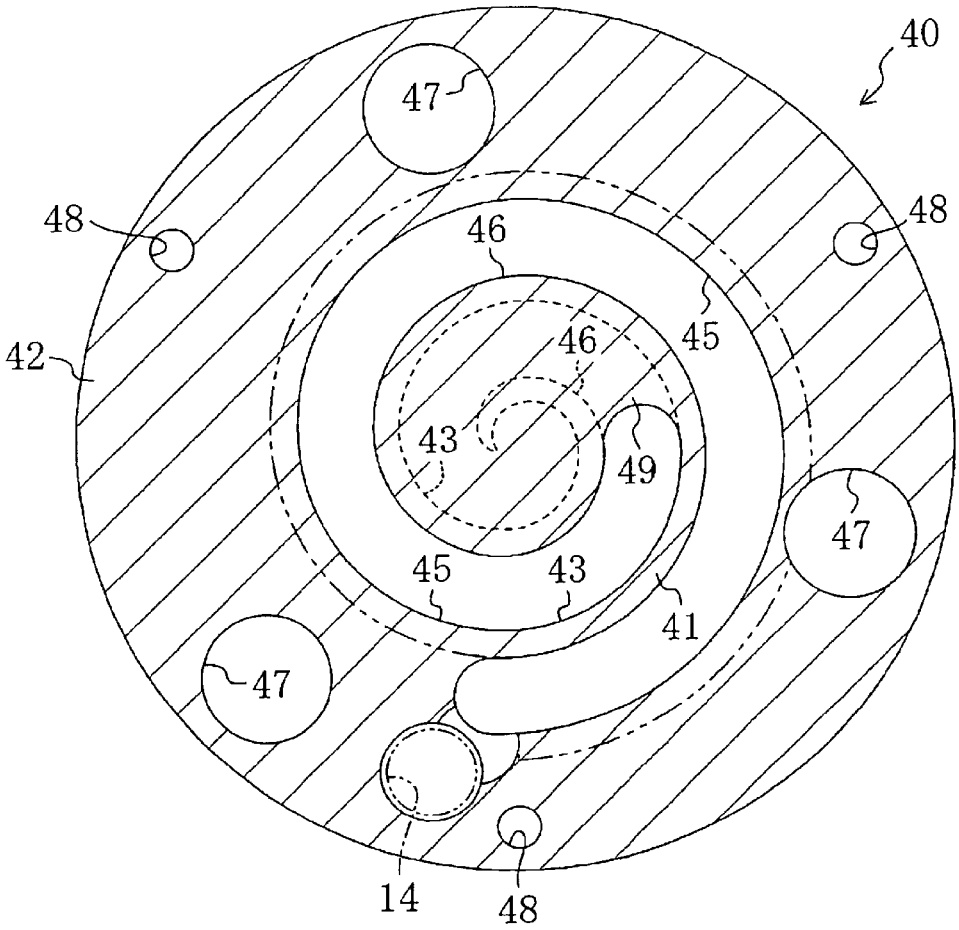
FIG. 21 is a cross-sectional view showing a stationary scroll in the second embodiment.

As shown in FIGS. 20 and 21, the stationary scroll (40) of the present embodiment is provided with a planar surface forming portion (49). FIG. 21 diagrams only the stationary scroll (40) and shows a cross-sectional view in a B—B cross-section of FIG. 20.

The planar surface forming portion (49) is so formed as to fill up a gap between the opposing, stationary side wrap surfaces (45) and (46) in an area extending from a central side end portion of the stationary side wrap (41) for a length of about 1½ turns. Additionally, the planar surface forming portion (49) is such formed that its lower surface is a planar surface. The lower surface of the planar surface forming portion (49) is located at a height of about half of the height of the stationary side wrap (41).

Figure 22:
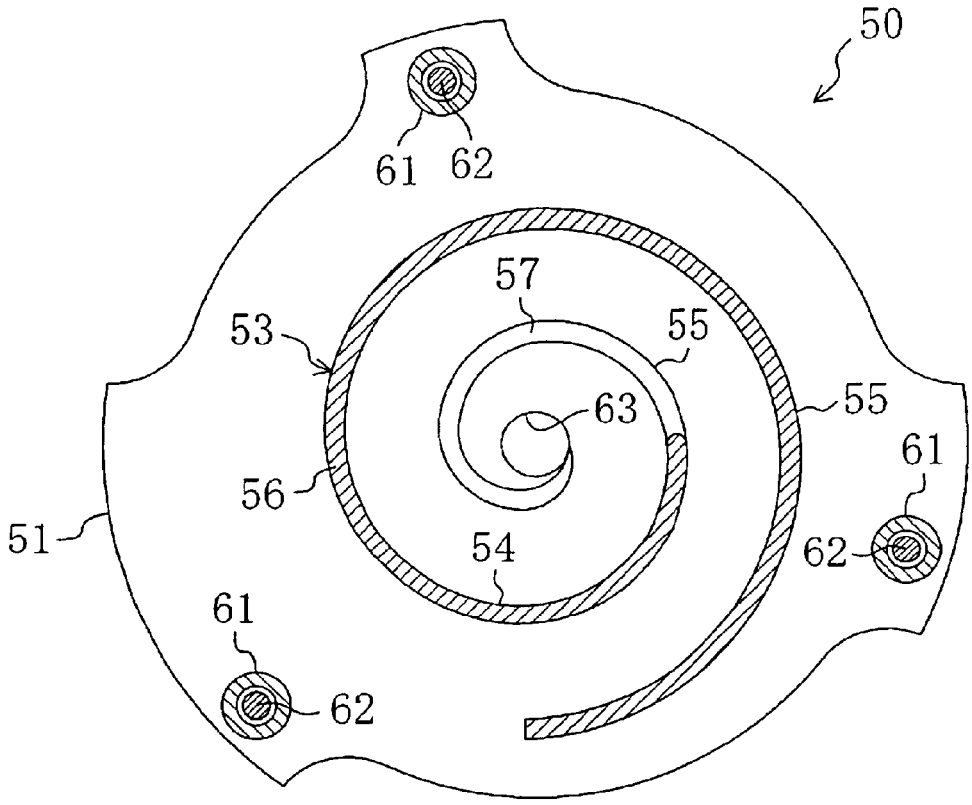
FIG. 22 is a cross-sectional view showing a movable scroll in the second embodiment.

As shown in FIGS. 20 and 22, a part of the movable side wrap (53) of the present embodiment constitutes a low wall portion (57) whereas the remaining part thereof constitutes a normal wall portion (56). FIG. 22 diagrams only the movable scroll (50) and shows a cross-sectional view in a B—B cross-section of FIG. 20.

More specifically, a portion of the movable side wrap (53) extending from its central side end portion for a length of about a turn constitutes the low wall portion (57) and the remaining portion constitutes the normal wall portion (56). The height of the low wall portion (57) is about half of that of the normal wall portion (56). The normal wall portion (56) has the same height as the movable side wrap (53) of the first embodiment.

As just stated above, the movable side wrap (53) of the present embodiment is formed in a stair case pattern so that its height is lowered one step from the outer peripheral side toward the central side. The tip of the low wall portion (57) in the movable side wrap (53) comes into sliding contact with the lower surface of the planar surface forming portion (49).

Figure 23:
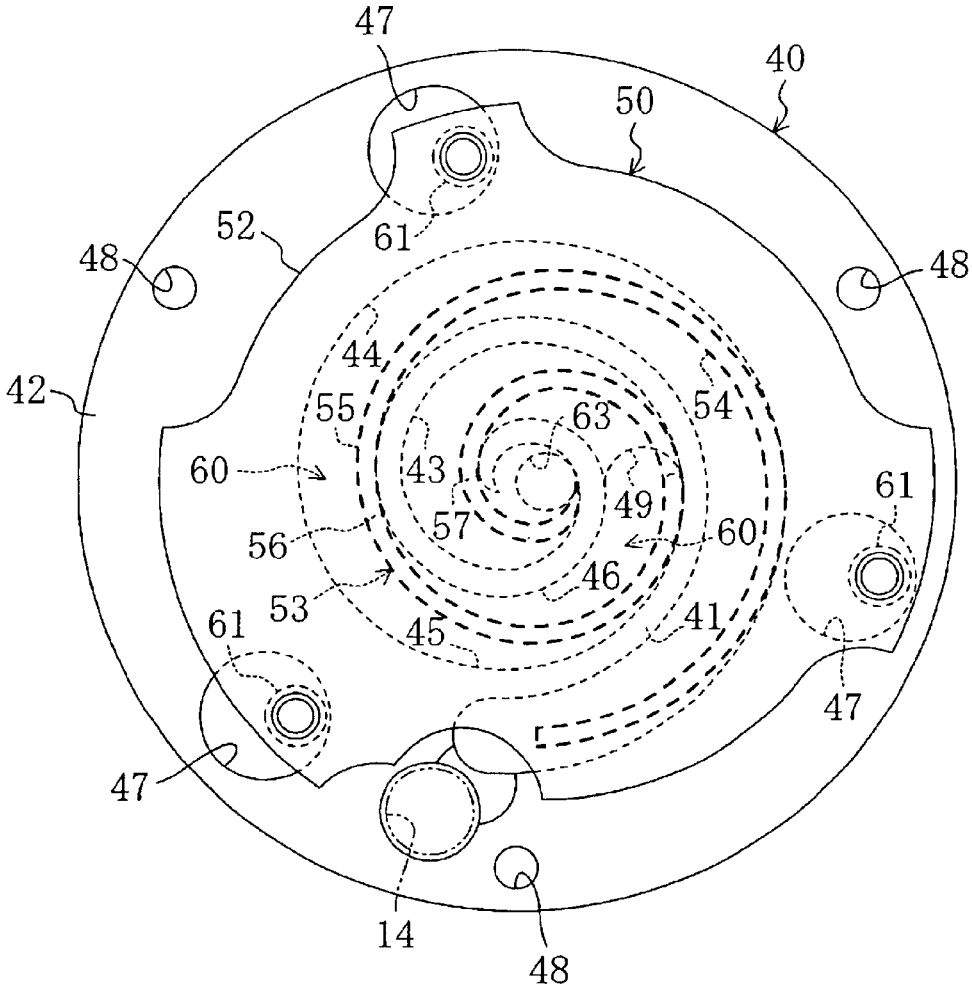
FIG. 23 is a top plan view showing the stationary scroll and the movable scroll in the second embodiment.

As shown also in FIG. 23, in the scroll compressor (10) of the present embodiment the stationary side wrap (41) of the stationary scroll (40) and the movable side wrap (53) of the movable scroll (50) are engaged matingly with each other. This is the same as the first embodiment. In addition, FIG. 23 shows both the stationary scroll (40) and the movable scroll (50) and is a top plan view in which the stationary scroll (40) and the movable scroll (50) are interlocked together.

In the scroll compressor (10) of the present embodiment, the normal wall portion (56) of the movable side wrap (53), together with the first flat plate (51), the second flat plate (52), and the stationary side wrap (41), forms the compression chamber (60) (see FIG. 20). Furthermore, the low wall portion (57) of the movable side wrap (53), together with the first flat plate (51), the planar surface forming portion (49), and the stationary side wrap (41), forms the compression chamber (60).

As just stated above, in the scroll compressor (10) of the present embodiment the compression chamber (60) is formed also by the planar surface forming portion (49) and the low wall portion (57) of the movable side wrap (53). The minimum volume of the compression chamber (60) whose volume varies with the revolution of the movable scroll (50) decreases in comparison with a case where the height of the movable side wrap (53) is constant over its whole length. Consequently, in accordance with the present embodiment it becomes possible to reduce the number of turns of the stationary side wrap (41) and the number of turns of the movable side wrap (53) while at the same time securing a necessary compression ratio (which is the ratio of the maximum volume to the minimum volume of the compression chamber (60)), thereby downsizing the stationary scroll (40) and the movable scroll (50).

The above will be described. If, in a scroll compressor in which the height of a stationary side wrap and the height of a movable side wrap are constant, the number of turns of each wrap is reduced, the compression ratio decreases with such reduction. The reason is that, if the height of each wrap is increased in order to keep the maximum volume of the compression chamber constant, this increases the minimum volume of the compression chamber with such increase in height.

By contrast to the above, in the scroll compressor (10) of the present embodiment the movable side wrap (53) is provided with the low wall portion (57) and the normal wall portion (56). Consequently, even when the number of turns of each of the stationary side wrap (41) and the movable side wrap (53) is reduced and the height of the normal wall portion (56) is increased in order to keep the maximum volume of the compression chamber (60) constant, the minimum volume of the compression chamber (60) will not vary unless the height of the low wall portion (57) is varied. Accordingly, in accordance with the present embodiment the number of turns of each of the stationary side wrap (41) and the movable side wrap (53) can be reduced without a drop in the compression ratio of the scroll compressor (10).

In the stationary scroll (40) of the present embodiment, the stationary side wrap (41) projects in the form of a cantilevered beam toward the inside of the outer peripheral portion (42), so that its central side portion is likely to undergo a great amount of deformation.

By contrast to the above, in the scroll compressor (10) of the present embodiment, as described above, the length of the stationary side wrap (41) can be reduced without influencing the compression ratio of the scroll compressor (10). Accordingly, in accordance with the present embodiment the rigidity of the stationary side wrap (41) is secured by reducing the length of the stationary side wrap (41), and the amount of deformation of the stationary side wrap (41) is reduced. Further, in the present embodiment the planar surface forming portion (49) is such formed that it crosses a central side portion of the stationary side wrap (41). Consequently, the provision of the planar surface forming portion (49) enhances the rigidity of the central side portion of the stationary side wrap (41), thereby reducing the amount of deformation of the stationary side wrap (41) to a further extent. Accordingly, in accordance with the present embodiment the stationary side wrap (41) is prevented from being in excessive friction with the movable side wrap (53) or the like even when undergoing deformations and the reliability of the scroll compressor (10) is improved by preventing the stationary side wrap (41) and others from becoming damaged.

Third Embodiment

A third embodiment of the present invention is an embodiment in which the compression mechanism (30) of the first embodiment is modified in construction. Differences between the scroll compressor (10) of the first embodiment and the scroll compressor (10) of the present embodiment will be described below.

Figure 24:
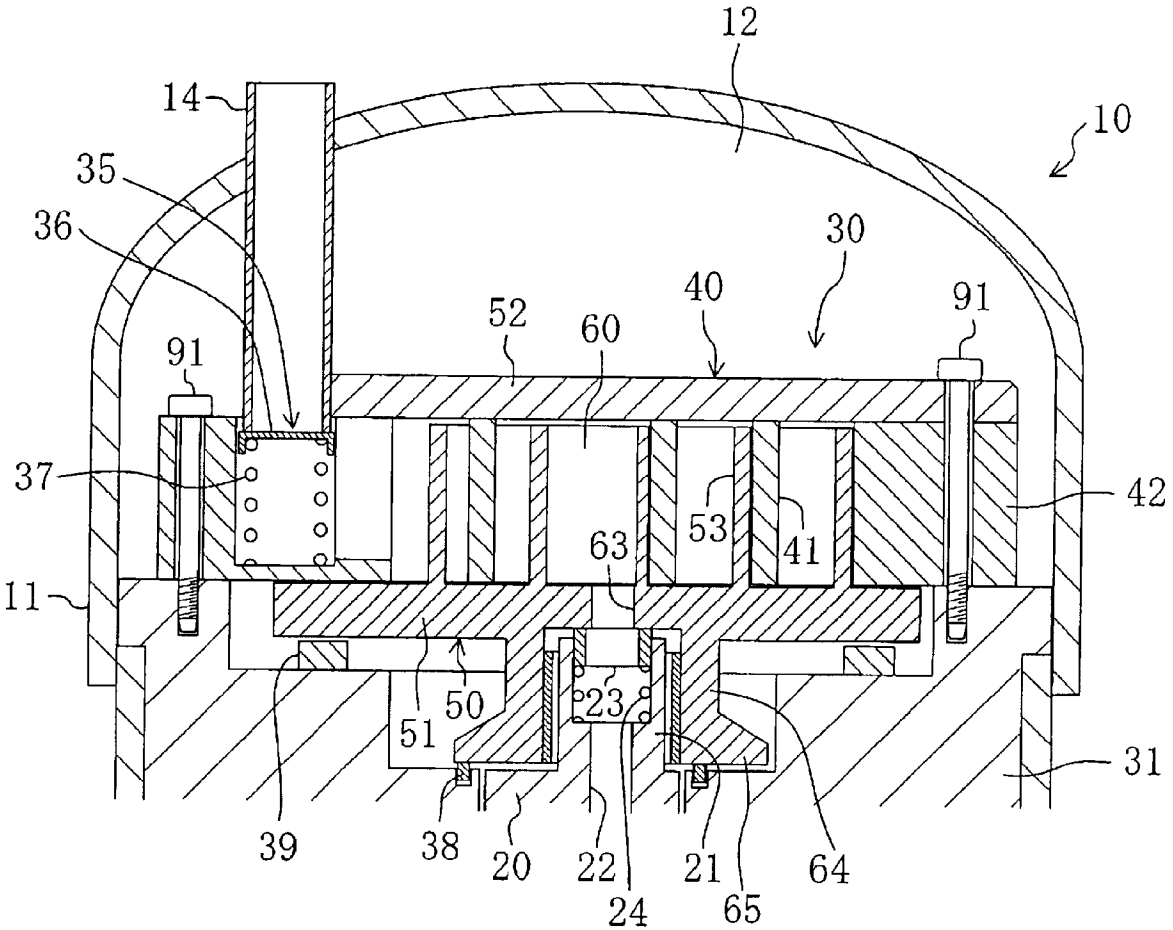
FIG. 24 is an enlarged cross-sectional view showing major parts of a scroll compressor in a third embodiment of the present invention.
Figure 25:
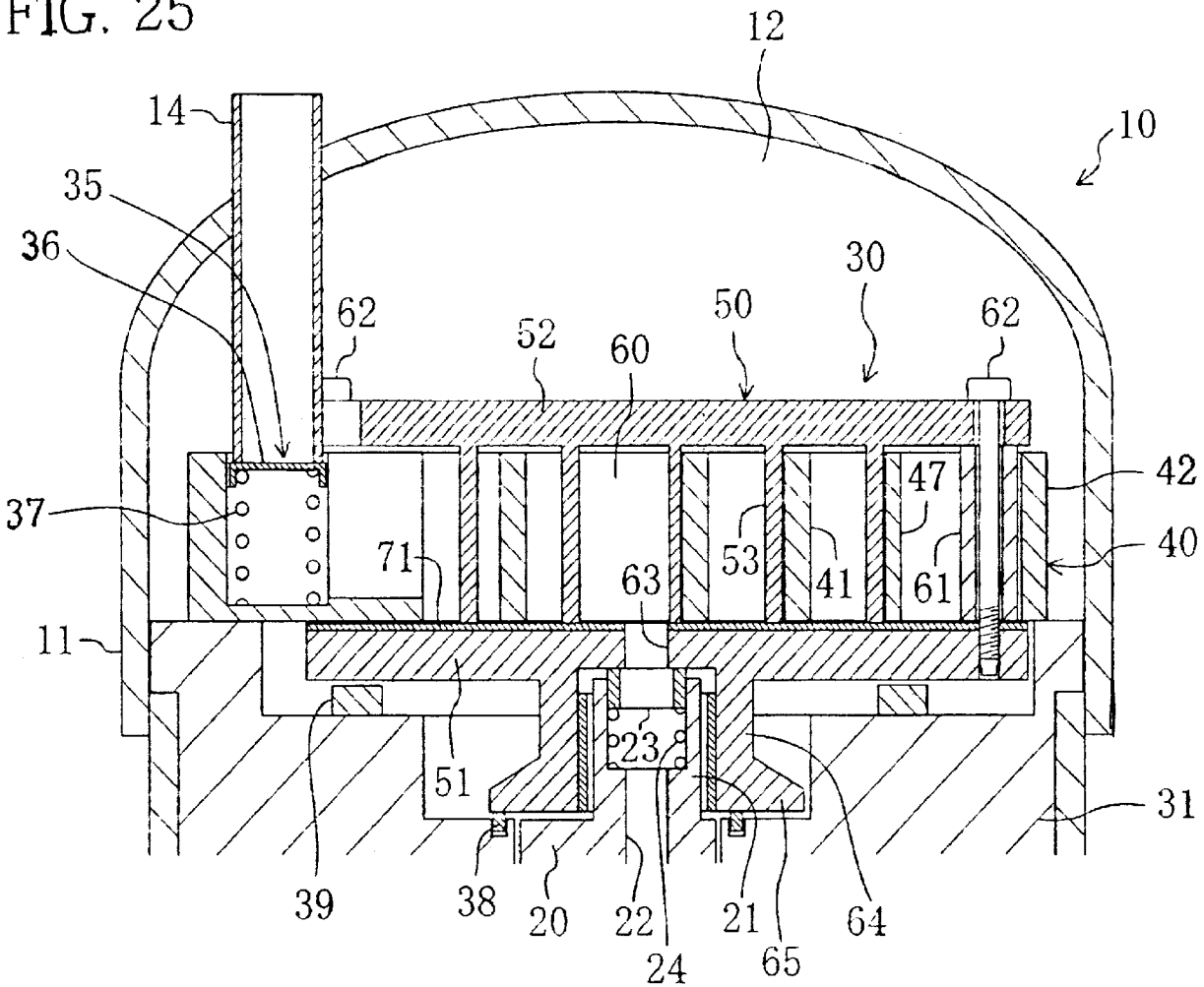
FIG. 25 is an enlarged cross-sectional view showing major parts of the scroll compressor of the second modification example of the first embodiment.

As shown in FIG. 24, in the compression mechanism (30) of the present embodiment the second flat plate (52) is mounted not on the movable scroll (50) but on the stationary scroll (40). More specifically, the second flat plate (52) is placed on the stationary side wrap (41) and the outer peripheral portion (42) and is attached firmly to the housing (31) by the bolt (91), together with the outer peripheral portion (42). In addition, in the stationary scroll (40) the insertion aperture (47) is not formed in the outer peripheral portion (42).

Further, in the compression mechanism (30) of the present embodiment the movable scroll (50) is made up of the first flat plate (51) and the movable side wrap (53). The first flat plate (51) is formed integrally with the movable side wrap (53), as in the first embodiment. In other words, the movable scroll (50) is constructed in the same way that a movable scroll of a commonly-used scroll compressor is constructed.

In the second flat plate (52) of the stationary scroll (40), its front surface (the lower one in FIG. 24) forms a sliding surface against which the tip of the movable side wrap (53) slides. Stated another way, the sliding surface of the second flat plate (52) with respect to the movable side wrap (53) is a mere planar surface. The compression chamber (60) is comparted by the second flat plate (52) and stationary side wrap (41) of the stationary scroll (40) and the first flat plate (51) and movable side wrap (53) of the movable scroll (50).

Additionally, also in the scroll compressor (10) of the present embodiment the hydraulic pressure of refrigerating machine oil acts on the lower surface of the collar portion (65) in the bearing portion (64), as in the first embodiment. The movable scroll (50) is moved upward by the hydraulic pressure acting on the collar portion (65). In other words, a force for pressing the first flat plate (51) against the stationary scroll (40) acts on the movable scroll (50).

As described above, in the compression mechanism (30) of the present embodiment the second flat plate (52) which comes into sliding contact with the movable side wrap (53) is formed as a separate body from the stationary side wrap (41). In the second flat plate (52) which is formed as a separate body from the stationary side wrap (41), its sliding surface with respect to the movable side wrap (53) is a mere planar surface. Consequently, in comparison with a commonly-used scroll compressor in which an equivalent to the second flat plate (52) is formed integrally with a stationary side wrap, it becomes extremely easy to machine the sliding surface of the second flat plate (52) with respect to the movable side wrap (53) with a high degree of accuracy.

Accordingly, the present embodiment makes it possible to finish the sliding surface of the second flat plate (52) to a low surface roughness without expending much time on the machining thereof and further ensures that the sliding surface of the second flat plate (52) is finished to a planar surface. As a result, the amount of refrigerant leaking through a gap between the second flat plate (52) and the movable side wrap (53) is reduced considerably without reducing the production efficiency of the scroll compressor (10), thereby improving the efficiency of the scroll compressor (10).

Further, in the compression mechanism (30) of the present embodiment the second flat plate (52) is formed as a separate body from the stationary side wrap (41) in the stationary scroll (40). This makes it possible to check a positional relationship between the stationary side wrap (41) and the movable side wrap (53) by visual check or by a clearance gauge and the like in a state prior to the assembling of the second flat plate portion (52), during the assembling of the scroll compressor (10). It is possible to check a gap between the stationary side wrap (41) and the movable side wrap (53) while turning the movable side wrap (53), and the stationary scroll (40) is secured firmly to the housing (31) at an optimum position. Accordingly, in accordance with the present embodiment the amount of refrigerant leaking from the compression chamber (60) is reduced by optimizing the alignment of the stationary side wrap (41) and the movable side wrap (53), thereby making it possible to improve the efficiency of the scroll compressor (10).

First Modification Example of Third Embodiment

In the scroll compressor (10) of the foregoing embodiment, a sliding plate may be sandwiched between the stationary side wrap (41) and the second flat plate (52). The sliding plate is a thin plate made of a material superior in abrasion resistance such as spring steel and constitutes a thing plate member. In the scroll compressor (10) of the present modification example, the tip of the movable side wrap (53) slides against the sliding plate. Since the sliding plate exhibits excellent resistance to abrasion, this ensures that the occurrence of trouble, such as abrasion and seizing, is prevented even in the tip of the movable side wrap (53) prone to deficiency in the amount of lubricant at startup or the like.

Second Modification Example of Third Embodiment

In the scroll compressor (10) of the foregoing embodiment, in the stationary scroll (40) the height of the outer peripheral portion (42) is equal to that of the stationary side wrap (41) (see FIG. 24). However, instead of employing such an arrangement the following arrangement may be used.

In other words, in the stationary scroll (40) the height of the outer peripheral portion (42) may be made somewhat greater than the height of the stationary side wrap (41). In the present modification example, the first flat plate (51) comes into sliding contact with the lower surface of the outer peripheral portion (42) even when the movable scroll (50) is located at its uppermost position, thereby ensuring that a clearance is always secured between the lower tip of the stationary side wrap (41) and the first flat plate (51).

Consequently, the tip of the stationary side wrap (41) is prevented from suffering damage from forceful frictional contact with the first flat plate (51) even when the stationary side wrap (41) undergoes some deformation due to the inner pressure of the fluid chamber (60) and heat. Further, the increase in frictional resistance by contact of the stationary side wrap (41) and the first flat plate (51) is avoidable.

Furthermore, in the present modification example a tip seal against which the first flat plate (51) slides may be mounted at the tip of the stationary side wrap (41). As described above, in the present modification example there is defined a gap between the tip of the stationary side wrap (41) and the first flat plate (51). This gap is sealed off by the tip seal.

Such provision of the tip seal makes it possible to seal off, after securing a clearance between the stationary side wrap (41) and the first flat plate (51), the gap. Accordingly, in accordance with the present modification example leakage of refrigerant through the gap between the stationary side wrap (41) and the first flat plate (51) is suppressed and the drop in the efficiency of the scroll compressor (10) is avoided, in addition to effects obtained by securing the clearance.

Third Modification Example of Third Embodiment

In the scroll compressor (10) of the foregoing embodiment, a sealant (not shown) may be sandwiched between the stationary side wrap (41) and the second flat plate (52) in the stationary scroll (40). As such a sealant (not shown), a rubber member or a gasket-like member may be used.

If the flatness of the tip surface of the stationary side wrap (41) and the flatness of the lower surface of the second flat plate (52) are inadequate, this gives rise to the possibility that there is created a gap between the stationary side wrap (41) and the second flat plate (52), even when the bolt (91)

is tightened. By contrast to this, for the case of the present modification example in which a sealant (not shown) is sandwiched between the stationary side wrap (41) and the second flat plate (52), a gap between the stationary side wrap (41) and the second flat plate (52) is sealed off with the sealant (not shown) without having to finish the tip surface of the stationary side wrap (41) and the lower surface of the second flat plate (52) with a high degree of accuracy. Accordingly, in accordance with the present modification example leakage of refrigerant through a gap between the stationary side wrap (41) and the second flat plate (52) is prevented without performing high accuracy machining on the stationary side wrap (41) and the second flat plate (52).

Other Embodiments of Invention

In the scroll compressor (10) of each of the foregoing embodiments, the stationary scroll (40) may be made of ceramic material. In this case, the stationary scroll (40) is formed of for example ceramics impregnated with copper and the finishing of the stationary scroll (40) is carried out only by polishing.

In the scroll compressor (10) of each of the foregoing embodiments, the stationary side wrap (41) is formed as a separate body from each of the first flat plate (51) and the second flat plate (52). Consequently, the stationary side wrap (41) is shaped like a cantilevered beam extending inwardly from the outer peripheral portion (42), which makes it difficult to secure the rigidity of the stationary side wrap (41). By contrast to this, if the stationary scroll (40) is made of ceramics as in the present modification example, this makes it possible to secure sufficiently the rigidity of the stationary side wrap (41) and to prevent the stationary side wrap (41) from undergoing excessive deformations.

In addition, even when both the stationary side wrap (41) and the movable side wrap (53) are formed of steal material, the same effects as the above are obtained by forming the stationary side wrap (41) by the use of a material whose Young's modulus is higher than the material of the movable side wrap (53). In other words, the use of a material of a high Young's modulus makes it possible to enhance the rigidity of the stationary side wrap (41) and to prevent the stationary side wrap (41) from undergoing excessive deformations.

Furthermore, each of the foregoing embodiments is directed to the scroll compressor (10) constructed by the scroll type fluid machine according to the present invention. However, the scroll type fluid machine may be applied to other than compressors. For example, the scroll type fluid machine may be disposed, as an expander, in a refrigerant circuit. In this case, high-pressure refrigerant is introduced into the scroll type fluid machine servings as an expander, after it liberated heat in a condenser or the like. A part of the internal energy of the high-pressure refrigerant is output, as rotation power, from the scroll type fluid machine serving as an expander.

INDUSTRIAL APPLICABILITY

As has been described above, the present invention is useful for scroll type fluid machinery that is utilized as a compressor and the like for refrigerating apparatus.

What is claimed is:

1. A scroll type fluid machine comprising:

a stationary scroll, a movable scroll, a rotation preventing mechanism for preventing rotation of said movable scroll, and a rotary shaft, said stationary scroll including a stationary side wrap, said movable scroll including a first flat plate portion which engages with an eccentric portion of said rotary shaft, a movable side wrap which is formed integrally with said first flat plate portion and which matingly engages with said stationary side wrap, and a second flat plate portion which is formed as a separate body from said first flat plate portion and said movable side wrap and which faces said first flat plate portion across said movable side wrap, said movable scroll being so constructed as to execute an orbital motion with said second flat plate portion coupled to said first flat plate portion or to said movable side wrap, and said stationary side wrap, said movable side wrap, said first flat plate portion, and said second flat plate portion together defining a fluid chamber.

2. A scroll type fluid machine comprising:

a stationary scroll, a movable scroll, a rotation preventing mechanism for preventing rotation of said movable scroll, and a rotary shaft, said stationary scroll including a stationary side wrap, said movable scroll including a first flat plate portion which engages with an eccentric portion of said rotary shaft, a movable side wrap which is formed as a separate body from said first flat plate portion and which matingly engages with said stationary side wrap, and a second flat plate portion which is formed integrally with said movable side wrap and which faces said first flat plate portion across said movable side wrap, said movable scroll being so constructed as to execute an orbital motion with said first flat plate portion coupled to said second flat plate portion or to said movable side wrap, and said stationary side wrap, said movable side wrap, said first flat plate portion, and said second flat plate portion together defining a fluid chamber.

3. A scroll type fluid machine comprising:

a stationary scroll, a movable scroll, a rotation preventing mechanism for preventing rotation of said movable scroll, and a rotary shaft, said stationary scroll including a stationary side wrap, said movable scroll including a first flat plate portion which engages with an eccentric portion of said rotary shaft, a movable side wrap which is formed as a separate body from said first flat plate portion and which matingly engages with said stationary side wrap, and a second flat plate portion which is formed as a separate body from said first flat plate portion and said movable side wrap and which faces said first flat plate portion across said movable side wrap, said movable scroll being so constructed as to execute an orbital motion with said first flat plate portion, said movable side wrap, and said second flat plate portion coupled to one another, and said stationary side wrap, said movable side wrap, said first flat plate portion, and said second flat plate portion together defining a fluid chamber.

4. The scroll type fluid machine of any one of claims 1–3, wherein said stationary scroll includes an outer peripheral portion which is formed integrally with said stationary side wrap and which encloses a periphery of said stationary side wrap, and said outer peripheral portion is greater in height than said stationary side wrap so that a gap is created between a tip of said stationary side wrap and either said first flat plate portion or said second flat plate portion.

5. The scroll type fluid machine of claim 4, wherein said tip of said stationary side wrap is provided with a tip seal against which either said first flat plate portion or said second flat plate portion slides.

6. The scroll type fluid machine of any one of claims 1–3, wherein said movable side wrap is greater in height than said stationary side wrap.

7. The scroll type fluid machine of claim 6, wherein a tip of said stationary side wrap is provided with a tip seal against which either said first flat plate portion or said second flat plate portion slides.

8. The scroll type fluid machine of any one of claims 1–3, wherein said stationary side wrap is so formed that a central portion of said stationary side wrap is smaller in height than an outer peripheral portion of said stationary side wrap.

9. The scroll type fluid machine of claim 8, wherein a tip of said stationary side wrap is provided with a tip seal against which either said first flat plate portion or said second flat plate portion slides.

10. The scroll type fluid machine of any one of claims 1–3, wherein a plurality of support post portions for maintaining spacing between said first flat plate portion and said second flat plate portion are provided outside said movable side wrap in said movable scroll.

11. The scroll type fluid machine of claim 10, wherein said plurality of support post portions are so formed as to be greater in height than said movable side wrap.

12. The scroll type fluid machine of claim 10, wherein said stationary scroll includes an outer peripheral portion which is formed integrally with said stationary side wrap and which encloses a periphery of said stationary side wrap, a plurality of guide apertures, into which said plurality of support post portions are inserted, are formed in said outer peripheral portion, and said plurality of guide apertures of said outer peripheral portion and said plurality of support post portions, which are inserted into said plurality of guide apertures to slide against side walls thereof, together constitute said rotation preventing mechanism for preventing rotation of said movable scroll.

13. The scroll type fluid machine of any one of claims 1–3, wherein said stationary side wrap is so formed that a thickness of a part of said stationary side wrap or an overall thickness of said stationary side wrap is greater than a thickness of said movable side wrap.

14. The scroll type fluid machine of any one of claims 1–3, wherein the Young's modulus of a material used to form said stationary side wrap is higher than the Young's modulus of a material used to form said movable side wrap.

15. The scroll type fluid machine of any one of claims 1–3, wherein said stationary scroll includes an outer peripheral portion which is formed integrally with said stationary side wrap and which encloses a periphery of said stationary side wrap, and an inner side surface of said outer peripheral portion is formed continuously with an inner side surface of said stationary side wrap so that said inner side surface of said outer peripheral portion comes into sliding contact with an outer side surface of said movable side wrap.

16. The scroll type fluid machine of claim 15, wherein said inner side surface of said outer peripheral portion is so formed as to be slidably contactable with a whole outer peripheralmost portion of said movable side wrap.

17. The scroll type fluid machine of any one of claims 1–3, wherein said first flat plate portion and said second flat plate portion are each formed into such a shape that a location of a center of gravity of said movable scroll lies on a central line of said eccentric portion.

18. The scroll type fluid machine of any one of claims 1–3, wherein said scroll type fluid machine further comprises a casing which is shaped like a hermetically sealed container for housing said stationary scroll, said movable scroll, said rotation preventing mechanism, and said rotary shaft, and said scroll type fluid machine is constructed such that a whole interior portion of said casing is placed in a low pressure state.

19. The scroll type fluid machine of any one of claims 1–3, wherein said scroll type fluid machine further comprises a casing which is shaped like a hermetically sealed container for housing said stationary scroll, said movable scroll, said rotation preventing mechanism, and said rotary shaft, and a low pressure chamber, which is placed in a low pressure state and in which at least said stationary scroll and said movable scroll are disposed, is defined in an interior portion of said casing.

20. The scroll type fluid machine of either claim 1 or claim 3, wherein said movable scroll further includes a thin plate member which is sandwiched between said movable side wrap and said second flat plate portion and which slides against a tip of said stationary side wrap.

21. The scroll type fluid machine of either claim 2 or claim 3, wherein said movable scroll further includes a thin plate member which is sandwiched between said movable side wrap and said first flat plate portion and which slides against a tip of said stationary side wrap.

22. The scroll type fluid machine of any one of claims 1–3, wherein said scroll type fluid machine is so constructed that a force for pressing either said first flat plate portion or said second flat plate portion against said stationary side wrap acts on said movable scroll.

23. The scroll type fluid machine of any one of claims 1–3, wherein a portion of said movable side wrap that extends from a central side end thereof for a given distance constitutes a low wall portion which is smaller in height than an outer peripheral side end of said movable side wrap, and said stationary side wrap of said stationary scroll is provided with a planar surface forming portion which is brought into sliding contact with a tip of said low wall portion to define said fluid chamber.

* * * * *